US005813465A

United States Patent [19]

Terrell et al.

[11] Patent Number: 5,813,465

[45] Date of Patent: Sep. 29, 1998

[54] APPARATUS FOR COMPLETING A SUBTERRANEAN WELL AND ASSOCIATED METHODS OF USING SAME

[75] Inventors: Jamie B. Terrell, Fort Worth; James M. Barker, Mansfield, both of Tex.

[73] Assignee: Halliburton Energy Services, Inc., Dallas, Tex.

[21] Appl. No.: 680,198

[22] Filed: Jul. 15, 1996

[51] Int. Cl.[6] ..... E21B 29/02; E21B 29/06

[52] U.S. Cl. ..... 166/298; 166/50; 166/55; 166/63

[58] Field of Search ..... 166/55, 63, 298, 166/297, 50, 117.6, 117.5; 175/77, 78, 424

[56] References Cited

U.S. PATENT DOCUMENTS

| | | | |
|---|---|---|---|
| 1,570,518 | 1/1926 | Mitchell . | |
| 1,589,399 | 6/1926 | Kinzbach . | |
| 1,804,819 | 5/1931 | Spencer, Jr. et al. . | |
| 1,812,880 | 7/1931 | Kinzbach et al. . | |
| 1,816,856 | 8/1931 | Kinzbach et al. . | |
| 1,835,227 | 12/1931 | Lane et al. . | |
| 1,866,087 | 7/1932 | Crowell . | |
| 1,869,759 | 8/1932 | Lynch . | |
| 2,014,805 | 9/1935 | Hinderliter | 255/1 |
| 2,065,896 | 12/1936 | Keever | 255/1 |
| 2,087,440 | 7/1937 | Merz | 43/81 |
| 2,101,185 | 12/1937 | Monroe | 255/1 |
| 2,102,055 | 12/1937 | Brauer | 255/1 |
| 2,103,622 | 12/1937 | Kinzbach | 255/1 |
| 2,105,721 | 1/1938 | Cutrer et al. | 255/1 |
| 2,105,722 | 1/1938 | Barrett et al. | 255/1 |
| 2,132,061 | 10/1938 | Walker | 255/1 |

(List continued on next page.)

FOREIGN PATENT DOCUMENTS

| | | | |
|---|---|---|---|
| 40168 | 6/1992 | Australia . | |
| 574326 | 12/1993 | European Pat. Off. . | |
| 3832715 | 3/1990 | Germany . | |
| 262040 | 1/1971 | Russian Federation . | |
| 878894 | 11/1981 | Russian Federation . | |
| 1537793 | 1/1990 | Russian Federation | 166/55.2 |
| 9302504 | 2/1993 | WIPO . | |

OTHER PUBLICATIONS

"General Catalog 68–69", A–1 Bit & Tool Co., p. 136.

"Who Has Mills That Are Diamond Tough", Homco, 1974; 4 pgs.

"Kinzbach Tool Co., Inc. Catalog 1958–59", Kinzbach Tool Company, Inc., 1958; see pp. 3–5 particularly.

"Dual Horizontal Extension Drilled Using Retrievable Whipstock", Cress et al, World oil, Jun. 1993, 5 pages.

"Casing Whipstocks", Eastman Whipstock, Composite Catalog, p. 2226, 1976–77.

"Bowen Whipstocks", Bowen Oil Tools, Composite Catalog, one page, 1962–63.

"Improved Casing Sidetrack Procedure Now Cuts Wider, Larger Windows", Cagle, et al., Petroleum Engineering International, Mar., 1979; pp. 60–70.

"Weatherford Fishing and Rental Tool Services", Weatherford International Inc.; 1993; 4 pgs.

A–1 Bit & Tool Company 1990–91 General Catalog, pp. 8 and 14.

(List continued on next page.)

*Primary Examiner*—Hoang C. Dang

*Attorney, Agent, or Firm*—William M. Imwalle; Paul I. Herman; Marlin R. Smith

[57] ABSTRACT

Apparatus and associated methods of using the apparatus provide ease forming an opening from a first wellbore to a second wellbore, the first wellbore having a portion thereof which intersects the second wellbore. In a preferred embodiment, an apparatus has a cutting device disposed within a housing and a series of spaced apart nozzles directed radially outward from the housing. In another preferred embodiment, the apparatus is axially, rotationally, and radially alignable relative to the liner of the first wellbore. The cutting device is connected to the nozzles. The nozzles direct a discharge from the cutting device radially outward to cut into the tubular structure.

11 Claims, 28 Drawing Sheets

U.S. PATENT DOCUMENTS

| | | | |
|---|---|---|---|
| 2,158,329 | 5/1939 | Kinzback | 255/1 |
| 2,170,284 | 8/1939 | Eastman | 255/1 |
| 2,207,920 | 7/1940 | Hughes | 255/1 |
| 2,227,347 | 12/1940 | Johnson | 255/1 |
| 2,258,001 | 10/1941 | Chamberlain | 255/1 |
| 2,298,706 | 10/1942 | Kothny | 255/1 |
| 2,324,682 | 7/1943 | DeLong | 255/1.4 |
| 2,331,293 | 10/1943 | Ballard | 255/1.6 |
| 2,338,788 | 1/1944 | Walker | 255/1.6 |
| 2,362,529 | 11/1944 | Barrett et al. | 255/1.6 |
| 2,445,100 | 7/1948 | Wright | 255/1.6 |
| 2,495,439 | 1/1950 | Brimble | 255/1.4 |
| 2,509,144 | 5/1950 | Grable et al. | 255/1.6 |
| 2,539,047 | 1/1951 | Arutunoff | 175/78 X |
| 2,567,507 | 9/1951 | Brown | 255/1.6 |
| 2,586,878 | 2/1952 | Staton | 255/1.6 |
| 2,633,331 | 3/1953 | Hampton | 255/1.6 |
| 2,633,682 | 4/1953 | Jackson | 51/20 |
| 2,638,320 | 5/1953 | Condra | 255/1 |
| 2,664,162 | 12/1953 | Howard et al. | 116/1 |
| 2,685,431 | 8/1954 | James | 255/1.6 |
| 2,699,920 | 1/1955 | Zublin | 255/1.6 |
| 2,770,444 | 11/1956 | Neal | 255/1.6 |
| 2,797,893 | 7/1957 | McCune et al. | 255/1.6 |
| 2,882,015 | 4/1959 | Beck | 255/1.6 |
| 2,885,182 | 5/1959 | Hering | 255/1.6 |
| 2,950,900 | 8/1960 | Wynes | 255/1.6 |
| 3,000,440 | 9/1961 | Malcomb | 166/4 |
| 3,075,583 | 1/1963 | Nielsen et al. | 166/117.5 |
| 3,095,039 | 6/1963 | Kinzbach | 166/117.6 |
| 3,096,824 | 7/1963 | Brown | 166/210 |
| 3,116,799 | 1/1964 | Lemons | 175/61 |
| 3,172,488 | 3/1965 | Roxstrom | 175/81 |
| 3,318,395 | 5/1967 | Messmer | 166/223 |
| 3,477,524 | 11/1969 | Marks, Jr. | 175/82 |
| 3,667,252 | 6/1972 | Nelson | 64/23.5 |
| 3,908,759 | 9/1975 | Cagle et al. | 166/117.6 |
| 4,007,797 | 2/1977 | Jeter | 175/26 |
| 4,153,109 | 5/1979 | Szescila | 166/250 |
| 4,266,621 | 5/1981 | Brock | 175/329 |
| 4,285,399 | 8/1981 | Holland et al. | 166/113 |
| 4,304,299 | 12/1981 | Holland et al. | 166/255 |
| 4,307,780 | 12/1981 | Curington | 166/113 |
| 4,352,397 | 10/1982 | Christopher | 166/297 |
| 4,397,360 | 8/1983 | Schmidt | 175/61 |
| 4,429,741 | 2/1984 | Hyland | 166/63 |
| 4,431,053 | 2/1984 | Morrow | 166/117.5 |
| 4,446,920 | 5/1984 | Woytek et al. | 166/297 |
| 4,450,912 | 5/1984 | Callihan et al. | 166/289 |
| 4,491,178 | 1/1985 | Terrell et al. | 166/192 |
| 4,550,781 | 11/1985 | Kagler, Jr. | 166/340 |
| 4,646,826 | 3/1987 | Bailey et al. | 166/55.3 |
| 4,665,995 | 5/1987 | Braithwaite et al. | 175/45 |
| 4,699,224 | 10/1987 | Burton | 175/61 |
| 4,717,290 | 1/1988 | Reynolds et al. | 407/34 |
| 4,733,732 | 3/1988 | Lynch | 175/9 |
| 4,765,404 | 8/1988 | Bailey et al. | 166/117.6 |
| 4,796,709 | 1/1989 | Lynde et al. | 166/55.6 |
| 4,800,966 | 1/1989 | Parant et al. | 175/73 |
| 4,807,704 | 2/1989 | Hsu et al. | 166/313 |
| 4,844,167 | 7/1989 | Clark | 175/4.53 |
| 4,887,668 | 12/1989 | Lynde et al. | 166/55.8 |
| 4,938,291 | 7/1990 | Lynde et al. | 116/55.8 |
| 4,978,260 | 12/1990 | Lynde et al. | 166/55.6 |
| 4,984,488 | 1/1991 | Lunde et al. | 76/115 |
| 5,014,778 | 5/1991 | Lynde et al. | 166/55.6 |
| 5,035,292 | 7/1991 | Bailey et al. | 175/45 |
| 5,038,859 | 8/1991 | Lynde et al. | 166/55.6 |
| 5,086,838 | 2/1992 | Cassel et al. | 166/55.6 |
| 5,109,924 | 5/1992 | Jurgens et al. | 166/117.5 |
| 5,113,938 | 5/1992 | Clayton | 166/117.6 |
| 5,115,872 | 5/1992 | Brunet et al. | 175/61 |
| 5,154,231 | 10/1992 | Bailey et al. | 166/298 |
| 5,163,522 | 11/1992 | Eaton et al. | 175/58 |
| 5,181,564 | 1/1993 | Lindley et al. | 166/55.6 |
| 5,188,190 | 2/1993 | Skaalure | 175/58 |
| 5,195,591 | 3/1993 | Blount et al. | 166/380 |
| 5,199,513 | 4/1993 | Stewart et al. | 175/73 |
| 5,211,715 | 5/1993 | Braden et al. | 175/58 |
| 5,222,554 | 6/1993 | Blount et al. | 166/117.6 |
| 5,253,710 | 10/1993 | Carter et al. | 166/298 |
| 5,265,675 | 11/1993 | Hearn et al. | 166/297 |
| 5,277,251 | 1/1994 | Blount et al. | 166/117.5 |
| 5,287,920 | 2/1994 | Terrell | 166/55 |
| 5,287,921 | 2/1994 | Blount et al. | 166/117.6 |
| 5,287,922 | 2/1994 | Bridges | 166/277 |
| 5,297,630 | 3/1994 | Lynde et al. | 166/297 |
| 5,311,936 | 5/1994 | McNair et al. . | |
| 5,318,121 | 6/1994 | Brockman et al. | 166/313 |
| 5,318,122 | 6/1994 | Murray et al. | 166/313 |
| 5,322,127 | 6/1994 | McNair et al. | 166/313 |
| 5,325,924 | 7/1994 | Bangert et al. | 166/313 |
| 5,335,737 | 8/1994 | Baugh | 175/61 |
| 5,341,873 | 8/1994 | Carter et al. | 166/117.5 |
| 5,346,017 | 9/1994 | Blount et al. | 166/380 |
| 5,353,876 | 10/1994 | Curington et al. | 166/313 |
| 5,373,900 | 12/1994 | Lynde et al. | 166/297 |
| 5,379,845 | 1/1995 | Blount et al. | 166/382 |
| 5,388,648 | 2/1995 | Jordan, Jr. | 166/380 |
| 5,398,754 | 3/1995 | Dinhoble | 166/117.6 |
| 5,409,060 | 4/1995 | Carter | 166/237 |
| 5,411,082 | 5/1995 | Kennedy | 166/181 |
| 5,425,417 | 6/1995 | Carter | 166/117.6 |
| 5,427,177 | 6/1995 | Jordan, Jr. et al. | 166/50 |
| 5,429,187 | 7/1995 | Beagrie et al. | 166/55.1 |
| 5,431,223 | 7/1995 | Konopczynski | 166/117.5 |
| 5,435,392 | 7/1995 | Kennedy | 166/344 |
| 5,435,400 | 7/1995 | Smith | 175/61 |
| 5,439,051 | 8/1995 | Kennedy et al. | 166/50 |
| 5,452,759 | 9/1995 | Carter et al. | 166/117.6 |
| 5,454,430 | 10/1995 | Kennedy et al. | 166/50 |
| 5,456,312 | 10/1995 | Lynde et al. | 166/55.6 |
| 5,458,199 | 10/1995 | Collins et al. | 166/313 |
| 5,458,209 | 10/1995 | Hayes et al. | 175/61 |
| 5,462,120 | 10/1995 | Gondouin | 166/380 |
| 5,472,048 | 12/1995 | Kennedy et al. | 166/50 |
| 5,474,131 | 12/1995 | Jordan, Jr. et al. | 166/313 |
| 5,477,923 | 12/1995 | Jordan, Jr. et al. | 166/313 |
| 5,477,925 | 12/1995 | Trahan et al. | 166/382 |
| 5,479,986 | 1/1996 | Gano et al. | 166/292 |
| 5,499,680 | 3/1996 | Walter et al. | 166/377 |
| 5,499,681 | 3/1996 | White et al. | 166/382 |
| 5,544,704 | 8/1996 | Laurel et al. | 166/117.6 |
| 5,551,509 | 9/1996 | Braddick | 166/55.7 |
| 5,560,435 | 10/1996 | Sharp | 175/5 |
| 5,564,503 | 10/1996 | Longbottom et al. | 166/313 |
| 5,566,757 | 10/1996 | Carpenter et al. | 166/285 |
| 5,566,763 | 10/1996 | Williamson et al. | 166/382 |
| 5,575,331 | 11/1996 | Terrell | 166/55 |
| 5,595,247 | 1/1997 | Braddick | 166/297 |
| 5,613,559 | 3/1997 | Williamson et al. | 166/381 |
| 5,615,740 | 4/1997 | Comeau et al. | 166/380 |

OTHER PUBLICATIONS

Frank's, "The Submudline Drivepipe Whipstock", Patent #4,733,732; 4 pgs.

International Search Report, PCT/EP94/02589, counterpart of this application Ser. No. 08/210,697.

International Search Report 2nd, PCT/EP94/02589, counterpart of this application Ser. No. 08/210,697.

USPTO Official Gazette entry, Oct. 26, 1993, p. 2356 for U.S. Patent 5,255,746.
TIW SS–WS Whipstock Packer Information, Texas Iron Works, 1987.
TIW Window Cutting Products & Services, TIW Corp., 1994; 6 pgs.
World Oil, Feb. 1, 1955, 1 page.

APPARATUS FOR COMPLETING A SUBTERRANEAN WELL AND ASSOCIATED METHODS OF USING SAME

BACKGROUND OF THE INVENTION

The present invention relates generally to the art of completing subterranean wells having lateral bores extending from parent bores thereof and, in a preferred embodiment thereof, more particularly provides apparatus for reentering the parent bores after the lateral bores have been cased and associated methods.

It is well known in the art of drilling subterranean wells to form a parent bore into the earth and then to form one or more bores extending laterally therefrom. Generally, the parent bore is first cased and cemented, and then a tool known as a whipstock is positioned in the parent bore casing. The whipstock is specially configured to deflect milling bits and drill bits in a desired direction for forming a lateral bore. A mill, otherwise referred to as a cutting tool, is lowered into the parent bore suspended from drill pipe and is radially outwardly deflected by the whipstock to mill a window in the parent bore casing and cement. Directional drilling techniques may then be employed to direct further drilling of the lateral bore as desired.

The lateral bore is then cased by inserting a tubular liner from the parent bore, through the window previously cut in the parent bore casing and cement, and into the lateral bore. In a typical lateral bore casing operation, the liner extends somewhat upwardly into the parent bore casing and through the window when the casing operation is finished. In this way, an overlap is achieved wherein the lateral bore liner is received in the parent bore casing above the window.

The lateral bore liner is then cemented in place by forcing cement between the liner and the lateral bore. The cement is typically also forced between the liner and the window, and between the liner and the parent bore casing where they overlap. The cement provides a seal between the liner, the parent bore casing, the window, and the lateral bore.

It will be readily appreciated that because the liner overlaps the parent bore casing above the window, extends radially outward through the window, and is cemented in place, that access to the parent bore below the liner is prevented at this point. In order to gain access to the parent bore below the liner, an opening must be provided through the liner. However, since the liner is extending radially outward and downward from the parent bore, cutting an opening into the sloping inner surface of the liner is a difficult proposition at best. Furthermore, it is desirable to obtain "full-bore access" to the parent wellbore below the liner so that the same-sized tools can be diverted into either the lateral wellbore, the parent wellbore below the liner, or any other equivalent-bore lateral wellbore extending from the parent wellbore.

Several apparatus and methods for cutting the opening through the liner to gain access to the lower portion of the parent bore have been devised. Each of these, however, have one or more disadvantages which make their use inconvenient or uneconomical. Some of these disadvantages include inaccurate positioning and orienting of the opening to be cut, complexity in setting and releasing portions of the apparatus, and danger of leaving portions of the apparatus in the well necessitating a subsequent fishing operation. Furthermore, none of the prior art teaches apparatus or a method of obtaining full-bore access to (1) the parent wellbore below the intersection of the parent and lateral wellbores and (2) all equivalent-bore lateral wellbores extending from the parent wellbore.

From the foregoing, it can be seen that it would be quite desirable to provide apparatus for gaining access to the lower portion of the parent wellbore which is convenient and economical to use, which provides accurate positioning and orienting of the opening to be cut, which is not complex to set and release, and which reduces the danger of leaving portions of the apparatus in the well. Furthermore, it is desirable to establish full-bore access to the parent wellbore below the intersection of the parent and the lateral wellbores. It is accordingly an object of the present invention to provide such apparatus and associated methods of completing a subterranean well.

SUMMARY OF THE INVENTION

In carrying out the principles of the present invention, in accordance with an embodiment thereof, apparatus is provided which is a cutting device connected to a nozzle manifold. The nozzle manifold may have a plurality of nozzles formed thereon and the cutting device may include a plurality of thermal cutters. Methods of using the apparatus are also provided.

In broad terms, apparatus for forming an opening from a first wellbore to a second wellbore is provided. The first wellbore has an intersecting portion thereof, which intersects the second wellbore. The first wellbore is lined with a protective liner, the first wellbore protective liner extending at least partially axially within the second wellbore. The first wellbore protective liner has an intersecting portion thereof which extends laterally across the second wellbore proximate the intersecting portion of the first wellbore.

The apparatus includes a housing, a cutting device, and a nozzle connected to the cutting device, the nozzle being radially outwardly directed relative to the housing.

The housing is generally tubular and is conveyable within the tubular structure. The cutting device is disposed within the housing. The nozzle is connected to the cutting device and is radially outwardly directed relative to the housing, toward the intersecting portion of the first wellbore protective liner.

In addition, apparatus for forming an opening from a first wellbore to a second wellbore is provided. The first wellbore has a portion thereof which intersects the second wellbore. The first wellbore is lined with a protective liner, a portion of the liner extending laterally across the second wellbore. The apparatus includes a nozzle manifold and a cutting device.

The nozzle manifold is axially, radially and rotationally alignable with the liner portion and has at least one nozzle therein. The nozzle is directable radially outward toward the liner portion.

The cutting device is connected to the nozzle manifold. It is capable of discharging through the nozzle manifold, thereby forming the opening through the liner portion.

Furthermore, a method of forming an opening through a tubular structure in a subterranean well is also provided. The method includes the steps of providing an apparatus having a cutting device disposed therein and a series of spaced apart nozzles radially outwardly directed therefrom, the cutting device being connected to the nozzles; positioning the apparatus within the tubular structure; activating the cutting device; and cutting into the tubular structure.

The use of the disclosed apparatus and associated methods permits convenient and economical forming of openings through tubular structures in subterranean wells. In one aspect of the present invention, an opening's shape may be determined by the shape of a two-dimensional array of nozzles disposed on the apparatus.

DETAILED DESCRIPTION

Figure 1:
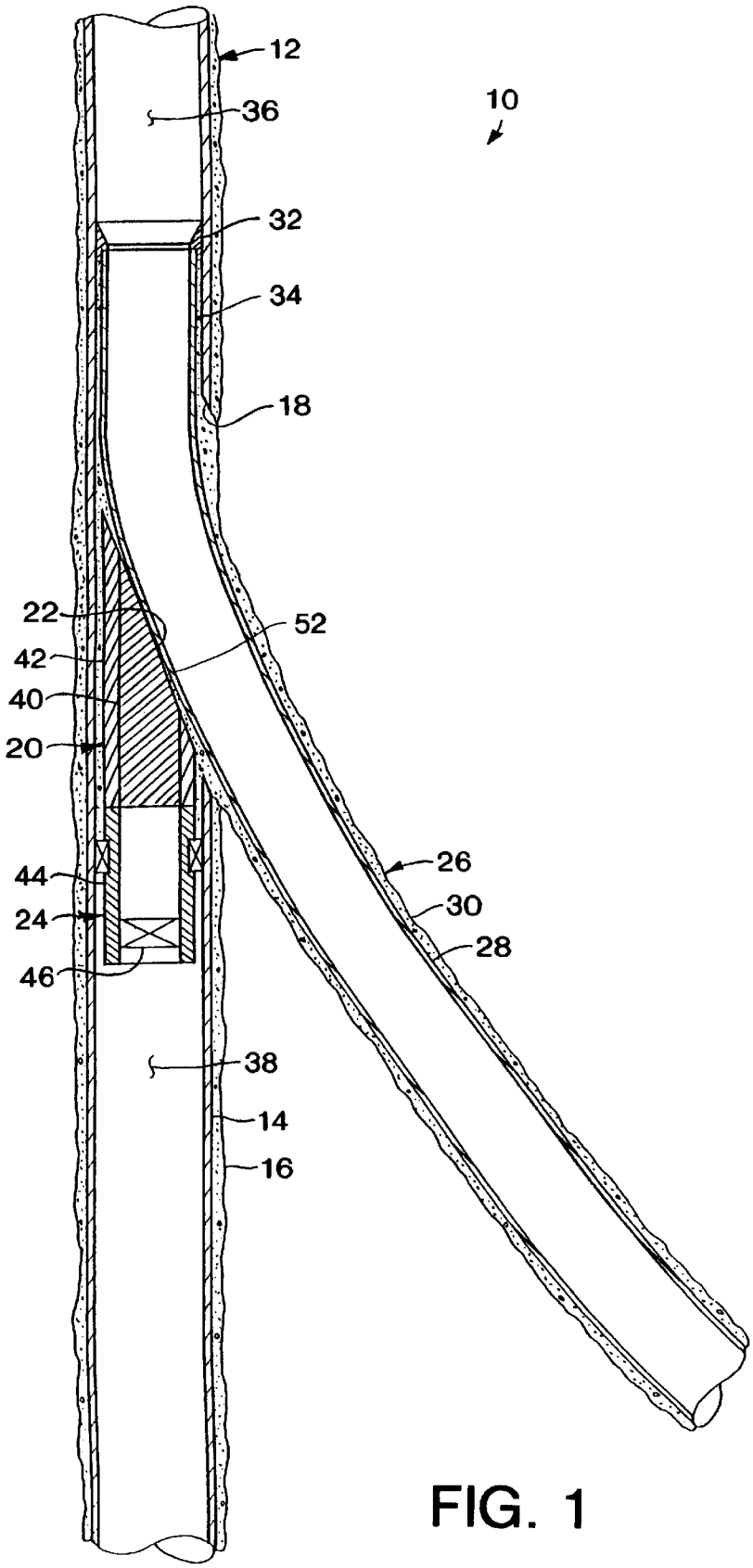
FIG. 1 is a cross-sectional view through a subterranean well showing a parent wellbore and a lateral wellbore, and an overlap therebetween.

Representatively illustrated in FIG. 1 is a method 10 which embodies principles of the present invention. In the following detailed descriptions of the embodiments of the present invention representatively illustrated in the accompanying figures, directional terms, such as "upper", "lower", "upward", "downward", etc., are used in relation to the illustrated embodiments as they are depicted in the accompanying figures, the upward direction being toward the top of the corresponding figure, and the downward direction being toward the bottom of the corresponding figure. It is to be understood that the embodiments may be utilized in vertical, horizontal, inverted, or inclined orientations without deviating from the principles of the present invention. It is also to be understood that the embodiments are schematically represented in the accompanying figures.

The term "axial" is used to define a direction along either a particular wellbore, a tool used in a wellbore, or a tubular found in a wellbore. The term "lateral wellbore" is accepted in the industry and used herein as meaning a wellbore diverging from the parent or primary wellbore. The terms "radial" and "lateral" (without application to the term "lateral wellbore") are used to define a direction normal or perpendicular to an axial direction. The terms "rotational alignment," "rotationally aligned," "rotational orientation," and "rotationally oriented" are used to designate or describe the position of a feature or tool relative to a known downhole direction, such as the high side of the wellbore or a particular azimuthal direction.

It is to be understood that milling bits and mills are typically used to cut steel or other metallic material, such as that found in casing or downhole tools. Generally, milling bits and mills are used to cut axially and/or radially. Furthermore, drilling bits and drills are commonly used to drill, cut, or remove cement and/or the earth's formation from a wellbore. Drilling bits are typically used to cut on the face of the drill in an axial direction. However, milling bits and mills can be used to cut the earth's formation and cement, while drilling bits can be used to cut steel and other metallic material.

It is to be understood that the terms "milling bit", "mill", "drilling bit", and "drill" are all types of cutting tools and are used herein interchangeably. It is also to be understood that the terms (verbs) "mill", "drill", "milled", "drilled", "milling" and "drilling" all refer to a cutting action and can be used interchangeably. It is to be understood that a "pilot mill" or a "pilot drill" is typically a cutting tool that is used to cut, mill, drill, or remove an initial bore within, or portion of, the earth's formation, cement, a tubular, a downhole tool; the initial bore, or portion, that is removed can then be used to guide a subsequent milling or drilling operation.

Furthermore, while a particular method or apparatus set forth herein may refer to, or be described as using or including, either a mill, milling bit, drill, drilling bit, or a particular type of mill or drill, it is to be understood that one skilled in the art can vary the particular cutting tool without deviating from the principles of the present invention. Furthermore, while a particular method or apparatus set forth herein may refer to, or be described as using or including, a single cutting tool or multiple cutting tools, it is to be understood that one skilled in the art can vary the number of cutting tools used in a particular method or apparatus without deviating from the principles of the present invention. For instance, a pilot mill or pilot drill might be used in conjunction with additional cutting tools in a single assembly to complete a milling operation in a single trip. It is further contemplated that a single cutting tool may be used to accomplish the entire milling operation, or multiple trips into the wellbore using different combinations of cutting tools may be necessary to accomplish the milling operation.

FIG. 1 shows a first-drilled, or "parent", wellbore 12 which is generally vertically formed in the earth. The parent wellbore 12 is lined with generally tubular and vertically disposed casing 14. Cement 16 fills an annular area radially between the casing 14 and the earth.

The parent wellbore 12 has a window 18 formed through the casing 14 and the cement 16. The window 18 is the result of an operation in which a whipstock 20 having an upper laterally inclined face 22 is positioned above a packer 24 set in the casing 14. The whipstock 20 is oriented so that the upper face 22 is downwardly inclined in a desired direction for drilling a lateral wellbore 26. An appropriate milling bit (not shown) is lowered into the parent wellbore 12 and biased against the upper face 22, thereby forcing the milling bit to deflect in the desired direction to form the window 18 through the casing 14 and the cement 16.

The whipstock 20 may have a relatively easily milled central core 40 radially outwardly surrounded by a relatively hard to mill outer tubular case 42. The packer 24 grippingly engages the casing 14 and may have a generally tubular body 44 with a relatively easily milled or retrievable plug member 46 sealingly disposed therein. The packer 24 may be oriented within the casing 14 by, for example, use of a conventional gyroscope and may include a means of engaging the whipstock 20, so that, after the packer 24 has been oriented and set in the casing 14, the whipstock 20 may be oriented by engaging the whipstock with the packer 24.

The lateral wellbore 26 is formed by passing one or more drill bits (not shown) through the window 18 and drilling into the earth. When the desired depth, length, etc. of the lateral wellbore 26 is achieved, a generally tubular liner 28 is inserted into the casing 14, lowered through the parent wellbore 12, deflected radially outward through the window 18 by the whipstock 20, and positioned appropriately within the lateral wellbore 26. The liner 28 is secured against displacement relative to the casing 14 by a conventional liner hanger 32. The liner hanger 32 is attached to the liner 28 and grippingly engages the casing 14. The liner 28 is then sealed to the casing 14, lateral wellbore 26, and parent wellbore 12 by forcing cement 30 therebetween.

It may be readily seen that an upper portion 34 of the liner 28 radially inwardly overlaps the casing 14 above the window 18. In this manner fluid, tools, tubing, and other equipment (not shown) may be conveyed downward from the earth's surface, through an upper portion 36 of the parent wellbore 12, into the upper portion 34 of the liner 28, and thence through the window 18 and into the lateral wellbore 26. The lateral wellbore 26 portion of the subterranean well may, thus, be completed (i.e., perforated, stimulated, gravel packed, etc.).

Figure 8:
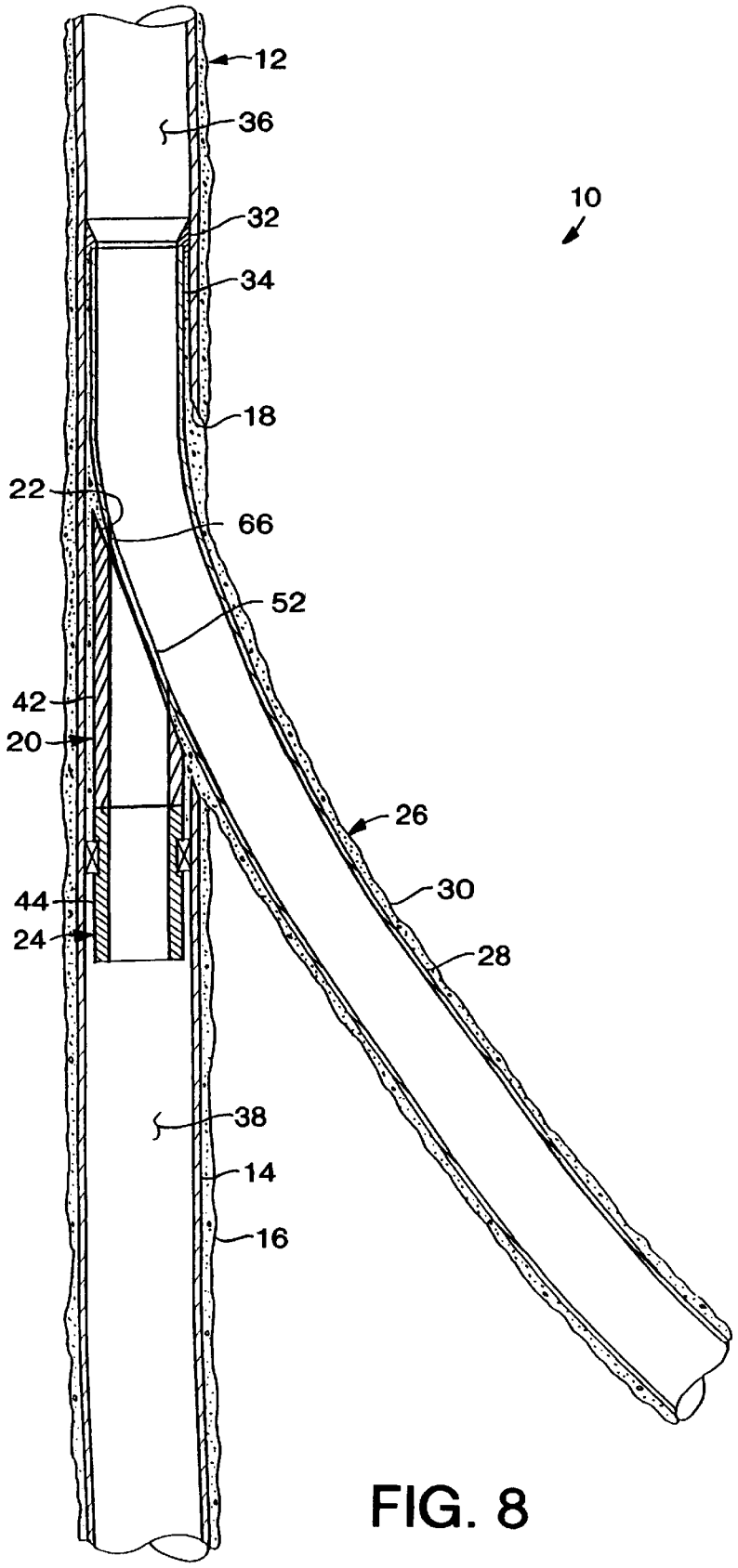
FIG. 8 is a cross-sectional view through the subterranean well of FIG. 1 illustrating the first method wherein the opening is enlarged and access is provided to the parent wellbore below the intersection.

It will be readily apparent to one of ordinary skill in the art that, as shown in FIG. 1, the liner 28, whipstock 20, and packer 24 effectively isolate the upper portion 36 from a lower portion 38 of the parent wellbore 12. Where it is desired to gain reentry to the lower portion 38 of the parent wellbore 12 from the upper portion 36, an opening must be formed through the liner 28 at liner portion 52, whipstock 20, and packer 24. In this respect, the present invention allows for complete reentry or access into the parent wellbore 12 below the intersection of the lateral wellbore 26 and the parent wellbore 12. This "reentry path" provides an access or path for the passage of tools as well as the flow of fluids between the upper portion 36 and the lower portion 38 of the parent wellbore 12. This reentry path (as shown in FIG. 8), which extends from the upper portion 36 of the parent wellbore 12, down through the opening in the liner 28 of the lateral wellbore 26, through the whipstock 20, and through the packer 24, has an inner diameter that approaches the drift diameter of the liner of the lateral wellbore located above the intersection of the parent and lateral wellbores. It is important for this reentry path to have an inner diameter that is large enough to allow the passage of tools into the parent wellbore below the intersection, including, but not limited to, monitoring, pressure control, reworking, and stimulating tools. Thus, upon completion of the reentry path at the intersection of the parent wellbore and a lateral wellbore, the parent wellbore and that lateral wellbore have "equivalent" inner diameters for full-bore access of downhole tools.

It is further contemplated that more than one lateral wellbore (not shown) can be directed from a portion of the parent wellbore having a particular diameter casing, each lateral wellbore being cased by an internal liner having the same inner diameter. The lateral wellbores are generally, successively completed starting from the downhole side of the portion of the parent wellbore. After a particular lateral wellbore is completed, as described above, then a new lateral wellbore can be extended from the parent wellbore at a location above the previously-completed wellbore. Once each lateral wellbore extending from the parent wellbore is completed, the operator would have full-bore access for the passage of the same-sized downhole tools to any equivalent-bore lateral wellbore or the parent wellbore.

If the packer 24 does not include a plug member 46 and the whipstock 20 does not include a central core 40, to establish a reentry path an opening must only be formed through the liner 28 and any cement, or other material used in setting the liner, that may be deposited in the parent wellbore.

Figure 2:
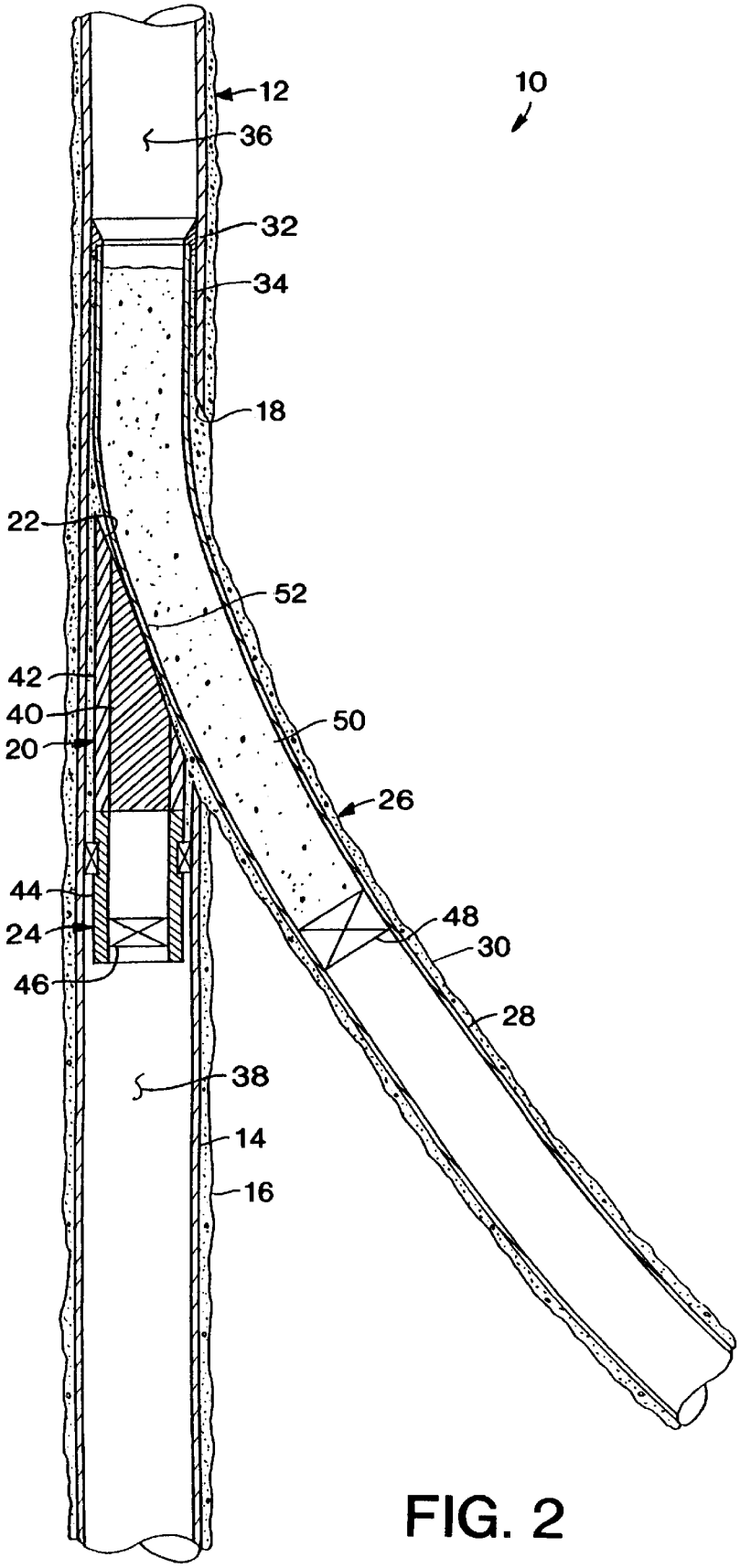
FIG. 2 is a cross-sectional view through the subterranean well of FIG. 1 illustrating a first method of providing access to a lower portion of the parent wellbore wherein cement has been deposited across an intersection of the lateral and parent wellbores, the method embodying principles of the present invention.

Referring additionally now to FIG. 2, a conventional plug 48 is set in the liner 28 below the whipstock 20. Cement 50 is then deposited above the plug 48 by, for example, forcing the cement through coiled tubing or drill pipe (not shown). It is not necessary for the cement 50 to completely fill the upper portion 34 of the liner 28, but it is desirable for the cement to extend axially upward from the whipstock 20 into the upper portion 34, for reasons that will become apparent upon consideration of the further description of the method 10 hereinbelow.

Note that a portion 52 of the liner 28 overlies the upper face 22 of the whipstock 20. It is desirable for the cement 50 to extend at least past the portion 52 of the liner 28. The cement 50 provides lateral support for forming an opening through the portion 52 in a manner that will be more fully described hereinbelow. Thus, techniques of depositing the cement 50 across the portion 52 of the liner 28 other than that representatively illustrated in FIG. 2 may be utilized without departing from the principles of the present invention.

Figure 3:
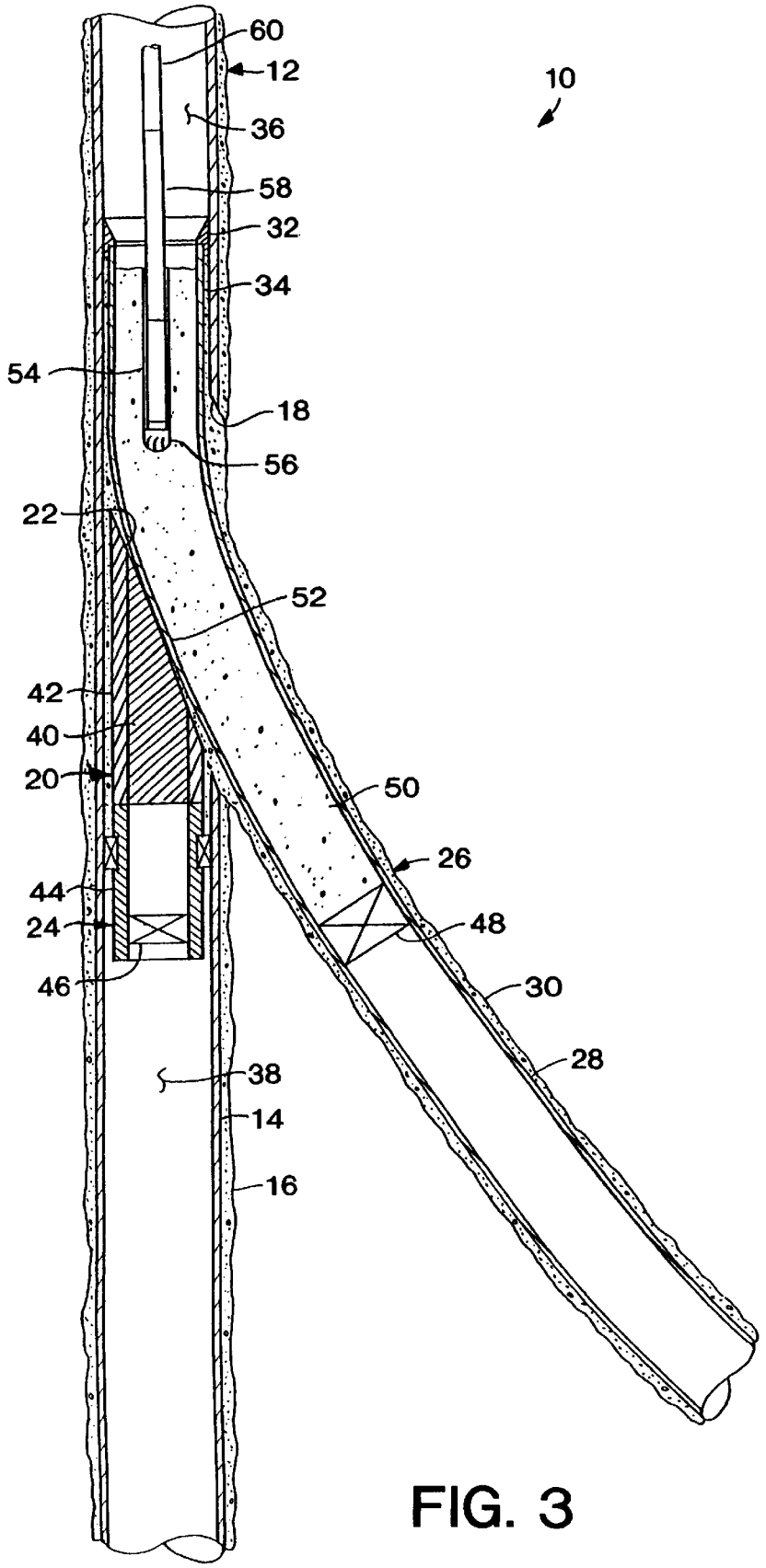
FIG. 3 is a cross-sectional view through the subterranean well of FIG. 1 illustrating the first method wherein an initial bore is drilled into the cement deposited across the intersection.

Referring additionally now to FIG. 3, an initial bore 54 is shown being formed axially downward into the cement 50 in the upper portion 34 of the liner 28. The initial bore 54 is formed by a drill bit, or casing/cement mill, 56 which is powered by a conventional mud motor 58. The motor 58 is suspended from coiled tubing or drill pipe 60 which extends to the earth's surface. It is to be understood that other means may be utilized to form the initial bore 54, such as a drill bit or jet drill suspended from drill pipe, and other additional equipment, such as stabilizers, may be utilized without departing from the principles of the present invention.

Preferably, the initial bore 54 is centered in the upper portion 34 of the liner 28 and the initial bore is straight. In this manner, the initial bore 54 may be used as a convenient reference for later milling therethrough. However, it is to be understood that the initial bore 54 may be offset within the upper portion 34 and may be otherwise directed without departing from the principles of the present invention.

Figure 4:
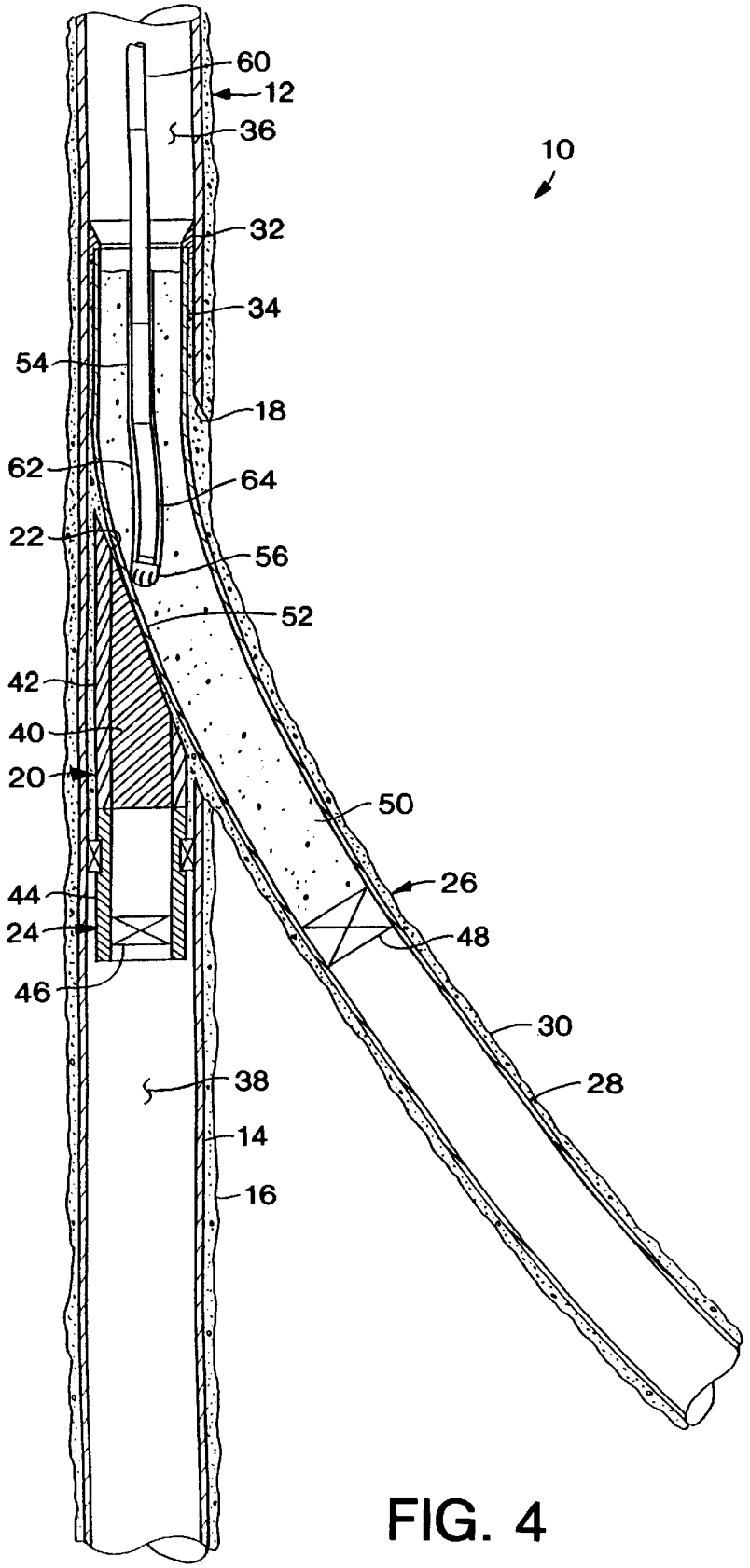
FIG. 4 is a cross-sectional view through the subterranean well of FIG. 1 illustrating the first method wherein a deviated bore is drilled toward a whipstock positioned in the lower portion of the parent wellbore.

Referring additionally now to FIG. 4, it may be seen that a curved bore 62 is formed axially downward from the initial bore 54 by a conventional bent motor housing 64 which is operatively connected between the coiled tubing 60 and the mill 56. The curved bore 62 is directed by the bent motor housing 64 toward the liner portion 52. In this manner, the mill 56 is made to contact the liner portion 52, the bent motor housing 64 creating a side load to force the mill 56 into contact with the liner portion 52, and the cement 50 providing lateral support for the mill 56, which enables the mill 56 to effectively penetrate the liner portion 52 with reduced downward "skidding" along the liner portion 52 inner surface.

Techniques for drilling curved holes in cement utilizing bent motor housings on coiled tubing are discussed in a Society of Petroleum Engineers paper no. 30486 (1995), which is hereby incorporated by reference.

Figure 9:
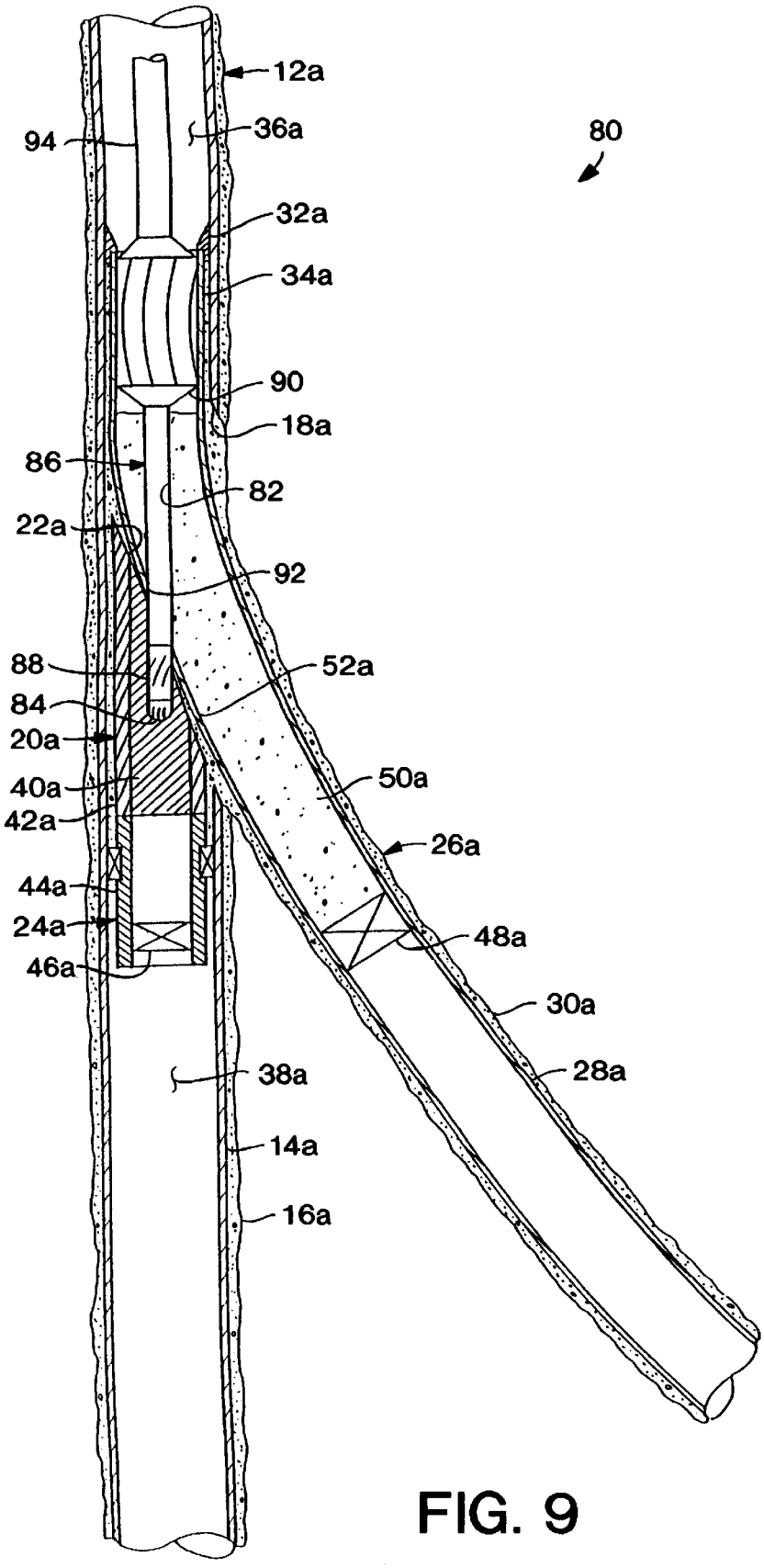
FIG. 9 is a cross-sectional view through a subterranean well illustrating a second method of providing access to a lower portion of a parent wellbore, the method embodying principles of the present invention.

The cement 50 acts to stabilize the mill 56 by reducing displacement of the mill laterally to its axial direction of travel. For this purpose, the mill 56 may also be provided with conventional full gauge flanks (not shown) or a full gauge stabilizer (not shown) each of which aid in preventing the mill from cutting laterally in the bores 54, 62. A similar application of a full bore stabilizer used proximate a mill is shown in FIG. 9 and described in the accompanying text.

Figure 5:
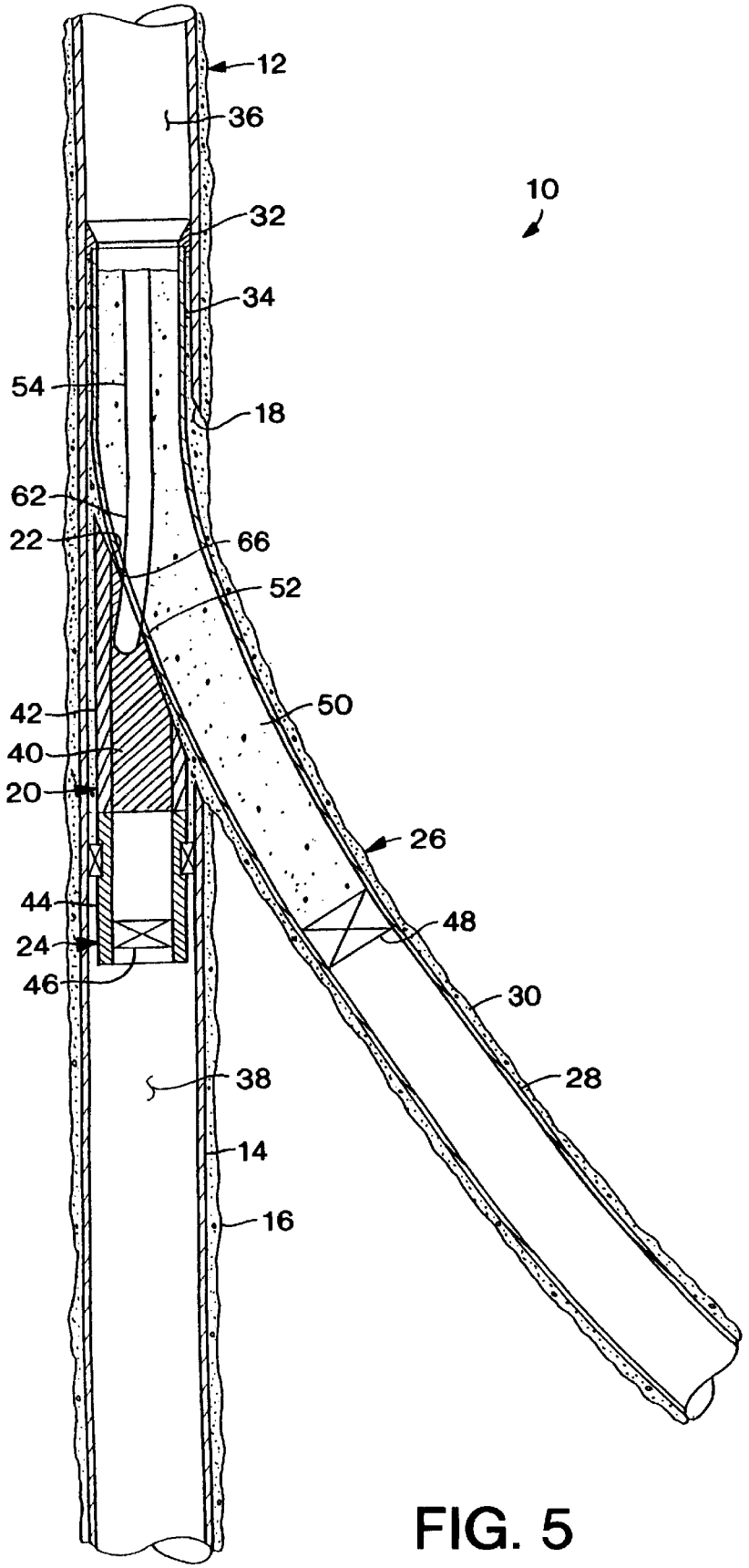
FIG. 5 is a cross-sectional view through the subterranean well of FIG. 1 illustrating the first method wherein the deviated bore has been milled through a liner and into the whipstock.

Referring additionally now to FIG. 5, it may be seen that the curved bore 62 now penetrates the liner portion 52. The mill 56 has cut through the liner portion 52 and into the inner core 40 of the whipstock 20. Thus, at this point fluid communication is established between the upper portion 36 of the parent wellbore 12 and the whipstock 20 via an opening 66 formed through the liner portion 52 by the mill 56. It will be readily appreciated that if the whipstock 20 does not include an inner core 40, fluid communication will also be established between the upper portion 36 and the packer 24, and that if the packer 24 does not include the plug member 46, fluid communication will also be established between the upper portion 36 and the lower portion 38 of the parent wellbore 12.

The curved bore 62 is next extended downwardly through the inner core 40 by utilizing the mill 56 (in this situation, preferably the mill 56 is a round nose mill) on a straight, instead of bent, housing, similar to that shown in FIG. 3 and described hereinabove. The mill 56 enters the opening 66 in the liner portion 52, is directed to the bottom of the curved bore 62, and mills completely downwardly through the inner core 40. The inner core 40 is relatively easily cut by the mill 56, but the outer case 42 of the whipstock 20 is harder for the mill to cut.

Preferably, the mill 56 is configured in this operation so that it is permitted to cut only slightly laterally as well as axially, so that if the mill contacts the case 42 it can deviate laterally and remain in the inner core 40, but it is otherwise constrained to cut substantially axially. For this reason, preferably the mill 56 includes full gauge flanks and/or is utilized with a full gauge stabilizer or fluted full gauge pads proximate thereto (not shown in FIG. 5, see full gauge pads 88 and full gauge stabilizer 90 shown in FIG. 9).

It is to be understood that the curved bore 62 may be otherwise extended through the inner core 40 without departing from the principles of the present invention, for example, the bent motor housing 64 may be utilized to direct the curved bore 62 toward an axially centralized position within the inner core 40 before drilling through the inner core, drill pipe may be used to drive another type of cutting device through the inner core 40, or the inner core 40 may be milled through after the cement 50 is removed from the liner 28 as described more fully hereinbelow.

Figure 6:
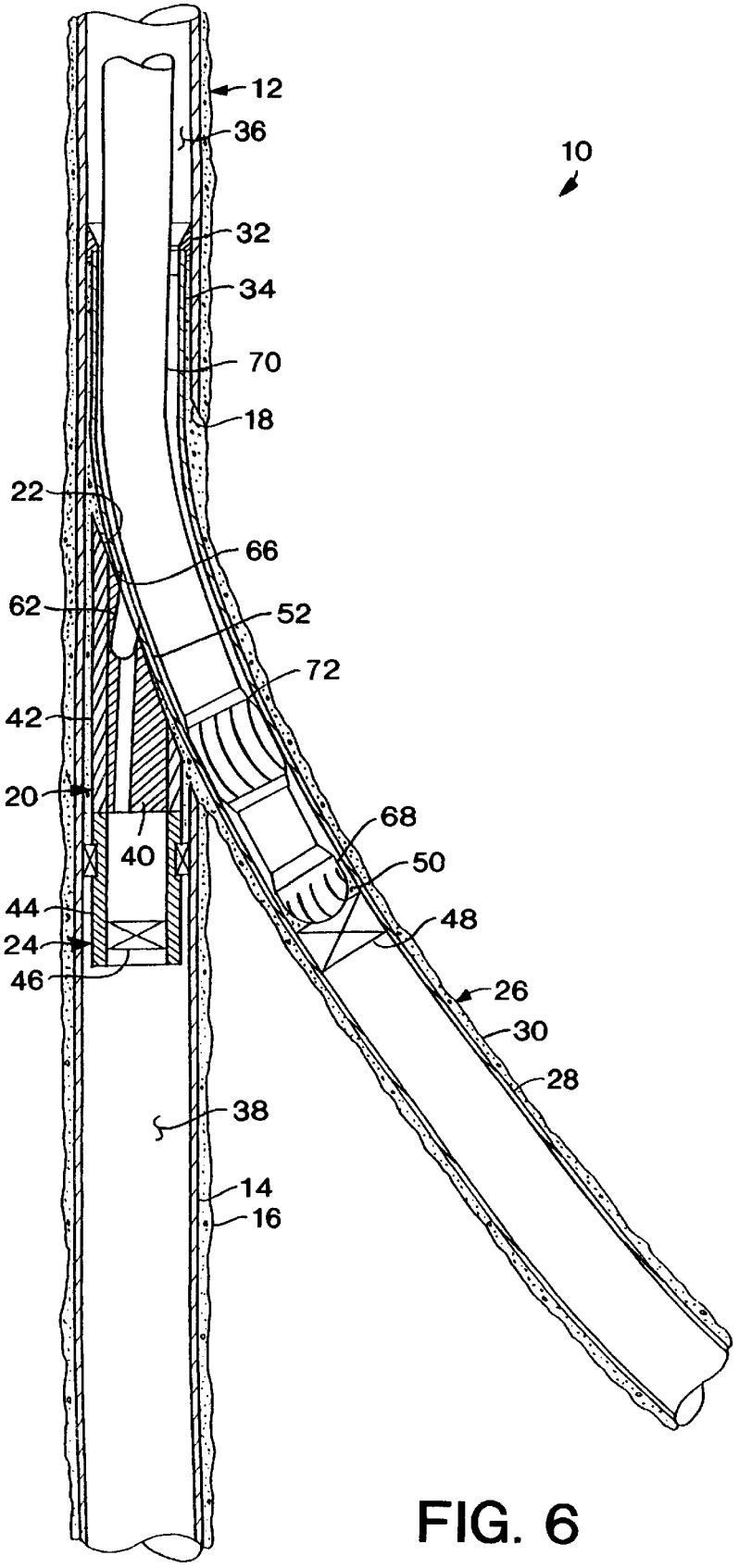
FIG. 6 is a cross-sectional view through the subterranean well of FIG. 1 illustrating the first method wherein the cement is being removed from the intersection.

Referring additionally now to FIG. 6, the cement 50 is removed from the liner 28 by utilizing a drill bit, cement mill, or other cement cutting device 68 suspended from drill pipe 70 which extends to the earth's surface. Alternatively, a cement cutting drill bit may be suspended from coiled tubing, or other means utilized to remove the cement 50, without departing from the principles of the present invention. Removal of the cement 50 permits enhanced access to the opening 66 previously formed through the liner portion 52.

The drill bit 68 is also utilized to remove the plug 48 so that the lateral wellbore 26 may be accessed. The drill bit is shown penetrating the plug 48 in FIG. 6, but it is to be understood that other equipment and techniques may be used to remove the plug 48 without departing from the principles of the present invention, for example, the plug 48 may instead be retrieved using conventional methods. A full gauge cleanout mill 72 follows the drill bit and cleans the liner 28 of cement. Other equipment, such as stabilizers, may be provided as well.

Figure 7:
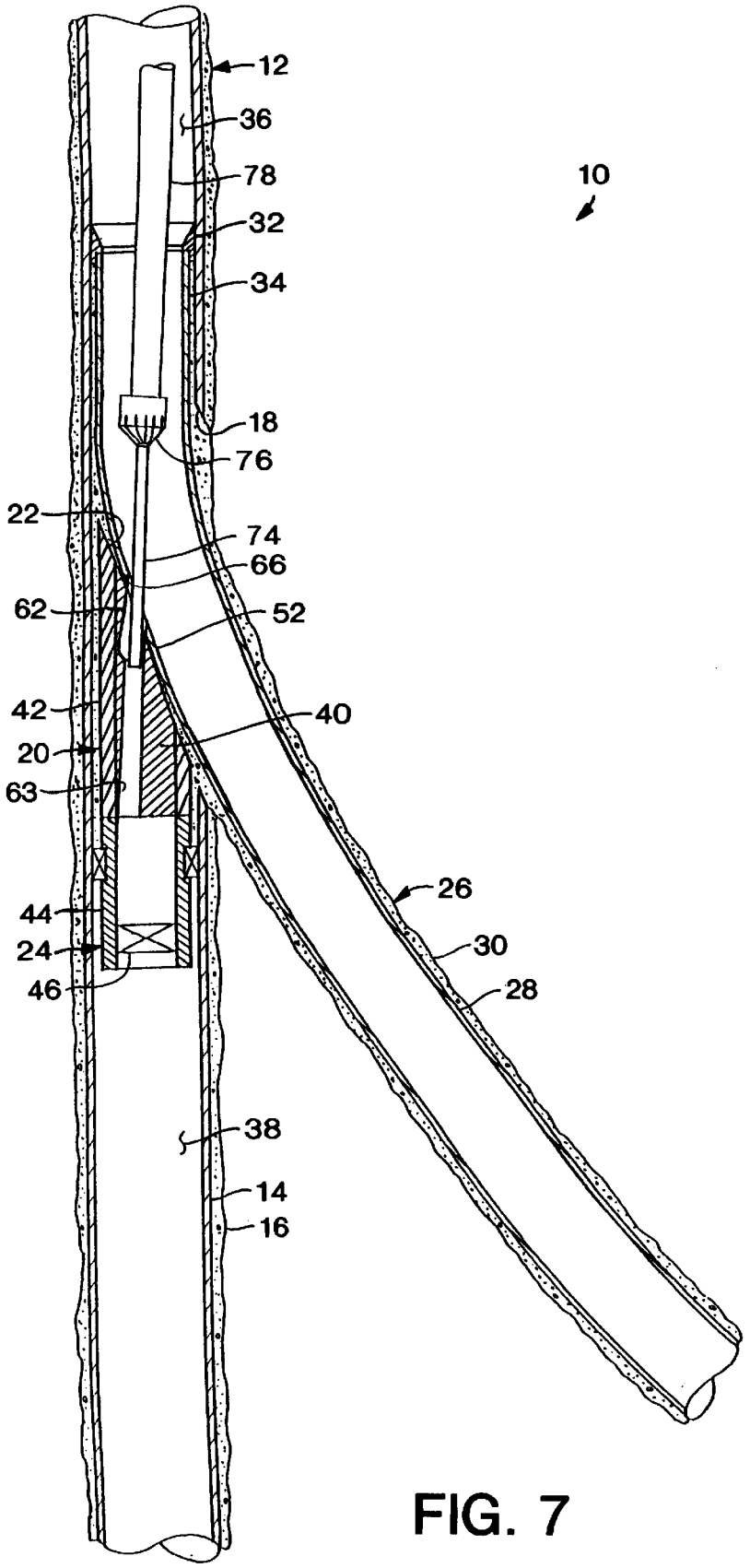
FIG. 7 is a cross-sectional view through the subterranean well of FIG. 1 illustrating the first method wherein an opening is formed completely through the whipstock.

Referring additionally now to FIG. 7, a guide nose 74 is shown entering the extended curved bore 62 and passing axially into the inner core 40 of the whipstock 20. The guide nose 74 passes downwardly through the opening 66 in the liner portion 52, following the curved bore 62 and its extended portion 63.

A mill 76 is attached to the guide nose 74, so that, as the guide nose passes axially through the bores 62, 63, the mill 76 is directed by the guide nose to progressively enter and enlarge the opening 66, curved bore 62, and extended bore 63. The mill 76 radially enlarges the opening 66 and bores 62, 63 as it passes therethrough, the mill being driven by drill pipe 78 or by a motor conveyed on coiled tubing, etc. Preferably, the mill 76 is configured to cut the liner portion 52 and the inner core 40 without cutting into the whipstock case 42. For this purpose, some lateral deflection of the mill 76 may be permitted as the mill passes axially through the liner portion 52 and the inner core 40.

The guide nose 74 may be telescopingly received within the mill 76, so that if the guide nose contacts the plug member 46, it may retract upwardly into the mill 76 and possibly into the drill pipe 78. Preferably, the guide nose 74 is releasably maintained in its extended position as shown in FIG. 7 by a securement device, such as a shear pin (not shown). The shear pin may then shear and permit retraction of the guide nose 74 if the guide nose strikes an object, such as the plug member 46. Other equipment, such as stabilizers, may also be used in this operation without departing from the principles of the present invention.

Referring additionally now to FIG. 8, the opening 66 is further enlarged and the inner core 40 of the whipstock 20 is substantially completely removed by milling therethrough with successively larger conventional mills, slot reamers, watermelon mills, etc. (not shown). Additionally, the plug member 46 is removed from the packer 24 by milling therethrough or other suitable methods, such as retrieving. The methods utilized to enlarge the opening 66 and remove the inner core 40 and plug member 46 may be similar to those described in FIGS. 22–24, or other methods may be used without departing from the principles of the present invention.

It may now be seen that fluid communication is established between the upper portion 36 and lower portion 38 of the parent wellbore 12. It is also now permitted to pass tools, pipe, other equipment, etc. through opening 66, through the whipstock 20, and through the packer 24, thereby providing access to the lower portion 38 for further operations therein.

Representatively illustrated in FIG. 9 is another method 80 of providing access to a lower portion 38*a* of a parent wellbore 12*a*. Elements shown in FIG. 9 which are similar to elements previously described are indicated with the same reference numerals, with an added suffix "a". Method 80 is somewhat similar to method 10 described hereinabove, the lateral wellbore 26*a* being formed via the window 18*a*, the liner 28*a* being cemented therein such that the upper portion 34*a* of the liner inwardly overlaps the casing 14*a*, and cement 50*a* being deposited across the liner portion 52*a* adjacent the whipstock 20*a*.

In the method 80, however, a bore 82 is formed axially through the cement 50*a* by a pilot mill 84 operatively coupled to a straight shaft 86. Preferably, the bore 82 thus formed extends straight through the cement 50*a*, through the liner portion 52*a*, and into the inner core 40*a* of the whipstock 20*a*. Fluted full gauge pads 88 are coupled to the pilot mill 84 to prevent lateral movement of the pilot mill. In addition, a full gauge stabilizer 90 is disposed in the upper liner portion 34*a* to assist in guiding the pilot mill 84 straight through the cement 50*a*, liner portion 52*a*, and inner core 40*a*. Although not shown in FIG. 9, preferably the stabilizer 90 enters the upper liner portion 34*a* before the pilot mill 84 enters the cement 50*a*, so that the pilot mill 84 is axially centralized. However, it is to be understood that it is not necessary for the bore 82 to be centralized within the upper liner portion 34*a*, or for the bore to be centralized within the inner core 40*a*. Other orientations of the bore 82 may be utilized without departing from the principles of the present invention.

The pilot mill 84, full gauge pads 88, shaft 86, and stabilizer 90 are suspended from coiled tubing 94. But it is to be understood that other conveying means, such as drill pipe may be used to transport the pilot mill 84, etc. in the parent wellbore 12*a* without departing from the principles of the present invention.

Figure 22:
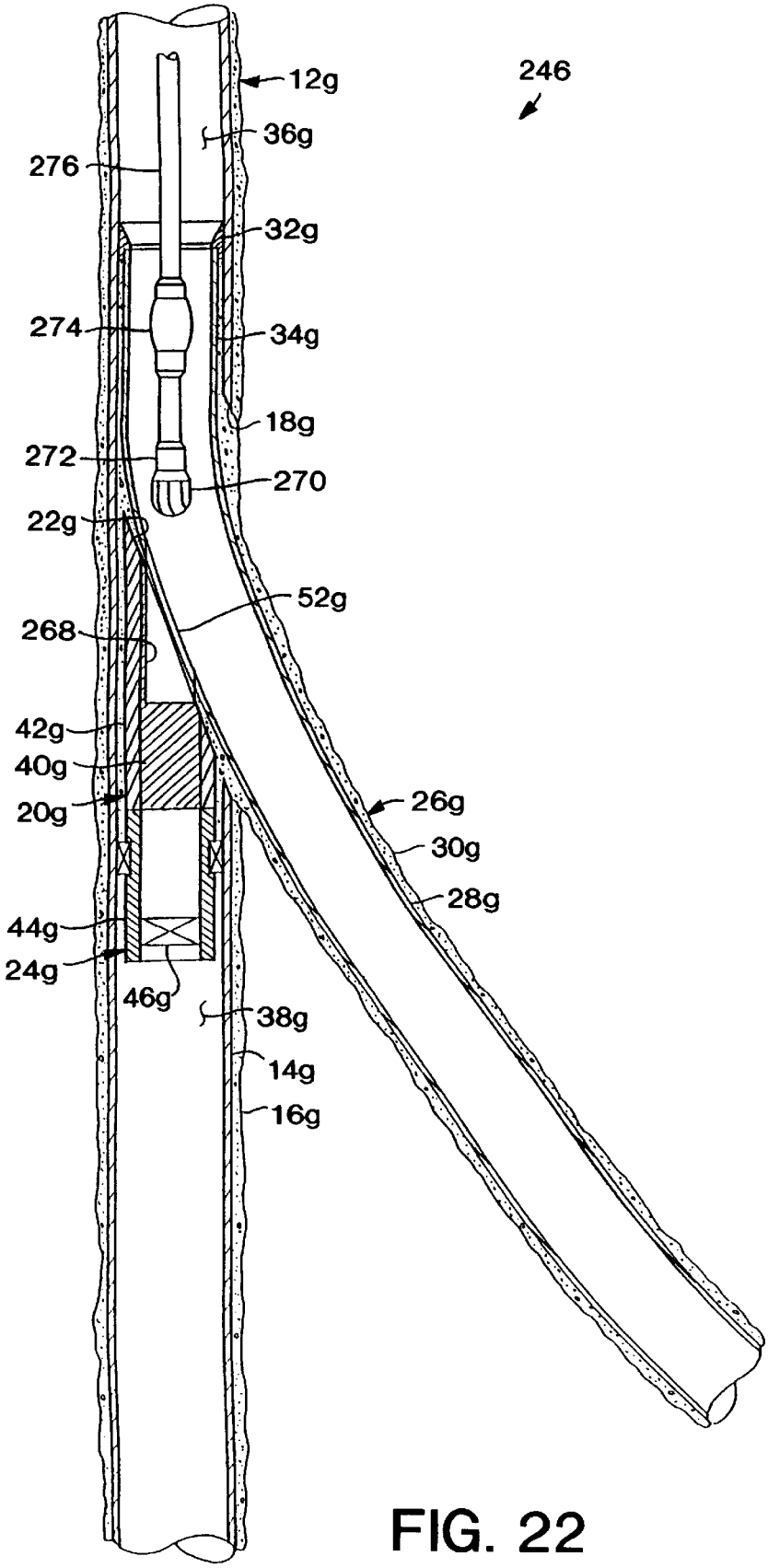
FIG. 22 is a cross-sectional view through the subterranean well of FIG. 21 showing the sixth apparatus and the seventh method wherein the opening is being extended through a whipstock.
Figure 23:
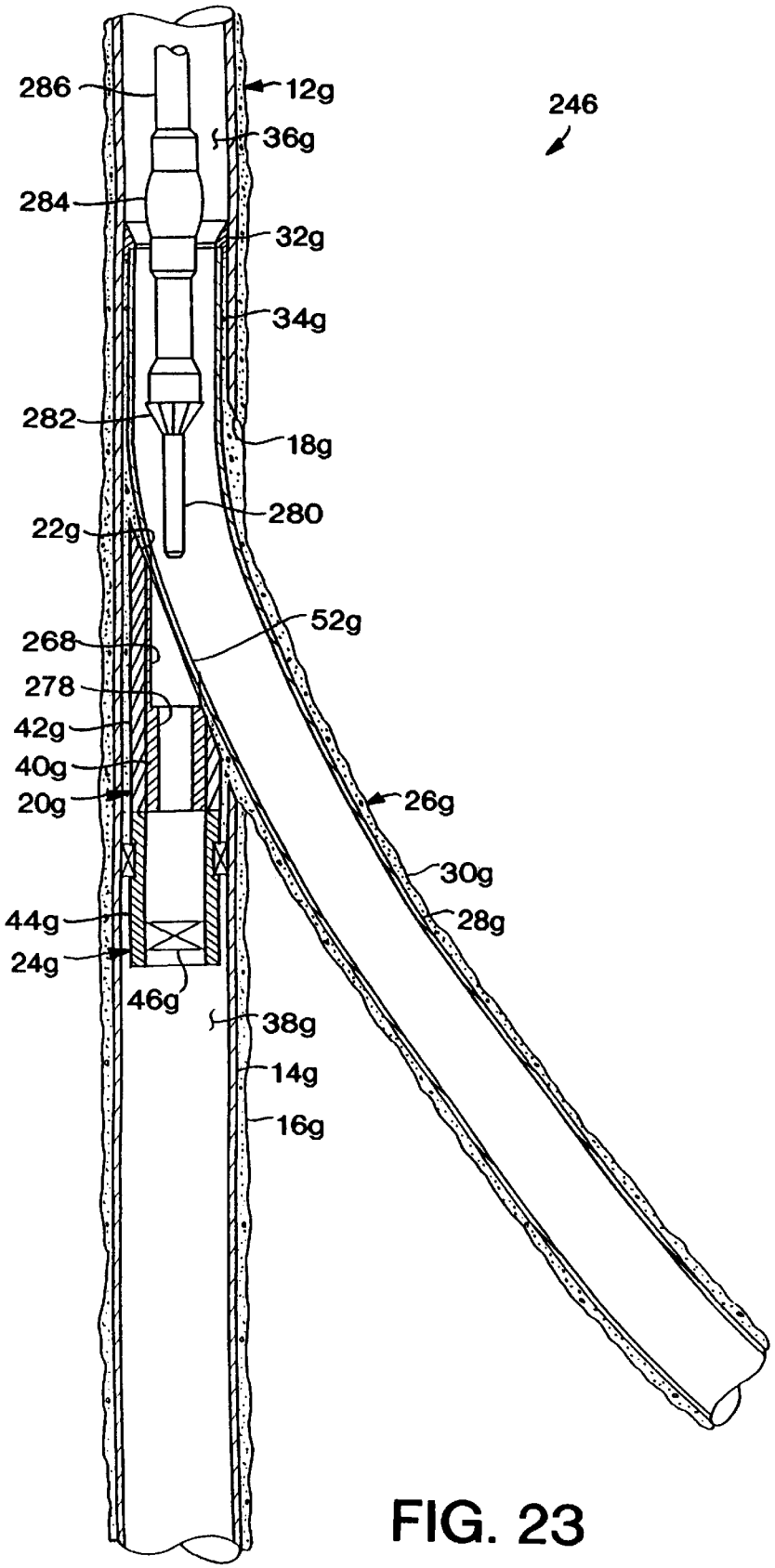
FIG. 23 is a cross-sectional view through the subterranean well of FIG. 21 showing the sixth apparatus and the seventh method wherein the opening is being radially enlarged.
Figure 24:
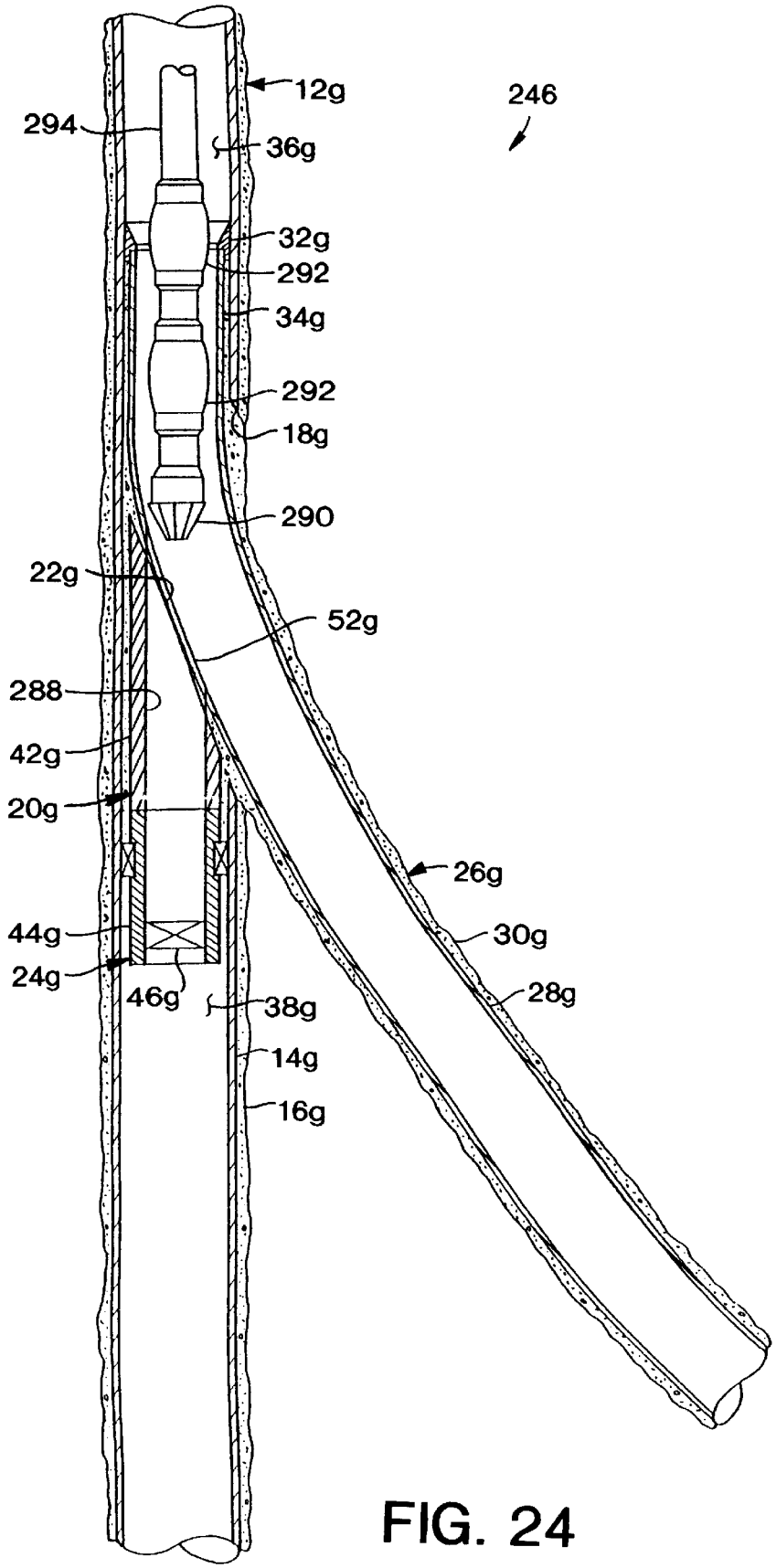
FIG. 24 is a cross-sectional view through the subterranean well of FIG. 21 showing the sixth apparatus and the seventh method wherein the opening is radially enlarged through the whipstock and access to the lower portion of the parent wellbore is being provided.

After the pilot mill 84 has pierced the liner portion 52*a*, the cement 50*a* and plug 48*a* may be removed as shown in FIG. 6 for the method 10, and described in the accompanying written description. When the pilot mill 84 cuts through the liner portion 52*a*, an opening 92 is formed axially through the liner portion. The opening 92 may thereafter be enlarged, and the inner core 40*a* and plug member 46*a* may be removed in a similar manner as shown in FIGS. 22–24 and described in the accompanying written description, or other methods may be utilized without departing from the principles of the present invention.

With the opening 92 enlarged, and the inner core 40*a* and plug member 46*a* removed, fluid communication is established between the upper portion 36*a* and lower portion 38*a* of the parent wellbore 12*a*. It is also now permitted to pass tools, pipe, other equipment, etc. through opening 92, through the whipstock 20*a*, and through the packer 24*a*, thereby providing access to the lower portion 38*a* for further operations therein.

Figure 9A:
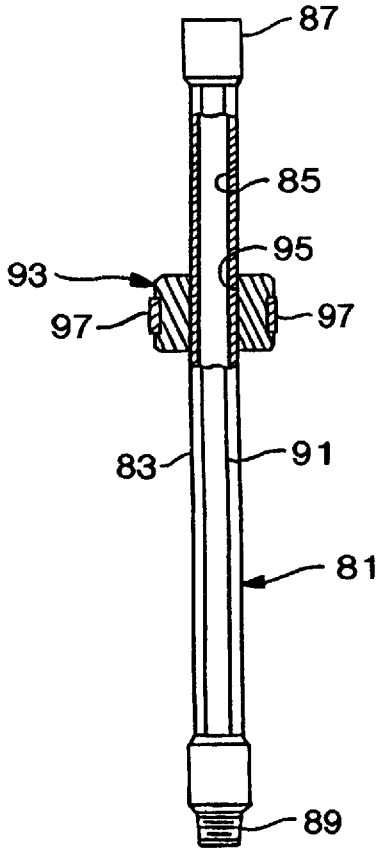
FIG. 9A is a cross-sectional view of a rotational anchoring device embodying the principles of the present invention.

Referring additionally now to FIG. 9A, a rotational anchoring device 81 is representatively illustrated, the rotational anchoring device embodying principles of the present invention. The rotational anchoring device 81 is usable in the above-described methods 10 and 80, and in other operations within a subterranean well wherein it is desirable to restrict rotational displacement while permitting axial displacement.

The device 81 includes an elongated generally tubular body portion 83 with an axial bore 85 extending therethrough. The bore 85 permits circulation fluids, such as mud, and passage of equipment axially through the device 81. At opposite ends of the body portion 83, internally and externally threaded end connections 87 and 89, respectively, permit interconnection of the device 81 within a string of drill pipe, a tubing string, a bottom hole assembly, etc. It is to be understood that the device 81 may be otherwise interconnected, and that the device may be otherwise utilized, in a subterranean well without departing from the principles of the present invention.

As representatively illustrated in FIG. 9A, the body portion 83 has a hexagonally shaped outer side surface 91. A rotationally restrictive portion 93 of the device 81 is axially slidingly disposed on the body portion 83. The rotationally restrictive portion 93 has an inner side surface 95 which is complementarily shaped relative to the outer side surface 91, such that the rotationally restrictive portion 93 is not permitted to rotate relative to the body portion 83.

It is to be understood that the body portion 83 and rotationally restrictive portion 93 may be otherwise configured to prevent relative rotation therebetween while permitting relative axial displacement therebetween without departing from the principles of the present invention. For example, a radially inwardly extending key may be provided on the inner side surface 95, the key mating with an appropriately shaped axially extending keyway formed on the outer side surface 91, the inner and outer side surfaces 95, 91 may have complimentarily shaped axially extending splines formed thereon, etc.

The rotationally restrictive portion 93 includes a series of circumferentially spaced apart and radially outwardly extendable members 97, only two of which are visible in FIG. 9A. In operation, the members 97 grippingly engage an inner side surface of a tubular structure in which the device 81 is axially received, such as the casing 14 or 14*a*, or the liner 28 or 28*a*. Such gripping engagement of the members 97 restricts rotation of the rotationally restrictive portion 93 relative to the tubular structure in which the device is received, and, thus, restricts rotation of the device 81 relative to the tubular structure.

It is contemplated that the members 97 may be conventional slips, in which case the members are operative to bite into the tubular structure in which the device 81 is received when the slips are set. Furthermore, if the members 97 are slips, the rotationally restrictive portion 93 may be similar to a conventional anchor and the slips may be set hydraulically, by manipulation from the earth's surface,, etc., according to conventional practice for setting anchors, plugs, and packers.

It is also contemplated that the members 97 may be conventional drag blocks, such as those well known to persons skilled in the art and utilized in conjunction with conventional packers. In that case, the members 97 may be radially outwardly biased by springs, or other biasing members, to contact the tubular structure in which the device 81 is received.

It is further contemplated that the members 97 may grippingly engage the tubular structure in which the device 81 is received in only one rotational direction. In other words, the rotationally restrictive portion 93 may serve as a one-way rotational clutch, only being rotationally restrictive in one direction relative to the tubular structure in which the device is received. Such one-way rotational restriction may be accomplished by, for example, configuring the members 97 so that they radially outwardly extend only when the device 81 is rotated in a preselected direction relative to the tubular structure in which the device received, providing directionally configured teeth on outer side surfaces of the members 97, the teeth only biting into the tubular structure when the device 81 is rotated in a preselected direction relative to the tubular structure, etc. Alternatively, a camming action between outward extending members 97 and body member 93 can provide reactive force against the tubular structure to restrict rotation in one rotational direction.

The device 81 may be utilized in the method 10 by, for example, installing the device axially between the coiled tubing 60 or drill pipe and the bent motor housing 64 shown in FIG. 4. In that case, the rotationally restrictive portion 93 may be disposed within the liner 28 or casing 14 above the cement 50. The members 97 may, thus, grippingly engage the liner 28 or casing 14 to restrict rotation of the bent motor housing 64 relative to the liner or casing. Such rotational restriction is desirable, particularly when the bit 56 bites into the liner portion 52, which typically produces a substantial reactive torque in the coiled tubing 60 or drill pipe.

Where substantial reactive torques are produced in coiled tubing, such as coiled tubing 60, the coiled tubing is not as able to resist the torque as is drill pipe. Thus, applicants prefer that the device 81 be utilized where coiled tubing is used to convey the bent motor housing 64 and bit 56 in the subterranean well in method 10. However, it is to be understood that the device 81 may be utilized advantageously in other steps of the method 10, and in methods other than method 10, without departing from the principles of the present invention.

For example, the device 81 may be utilized in the method 80 by installing the device axially between the coiled tubing 94 and the stabilizer 90 or in lieu of the stabilizer 90 (see FIG. 9). When the pilot drill 84 cuts into the liner portion 52*a*, reactive torque produced thereby may be absorbed by the gripping engagement of the members 97 with the liner 28*a* or casing 14*a*. Thus, it will be readily appreciated by one of ordinary skill in the art that the device 81 permits axial displacement of the coiled tubing 94 relative to the casing 14*a* and liner 28*a*, while restricting rotation of the coiled tubing relative to the casing and liner. Similarly, when the device 81 is utilized in the method 10 as hereinabove described, the device 81 permits relative axial displacement between the coiled tubing 60 and the casing 14 and liner 28, while restricting rotation of the coiled tubing relative to the casing and liner.

Figure 10:
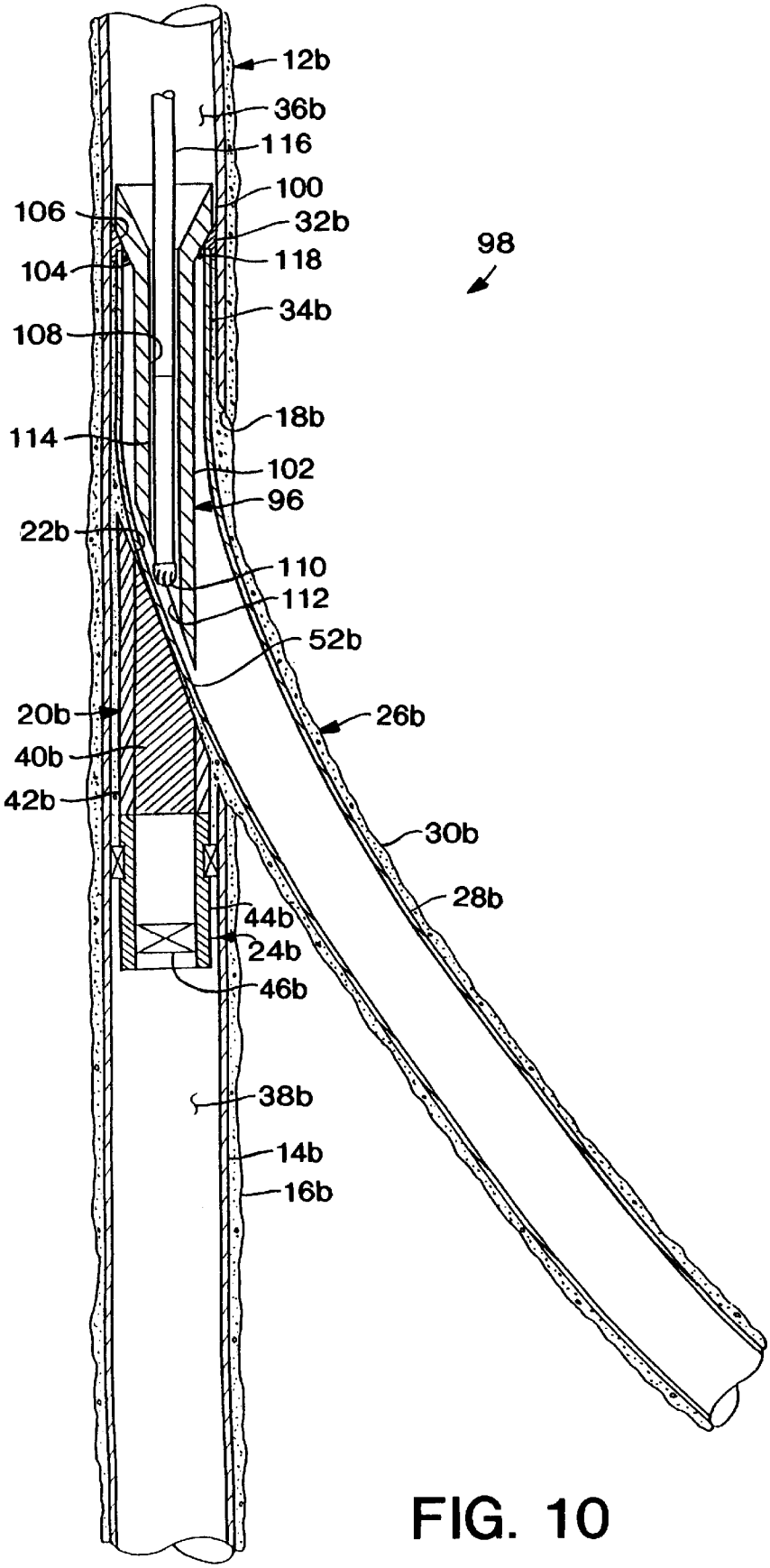
FIG. 10 is a cross-sectional view through a subterranean well illustrating a first apparatus and a third method of providing access to a lower portion of a parent wellbore, the apparatus and method embodying principles of the present invention.

Turning now to FIG. 10, a milling guide 96 and an associated method 98 of providing access to the lower portion 38*b* of the parent wellbore 12*b* are representatively illustrated. Elements shown in FIG. 10 which are similar to elements previously described are indicated with the same reference numerals, with an added suffix "b".

The milling guide 96 is generally tubular and elongated, and is axially disposed substantially within the upper portion 34*b* of the liner 28*b*. The milling guide 96 includes a radially enlarged upper portion 100 and a radially reduced lower portion 102. The milling guide lower portion 102 is received in the liner upper portion 34*b* and the milling guide upper portion 100 engages the liner hanger 32*b* to thereby position the milling guide 96 within the liner 28*b*.

As shown in FIG. 10, the milling guide upper portion 100 may have a radially inwardly sloping lower surface 104 formed thereon which engages a complementarily shaped radially outwardly sloping upper surface 106 formed on the liner hanger 32*b*. Such cooperative engagement between the surfaces 104, 106 operates to fix the axial position of the milling guide 96 relative to the liner 28*b* for purposes which will become apparent upon consideration of the further description hereinbelow. However, it is to be understood that other axial positioning methods may be employed without departing from the principles of the present invention, for example, the liner hanger 32*b* may be internally threaded and the milling guide upper portion 100 may be complementarily externally threaded for cooperative threaded engagement therebetween, or the liner hanger 32*b* may have an internal latching profile formed thereon and the milling guide upper portion 100 may be provided with complementarily shaped latch members or lugs for cooperative engagement therewith.

An internal bore 108 extends axially through the milling guide 96 and serves to direct a mill 110 therethrough. For this purpose, the milling guide 96 is preferably made of a tough and wear resistant material, such as hardened steel, in the area surrounding the internal bore 108. The mill 110 preferably has full gauge pads (not shown in FIG. 10) formed thereon or separately attached thereto, or may have a full gauge stabilizer (not shown in FIG. 10) attached thereto, in order to resist lateral displacement of the mill 110 within the internal bore 108 and within the components in which the mill will drill. In this respect, the mill 110 is similar to the pilot mill 84, including full gauge pads 88 and stabilizer 90, shown in FIG. 9.

The milling guide 96 also includes a lower downwardly facing sloping surface 112 formed thereon. In this manner, the mill 110 may continue to contact, and thereby continue to be directed by, the internal bore 108 as the mill 110 begins to penetrate the liner portion 52*b* overlying the whipstock 20*b*. The sloping surface 112 is complementarily shaped with respect to the liner portion 52*b*, so that when the upper portion 100 of the milling guide 96 engages the liner hanger 32*b*, the sloping surface 112 is closely spaced apart from the liner portion 52*b*.

It is to be understood that it is not necessary for the sloping surface 112 to be continuous across the milling guide lower portion 102, nor is it necessary for the sloping surface to be inclined axially, in a milling guide constructed in accordance with the principles of the present invention. However, it is preferred that the milling guide 96 provide lateral support to the mill 110 at least until the mill penetrates the liner portion 52*b*.

The mill 110 may be driven by a downhole motor 114, such as a mud motor, and the mill and motor may be conveyed into the milling guide 96 suspended from coiled tubing 116 extending to the earth's surface. It is to be understood that other conveying and driving methods may be employed without departing from the principles of the present invention, for example, the mill 110 may be suspended from drill pipe and rotated thereby.

If mud is circulated through the coiled tubing 116 (or optional drill pipe, etc.) while the mill 110 is milling, cuttings produced thereby may be circulated back to the earth's surface with the mud. Such return circulation of the mud may be provided for by forming an additional opening through the milling guide 96, providing axially extending slots on the internal bore 108, providing radially extending slots on one or both of the surfaces 104, 106, or otherwise providing a sufficient flow path for the return circulation.

In a preferred embodiment of the method 98, the return circulation flows in the annulus between the internal bore 108 and the coiled tubing 116 or drill pipe and the downhole motor 114. Where drill pipe is utilized instead of coiled tubing 116, the drill pipe may have spiral grooves cut onto its outer surface to accommodate the return circulation flow. Where the downhole motor 114 is utilized, it may be centralized with, for example, fins or a fluted stabilizing ring disposed thereon, to permit return circulation flow in the annulus between it and the internal bore 108. Accordingly, the coiled tubing 116 or drill pipe and the downhole motor 114 are sufficiently radially reduced relative to the internal bore 108 to permit adequate return circulation flow in the annulus therebetween.

Preferably, such return circulation is not provided in the annulus between the milling guide 96 and the liner upper portion 34*b* since the cuttings may tend to accumulate there, possibly making the milling guide 96 difficult to remove from the liner upper portion 34*b*. To prevent return circulation between the milling guide 96 and the liner upper portion 34*b*, a seal 118 may be provided therebetween. Alternatively, the seal 118 may sealingly engage the surfaces 104, 106 to thereby prevent return circulation flow therebetween.

In the method 98, the milling guide 96 is lowered into the liner upper portion 34*b* until the milling guide upper portion 100 operatively engages the liner hanger 32*b*, the desired length of the milling guide lower portion 102 and the desired shape of the sloping surface 112 having been predetermined by, for example, utilizing conventional logging tools (not shown) to measure the distance between the liner hanger 32*b* and the liner portion 52*b*, and to measure the relative inclination between the liner upper portion 34*b* and the liner portion 52*b*. Rotational orientation of the sloping surface 112 relative to the liner portion 52*b* may be provided by conventional logging tools, such as survey tools, gyroscopes, accelerometers, or inclinometers. The milling guide 96 may be conveyed into the parent wellbore 12*b* on pipe, wireline, slickline, coiled tubing, or other conveyance.

When the milling guide 96 is properly disposed axially within the liner upper portion 34*b* and is properly axially and rotationally aligned relative to the liner portion 52*b*, the mill 110 is conveyed into the parent wellbore 12*b*. Pipe, coiled tubing, or other conveyances may be utilized to transport the mill 110 within the parent wellbore 12*b*. The mill 110 is then received axially within the internal bore 108 of the milling guide 96.

The mill 110 is lowered within the internal bore 108 and the motor 114 is operated to drive the mill, or, optionally, pipe is utilized to drive the mill. The mill 110 is further lowered until it contacts and begins penetrating the liner portion 52*b*. Preferably, the mill 110 penetrates the liner portion 52*b* in an area overlying the whipstock inner core 40*b* and eventually penetrates the inner core.

When the mill 110 has penetrated into the inner core 40*b*, the mill may be further lowered until it mills completely through the inner core 40*b* similar to pilot mill 74 shown in FIG. 7, or it may be raised and withdrawn from the whipstock 20 after only partially penetrating the inner core 40*b* similar to pilot mill 84 shown in FIG. 9. In either case, an opening (similar to opening 66 and 92, but not shown in FIG. 10) formed through the liner portion 52*b* and into the whipstock 20*b* may later be radially enlarged and extended axially through the whipstock 20*b* and packer 24*b* as more fully described hereinabove for the methods 10 and 80. Such radial enlargement is preferably performed after the milling guide 96 is removed from the liner upper portion 34*b*.

After the mill 110 has penetrated the inner core 40*b*, it may be raised and withdrawn from the parent wellbore 12*b*. The milling guide 96 may then also be raised and withdrawn from the parent wellbore 12*b*. Alternatively, the mill 110 and/or coiled tubing 116 or other conveyance may engage the milling guide 96 so that the milling guide is retrieved from the parent wellbore 12*b* at the same time as the mill. Such engagement may be conveniently accomplished by various methods, such as by providing an internal latching profile on the milling guide 96, providing an internal downwardly facing shoulder on the milling guide, providing an external gripping member, such as a slip or collet mechanism, on the coiled tubing 116, etc.

The milling guide 96 may also have a conventional anchor (not shown) secured thereto for preventing axial and rotational displacement of the milling guide relative to the liner upper portion 34*b* while the mill 110 is being driven. In that case, the method 98 will include setting the anchor prior to driving the mill 110 and releasing the anchor prior to retrieving the milling guide 96. A suitable anchor for such purposes may be similar to those shown in FIGS. 19 and 20. The anchor may be carried proximate the upper portion 100 or the lower portion 102 and may internally grippingly engage the casing 14*b*, the liner hanger 32*b*, and/or the liner 28*b*. Other methods of positioning the milling guide 96 relative to the liner upper portion 34*b* may be utilized without departing from the principles of the present invention. It is also contemplated that the anchor provides limited radial support, which is primarily a function of the relative stiffness, shape and thickness of the guide, and that additional radial support can be provided by the appropriate placement of radially extending, fixed or deployable, lugs or support members along the milling guide.

Figure 11:
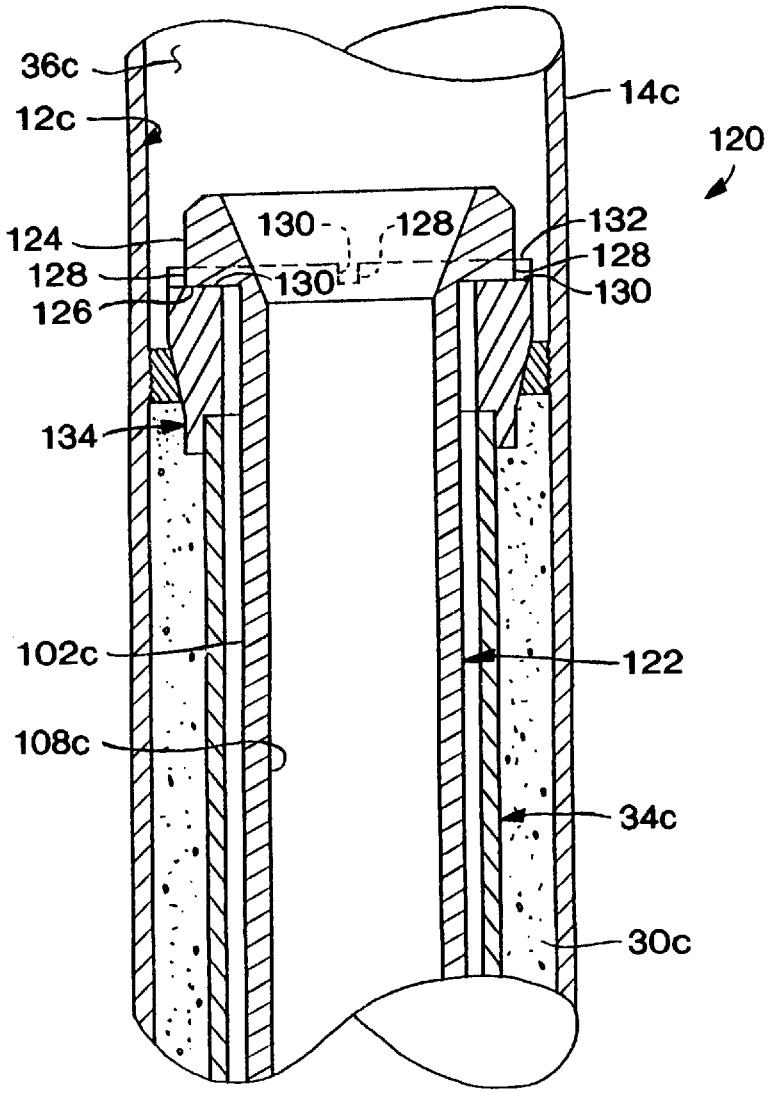
FIG. 11 is an enlarged cross-sectional view through the first apparatus, showing an alternate configuration of the apparatus.

Referring additionally now to FIG. 11, a method 120 of rotationally aligning a milling guide 122 relative to a liner upper portion 34*c* is representatively illustrated. Elements shown in FIG. 11 which are similar to elements previously described are indicated with the same reference numerals, with an added suffix Milling guide 122 is substantially similar to the milling guide 96 previously described and shown in FIG. 10. However, the milling guide 122 includes a radially enlarged upper portion 124 which has a downwardly facing and radially extending side 126 formed thereon. The downwardly facing side 126 has one or more keys 128 formed thereon which are positioned to cooperatively engage corresponding complementarily shaped keyways 130.

The keyways 130 are formed on an upwardly facing and radially extending side 132 on a liner hanger 134. The liner hanger 134 may be otherwise similar to the liner hanger 32*b* previously described.

Preferably, cooperative engagement of the keys 128 with the keyways 130 operates to determine the rotational orientation of the milling guide 122 relative to the liner hanger 134. For this purpose, the keys 128 and keyways 130 are preferably unevenly spaced circumferentially about the surfaces 126 and 132, respectively. Note that, in FIG. 11, three keys 128 are shown spaced apart at 90 degrees, 90 degrees, and 180 degrees relative to one another, so that the keys may engage the similarly spaced apart keyways 130 only when the milling guide 122 is rotationally aligned with respect to the liner hanger 134 as shown. A single key 128 and keyway 130 may also be utilized for this purpose. Indeed, any convenient number of keys 128 and keyways 130 may be utilized without departing from the principles of the present invention.

It is to be understood that the milling guide 122 may be otherwise rotationally aligned with respect to the liner hanger 134 without departing from the principles of the present invention. For example, the milling guide 122 may be provided with external axially extending splines formed on its lower portion 102*c* which may cooperatively engage corresponding complementarily shaped internal splines formed on the liner hanger 134. Alternatively, other cooperatively engaged shapes, such as a mule shoe arrangement, can operate to determine the rotational and axial alignment of the milling guide 122 relative to the liner hanger 134.

Figure 12:
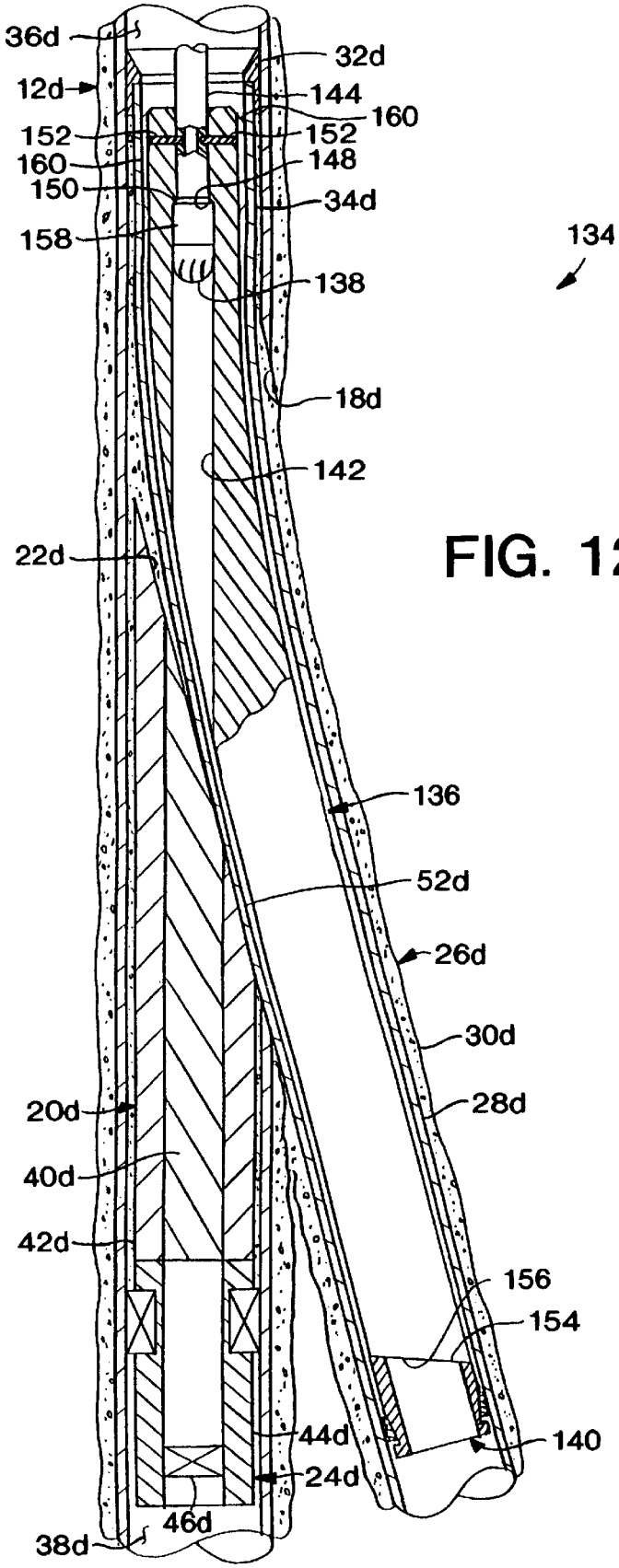
FIG. 12 is a cross-sectional view through a subterranean well illustrating a second apparatus and a fourth method of providing access to a lower portion of a parent wellbore, the apparatus and method embodying principles of the present invention.
Figure 13:
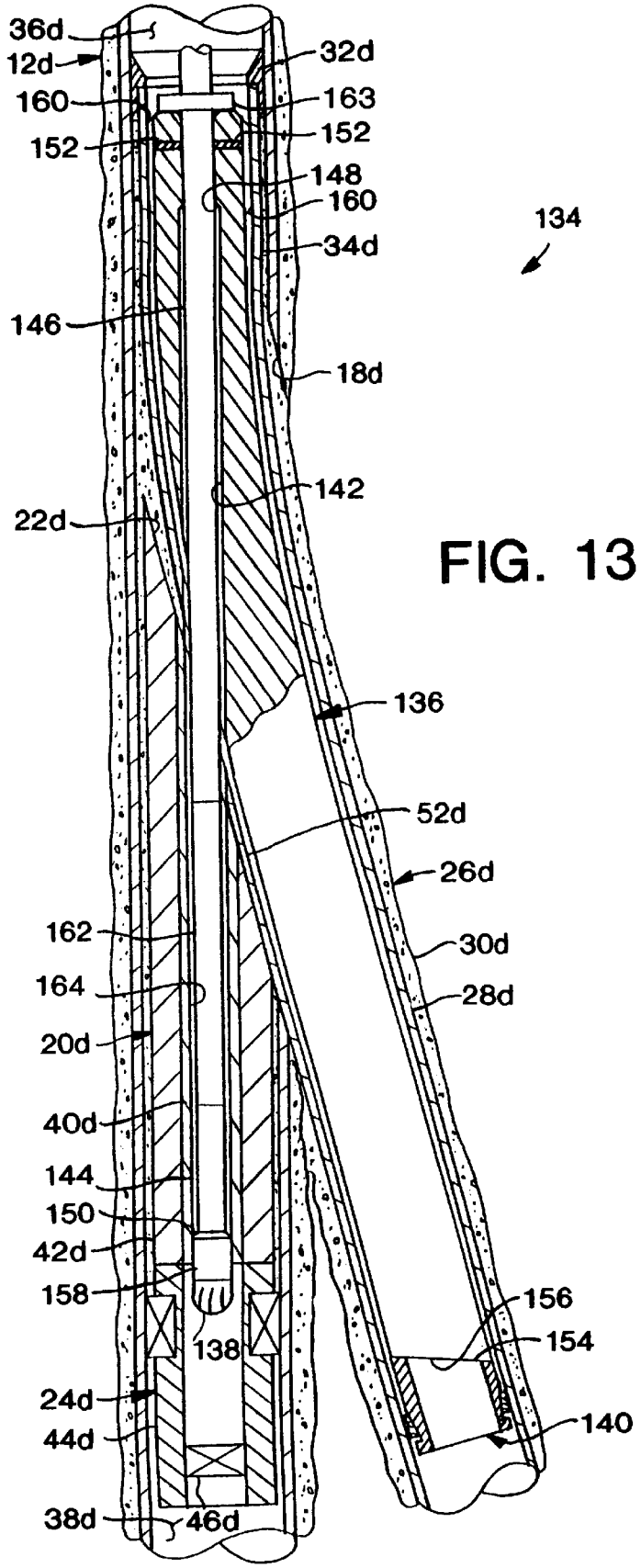
FIG. 13 is a cross-sectional view through the subterranean well of FIG. 12 showing the second apparatus and the fourth method wherein an opening is formed through an intersection of a lateral wellbore liner and a parent wellbore casing.

Referring now to FIGS. 12 and 13, a method 134 of providing access to the lower portion 38*d* of the parent wellbore 12*d* is representatively illustrated. Elements shown in FIGS. 12 and 13 which are similar to elements previously described are indicated with the same reference numerals, with an added suffix "d".

The method 134 utilizes a uniquely configured milling guide 136, a pilot mill 138 received therein, and an anchor 140. The anchor 140 is set in the liner 28*d* downward from the liner portion 52*d* and is utilized to axially and rotationally position the milling guide 136 relative to the liner portion 52*d* in a manner which will be more fully described hereinbelow. The milling guide 136 includes a generally axially extending profile 142 formed thereon which serves to guide the pilot mill 138 toward the liner portion 52*d*.

Preferably, the profile 142 has a generally circular lateral cross-section, but other shapes may be utilized for the profile 142 without departing from the principles of the present invention, for example, the profile may have a hexagonal or spirally fluted cross-section to more readily permit fluid circulation in the annulus between the pilot mill 138 and the profile 142. As shown in FIGS. 12 and 13, the profile 142 appears to be linear and the milling guide 136 appears to be curved, these appearances being due to convenience of illustration thereof within limited drawing dimensions. However, it is to be understood that the milling guide 136 may be linear and the profile 142 may be curved without departing from the principles of the present invention.

An upper shaft 144 extends axially upward through the milling guide 136 as shown in FIG. 12 and is suspended from coiled tubing 146 or drill pipe. FIG. 12 shows the milling guide 136, pilot mill 138, shaft 144, and anchor 140 as they are positioned just after the milling guide 136 has been disposed within the liner 28*d* and oriented to permit milling through the liner portion 52*d*. The milling guide 136 is so conveyed downwardly into the liner 28*d* suspended from the coiled tubing 146 or drill pipe due to a radially inwardly extending and downwardly facing shoulder 148 internally formed on the milling guide 136 which axially contacts a complementarily shaped radially outwardly extending and upwardly facing shoulder 150 externally formed on the pilot mill 138. Cooperative engagement between the shoulders 148, 150 permits the milling guide 136 to be transported within the parent wellbore 12*d* and lateral wellbore 26*d* along with the pilot mill 138.

The shaft 144 is releasably secured to the milling guide 136 by shear pins 152 extending radially inward through the milling guide 136 and into the shaft 144. The shear pins 152 provide connection for axial and rotational orientation of milling guide 152 and anchor 140, if anchor 140 was not previously located and axially and rotationally oriented. Then, the shear pins 152 permit the shaft 144 and pilot mill 138 to be axially reciprocated within the milling guide 136 after a sufficient force has been applied to the shaft 144, which force is resisted by the milling guide 136. Such force may be applied by lowering the milling guide 136 until it axially contacts the anchor 140 as shown in FIG. 12 and slacking off or otherwise applying force to the coiled tubing 146 or drill pipe attached to the shaft 144.

It is to be understood that it is not necessary for the shaft 144 to be releasably attached to the milling guide 136, and that other devices may be utilized for releasably attaching the shaft to the milling guide without departing from the principles of the present invention. Note that, if the shear pins 152 or other releasable attaching device is appropriately configured, the shoulders 148 and 150 are not necessary for transporting the milling guide 136 into the liner 28*d* with the pilot mill 138. In that alternate configuration, the pilot mill 138 may be able to pass axially upward through the milling guide 136 after the shear pins 152 are sheared, thereby permitting the pilot mill 138 to be retrieved to the earth's surface without also retrieving the milling guide 136.

The anchor 140 may be set in the liner 28*d* below the liner portion 52*d* by conventional methods, such as setting by wireline or on tubing, or the anchor may be run into the parent wellbore 12*d* and lateral wellbore 26*d* along with the milling guide 136. If the anchor 140 is run in with the milling guide 136, it is attached to the milling guide and may be set in the liner 28*d* at the same time as the milling guide 136 is axially positioned and rotationally aligned relative to the liner portion 52*d*. Furthermore, if the anchor 140 is run in with the milling guide 136, the anchor may be set by manipulation of the milling guide/anchor assembly from the earth's surface, or the anchor may be hydraulically set by application of fluid pressure through the coiled tubing 146 or drill pipe, which fluid pressure may be transferred through the milling guide to the anchor by, for example, providing an axially extending fluid conduit through the milling guide 136. It is to be understood that other methods and devices for setting the anchor 140 may be utilized without departing from the principles of the present invention.

In the method 134 as representatively illustrated in FIG. 12, the anchor 140 is set in the liner 28*d* prior to the milling guide 136 being transported into the liner. For rotational orientation of the milling guide 136 relative to the liner portion 52*d*, the anchor 140 includes a laterally sloping upper surface 154 formed thereon. When the milling guide 136 is lowered into axial contact with the anchor 140, a complementarily shaped laterally sloping lower surface 156 formed on the milling guide cooperatively engages the sloping upper surface 154 to thereby fix the rotational orientation of the milling guide within the liner 28*d*. Accordingly, the anchor 140 is rotationally aligned with respect to the liner 28*d* when it is set therein by, for example, use of a conventional gyroscope, or the rotational orientation of the anchor 140 may be determined after it is set. If the rotational orientation of the anchor 140 is to be determined after it is set in the liner 28*d*, the sloping surface 156 on the milling guide 136 may be rotationally adjustable relative to the profile 142, so that the profile is properly rotationally aligned with the liner portion 52*d* when the sloping surfaces 154, 156 are cooperatively engaged.

It is to be understood that other devices and methods may be utilized to rotationally align the milling guide 136 with respect to the anchor 140 without departing from the principles of the present invention. For example, the anchor 140 may be provided with splines or a keyway formed internally thereon and the milling guide 136 may correspondingly be provided with splines or a key formed externally thereon. It will be readily apparent to one of ordinary skill in the art that various cooperatively engaging configurations of the milling guide 136 and anchor 140 may be provided for rotational orientation therebetween.

The anchor 140 may also be a bridge plug or a packer and may be millable and/or retrievable. Accordingly, fluid communication may or may not be provided axially through the anchor 140 or in the annulus between the anchor and the liner 28*d*. Preferably, fluid communication is provided axially through the anchor 140, so that cuttings and other debris does not accumulate above the anchor and about the milling guide 136.

The pilot mill 138 preferably has full gauge flanks 158 or full gauge fluted pads (not shown) attached thereto to prevent lateral displacement of the pilot mill within the profile 142 and within the inner core 40*d* upon penetration of the liner portion 52*d*. The pilot mill 138 is guided axially downward and laterally toward the liner portion 52*d* as the shaft 144 is displaced axially downward. For this reason, cooperative axially slidable engagement between the pilot mill 138 and the profile 142 permits the pilot mill to be accurately axially, radially, and rotationally directed toward the whipstock inner core 40*d*. When the pilot mill 138 contacts the liner portion 52*d*, the engagement between the pilot mill 138 and the profile 142 substantially controls the lateral or radial position of the pilot mill relative to the liner portion 52*d*.

The milling guide 136 has a series of circumferentially spaced apart and radially outwardly extending flutes 160 formed thereon which serve to substantially centralize the milling guide radially within the liner 28*d*. In this manner, the milling guide 136 may be accurately positioned and stabilized within the liner 28*d*. Note that the milling guide 136 can be rotationally secured within the liner 28*d* above, below, or above and below the profile 142, thereby enhancing accuracy in rotationally and axially positioning the milling guide 136 within the liner 28*d*, and stabilizing the milling guide while the pilot mill 138 is milling into the liner portion 52*d* and inner core 40*d*. It is to be understood, however, that the milling guide 136 may be otherwise secured within the liner 28*d* without departing from the principles of the present invention.

Referring specifically now to FIG. 13, the method 134 is representatively illustrated in a configuration in which the pilot mill 138 has milled completely through the inner core 40*d* of the whipstock 20*d*. The shear pins 152 have been sheared, permitting axial displacement of the shaft 144 relative to the milling guide 136. The profile 142 has directed the pilot mill 138 axially downward and laterally toward the liner portion 52*d*. The pilot mill 138 has been driven by a mud motor 162 attached to the coiled tubing 146 or, for example, by drill pipe extending to the earth's surface, to mill axially downward through the liner portion 52*d* and inner core 40*d*, thereby forming an internal bore 164 therethrough.

The coiled tubing 146 may be provided with a radially outwardly extending external projection 163 thereon, so that the axially downward displacement of the pilot mill 138 relative to the milling guide 136 is stopped when the pilot mill mills completely through the inner core 40*d*. The projection 163 axially contacts the milling guide 136 when the pilot mill 138 extends a predetermined distance outwardly from the milling guide.

After the pilot mill 138 has milled completely through the inner core 40*d,* the coiled tubing 146 or drill pipe may be displaced axially upward to thereby remove the pilot mill 138 from the inner core 40*d* and liner portion 52*d,* and to retract the pilot mill and shaft 144 within the milling guide 136. If shoulders 148 and 150 are not provided on the milling guide 136 and pilot mill 138, respectively, the pilot mill 138, shaft 144, mud motor 162, and coiled tubing 146 may then be retrieved to the earth's surface. If, however, the shoulders 148, 150 are provided as shown in FIGS. 12 and 13, the milling guide 136 will be retrieved to the earth's surface along with the pilot mill 138, the shoulders axially contacting each other and thereby preventing axial displacement of the pilot mill 138 upward relative to the milling guide.

Alternatively, deployable shoulders or retrieving lugs (not shown), which are known in the art, may be used to selectively retrieve the milling guide 136 during operations. For example, upon retrieval, the milling guide 136 may get stuck and it would be desirable to leave the milling guide 136 downhole and retrieve the pilot mill to allow fishing tools to be used to retrieve the milling guide on a subsequent trip.

If the anchor 140 is not secured to the milling guide 136, as shown in FIGS. 12 and 13, the anchor will not be retrieved to the earth's surface along with the milling guide. In that case, the anchor 140 may be separately retrieved by conventional methods. If, however, the anchor 140 is secured to the milling guide 136, it may be retrieved along with the milling guide by, for example, application of a sufficient axially upward force from the milling guide to release the anchor.

After the pilot mill 138 has been removed from the internal bore 164 and the pilot mill and milling guide 136 have been removed from the subterranean well, the internal bore 164 may be enlarged as described hereinabove for the method 10 shown in FIGS. 7 and 8. For example a guide nose and mill may be utilized to substantially enlarge the internal bore 164, and a reamer may be utilized to appropriately finish and/or size the internal bore. The plug member 46*d* may be milled through or otherwise removed by, for example, retrieving it to the earth's surface.

Figure 14:
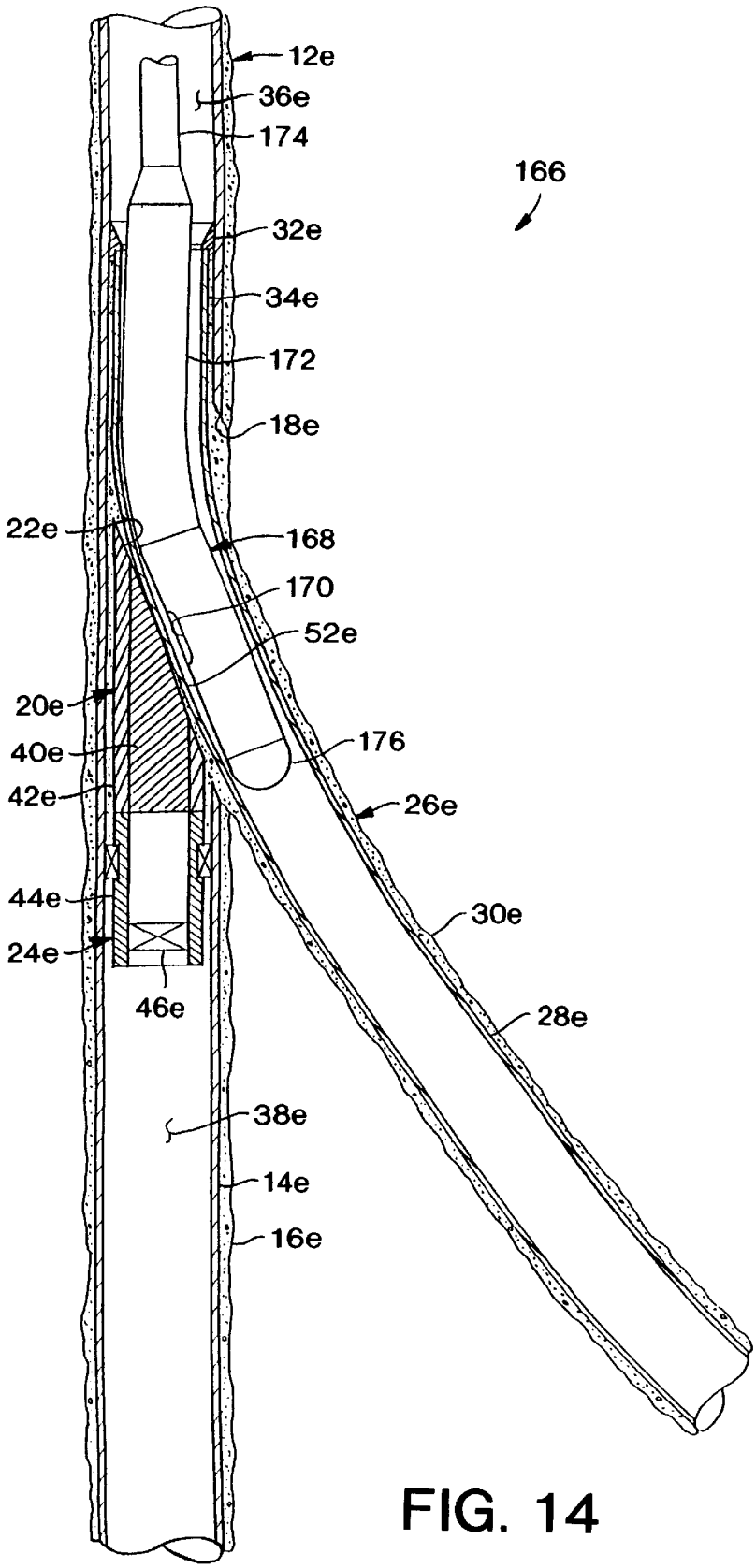
FIG. 14 is a cross-sectional view through a subterranean well illustrating a fifth method of providing access to a lower portion of a parent wellbore, the method embodying principles of the present invention.
Figure 15:
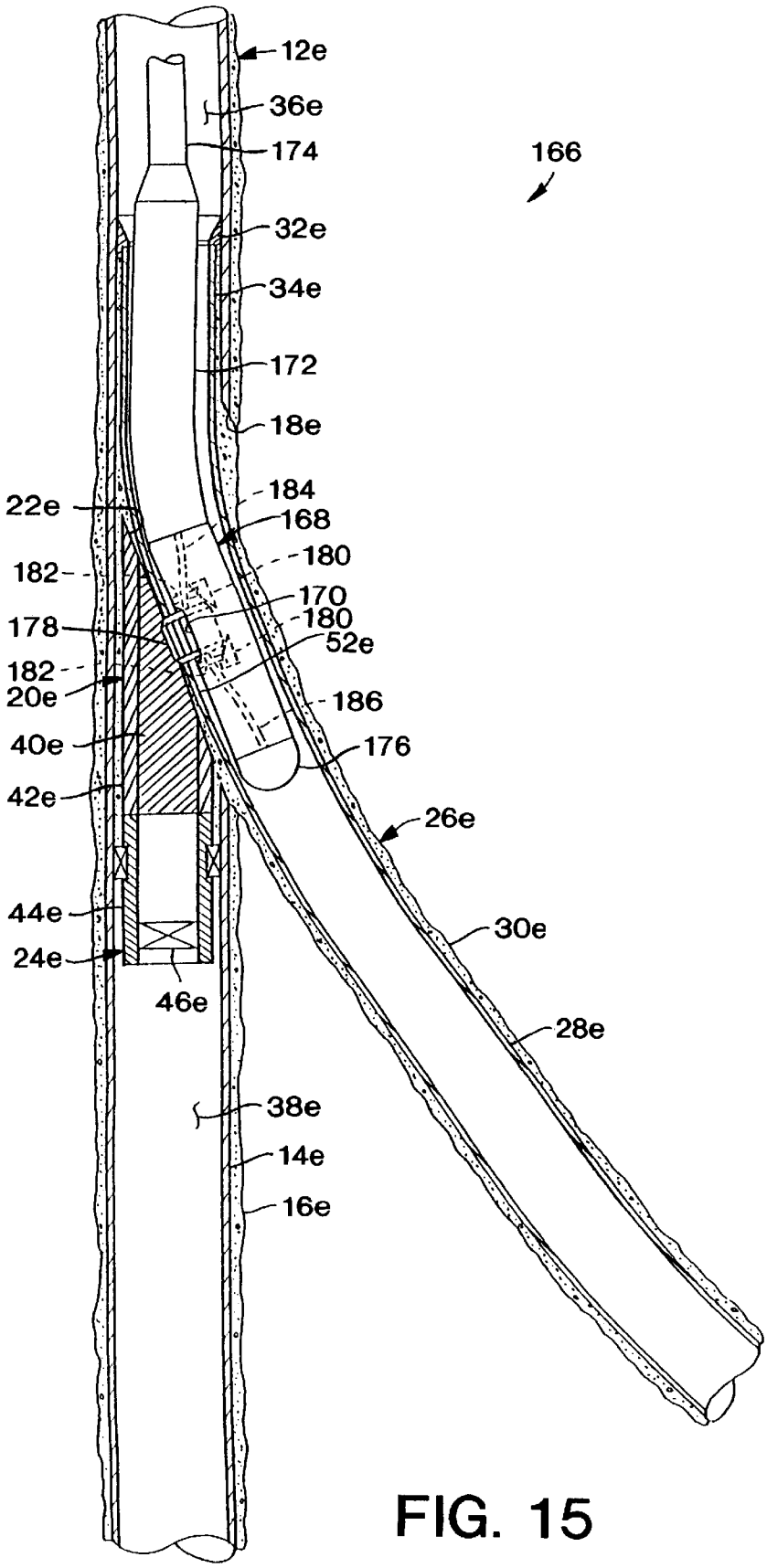
FIG. 15 is a cross-sectional view through the subterranean well of FIG. 14 showing the fifth method wherein an opening is formed through an intersection of a lateral wellbore liner and a parent wellbore casing.

Turning now to FIGS. 14 and 15, a method 166 of providing access to the lower portion 38*e* of the parent wellbore 12*e* is representatively illustrated, the method 166 utilizing a uniquely configured sidewall cutting apparatus 168. Elements shown in FIGS. 14 and 15 which are similar to elements previously described are indicated with the same reference numerals, with an added suffix "e".

In the method 166, the sidewall cutting apparatus 168 is positioned such that a radially extending opening 170 formed on the apparatus 168 is axially and rotationally aligned with the liner portion 52*e* overlying the whipstock 20*e*. Such axial and rotational alignment of the apparatus 168 may be accomplished by various conventional devices and processes, for example, by utilizing logging tools such as gamma ray detectors, gyroscopes, inclinometers, etc.

The apparatus 168 is suspended from a mud motor 172 for purposes which will become apparent upon consideration of the further description of the method 166 hereinbelow. The mud motor 172 is, in turn, suspended from drill pipe 174 extending to the earth's surface. It is to be understood that other methods of conveying the apparatus 168, such as coiled tubing, and other methods of providing a power source to the apparatus, such as by electrical cable to a downhole electric submersible motor, may be utilized without departing from the principles of the present invention.

As representatively illustrated in FIG. 14, the apparatus 168 is disposed within the liner 28*e* and extends partially into the liner upper portion 34*e*. The mud motor 172 is also shown disposed within the liner upper portion 34*e* and appears to be curved or bent in FIG. 14. It is to be understood that preferably the mud motor 172 is not curved or bent, the representatively illustrated curved or bent shape being due to convenience of illustration within the drawing dimensions. It is also to be understood that it is not necessary for the mud motor 172 to be disposed within the liner upper portion 34*e* in the method 166 according to the principles of the present invention.

At a lower end of the apparatus 168, a bull plug 176 is connected to the apparatus to close off the lower end. Other tools and/or equipment may be connected to the apparatus 168 in place of, or in addition to, the bull plug 176. For example, the mud motor 172 may be utilized to power other tools, such as a mill (not shown), below the apparatus 168.

The apparatus 168 is a uniquely modified adaptation of a telemetry-controllable adjustable blade diameter stabilizer, known as TRACS™ and marketed by Halliburton Energy Services, Incorporated of Carrollton, Tex. In conventional operation, the TRACS™ stabilizer utilizes mud flow therethrough and pressure therein to control the radial extension and retraction of stabilizer blades during milling operations. Mud pulse telemetry techniques, well known in the art, are used to control the radial outward extension of the stabilizer blades to thereby determine the blades' effective diameter within a wellbore. Full retraction of the blades may be accomplished by decreasing the mud pressure therein. It is to be understood that other devices for radially extending and retracting components within the lateral wellbore 26*e* may be utilized without departing from the principles of the present invention.

Referring specifically now to FIG. 15, the method 166 is representatively illustrated wherein the apparatus 168 is configured to cut radially outwardly through the liner portion 52*e*. A specially configured mill 178 is made to extend radially outward through the opening 170 on the apparatus 168 by utilizing the telemetry-controlled operation of the TRACS™. For this purpose, mud is circulated downward form the earth's surface, through the mud motor 172, and through the apparatus 168. Mud pulses applied to the mud flow at the earth's surface in conventional fashion are used to control the radial outward extension of the mill 178.

The telemetry-controlled mechanism 180 normally used to extend and retract stabilizer blades, is used in the apparatus 168 to extend and retract the mill 178 through the opening 170. The telemetry-controlled mechanism 180 provides two-way communication such that the completion of commands downhole are verified at the surface. A pair of bearing assemblies 182 permit rotation of the mill 178 within the telemetry-controlled mechanism 180.

The mill 178 may be configured as desired to produce an opening in the liner portion 52*e* having a corresponding desired shape. The representatively illustrated mill 178 has a generally cylindrical configuration and will, thus, produce a generally rectangular shaped opening through the liner portion 52*e*. Other configurations of the mill 178 may also be utilized, for example, the mill 178 may be provided with a spherical configuration, in which case a corresponding circular shaped opening will be produced through the liner portion 52*e*.

An upper flexible shaft 184 interconnects the mill 178 to the mud motor 172. In this manner, the mud motor 172 drives the mill 178 to rotate when mud is circulated through the mud motor. The upper flexible shaft 184 permits driving the mill 178 while the mill is at various radially extended or retracted positions with respect to the remainder of the apparatus 168. A lower flexible shaft 186 may also be provided for interconnection of the mill 178 with other tools and equipment, such as a downward facing mill, attached to the downward end of the apparatus 168 if desired. It is contemplated that the flexible shafts 184 and 186 may be comprised of articulated or jointed members, or individual members, such members being constructed of elastomeric, metallic, or composite material to allow simultaneous transmission of torque and lateral displacement.

Thus, the mill 178 is driven by the mud motor 172 and radially outwardly extended by the mechanism 180, such that the mill forms an opening through the liner portion 52*e* proximate the inner core 40*e*. The mill 178 may also be axially or rotationally displaced relative to the liner portion 52*e* in order to enlarge and/or shape the opening formed therethrough. Such displacement may be achieved by, for example, rotating, raising, or lowering the drill pipe 174 at the earth's surface.

In an alternate construction of the apparatus 168, the mill 178 may be a cutting tool as used on a milling machine in a typical machine shop operation. In that case, the cutting tool may be rotated by the mud motor 172 and a screw drive geared to the mud motor rotation may cause axial advancement of the cutting tool in an axial direction. The TRACS™ type tool may be used in this case, together with wedge devices to adjust a depth of cut of the cutting tool for each pass of the cutting tool, with multiple passes potentially required to cut a given wall thickness of a known material. A controlled profile of the opening from the lateral wellbore 26*e* to the parent wellbore 12*e* through the liner portion 52*e* may thus be formed.

In a preferred manner of operation, after the opening formed through the liner portion 52*e* has been formed as desired, mud flow through the apparatus 168 is regulated to cause the mechanism 180 to retract the mill 178 inwardly through the opening 170. Such retraction may be achieved by ceasing the flow of mud through the apparatus 168. Ceasing the flow of mud through the mud motor 172 will also cause the mud motor to cease driving the mill 178. The mud motor 172 and apparatus 168 may then be raised and retrieved from the parent and lateral wellbores 12*e*, 26*e*.

After the opening has been formed through the liner portion 52*e* and the apparatus 168 has been removed from the liner 28*e*, the opening is extended through the whipstock inner core 40*e* and radially enlarged as described hereinabove for method 10 shown in FIGS. 7 and 8, and for method 134 shown in FIG. 13. For example, a pilot mill or round nose mill may be used to extend the opening axially downward through the inner core 40*e*, a guide nose and mill may be utilized to substantially enlarge the opening, and a reamer may be utilized to appropriately finish and/or size the opening. Specifically, the milling guide 136 shown in FIG. 13 may be used to align a pilot mill (such as pilot mill 138) with the opening and direct the pilot mill to mill through the inner core 40*e*. The plug member 46*e* may then be milled through or otherwise removed by, for example, retrieving it to the earth's surface.

Figure 16:
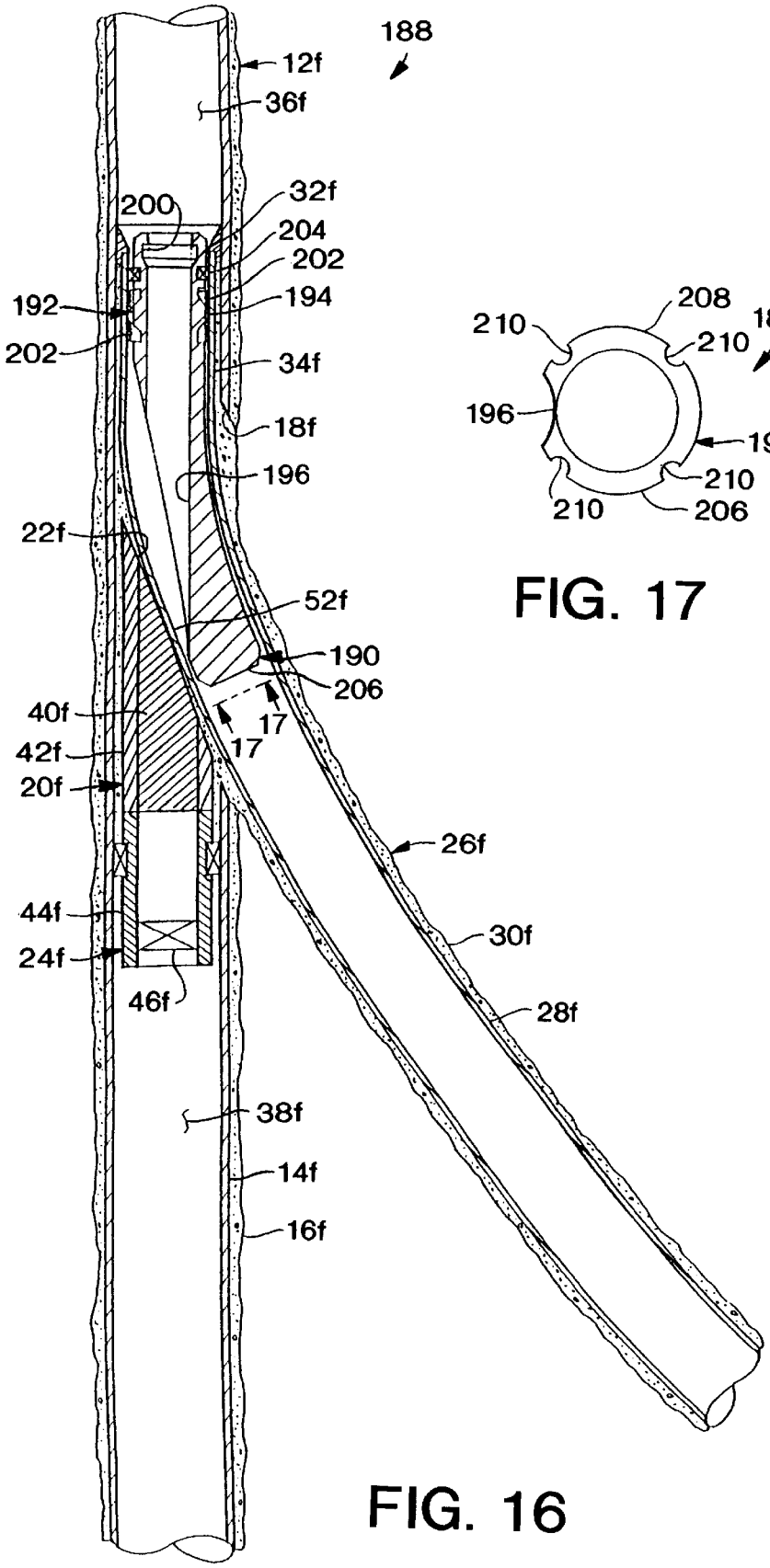
FIG. 16 is a cross-sectional view through a subterranean well illustrating a third apparatus and a sixth method of providing access to a lower portion of a parent wellbore, the apparatus and method embodying principles of the present invention.
Figure 17:
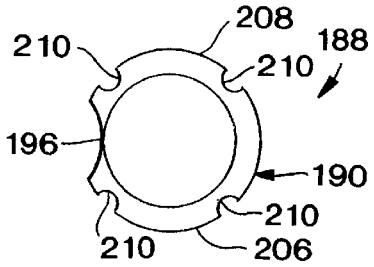
FIG. 17 is an enlarged end view of the third apparatus, as viewed from line 17—17 of FIG. 16.
Figure 18:
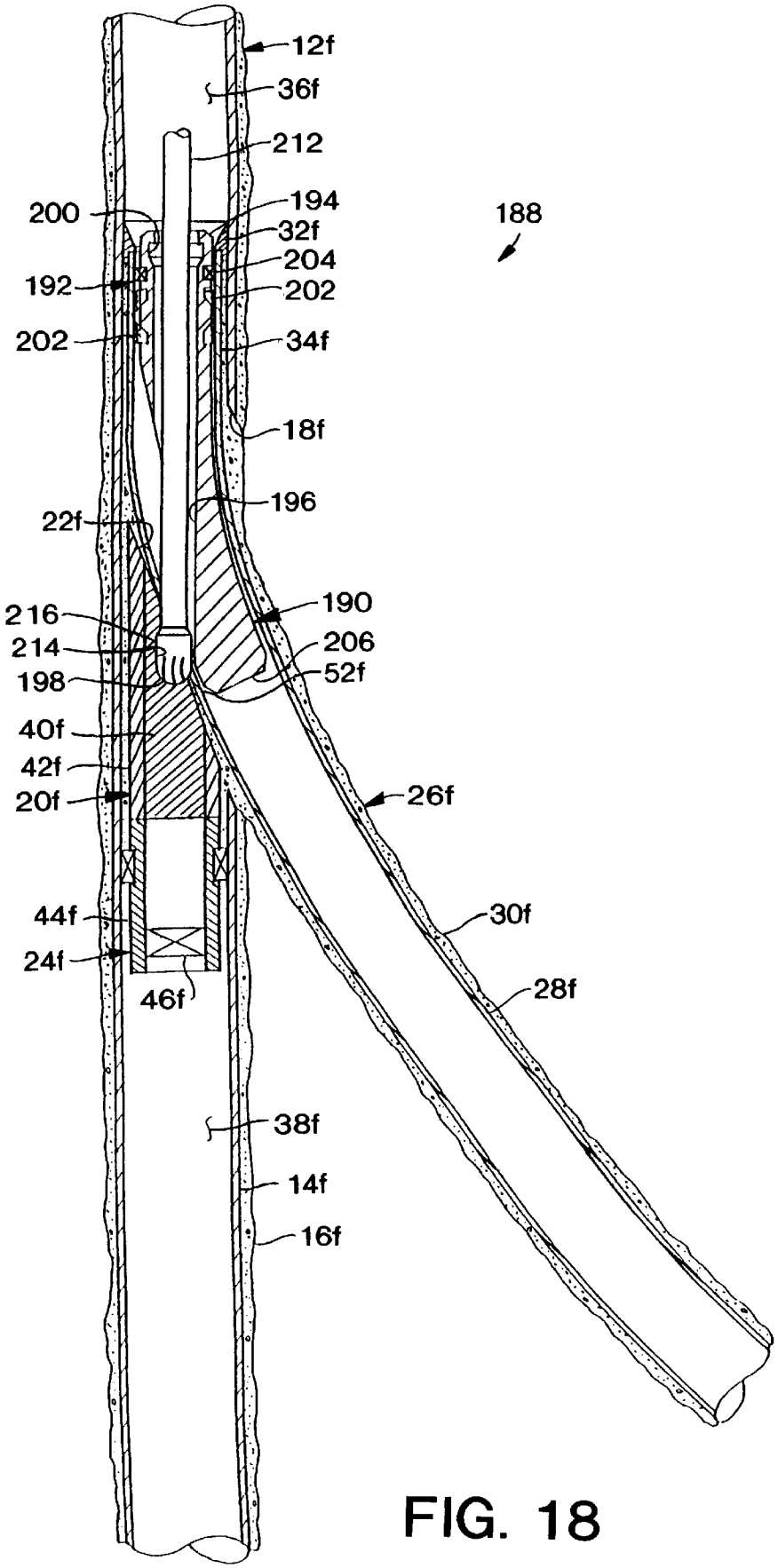
FIG. 18 is a cross-sectional view through the subterranean well of FIG. 16, showing the third apparatus and the sixth method wherein an opening is formed through an intersection of a lateral wellbore liner and a parent wellbore casing.

Referring now to FIGS. 16, 17, and 18, a method 188 of providing access to the lower portion 38*f* of the parent wellbore 12*f* is representatively illustrated. Elements shown in FIGS. 16, 17, and 18 which are similar to elements previously described are indicated with the same reference numerals, with an added suffix "f".

The method 188 utilizes a uniquely configured milling guide 190 having an anchor portion 192 disposed proximate an upper end 194 of the milling guide. The anchor portion 192 is set in the liner 28*f* downward from the liner hanger 32*f* and is utilized to axially and rotationally position the milling guide 190 relative to the liner portion 52*f* in a manner which will be more fully described hereinbelow. The milling guide 190 includes a generally axially extending mill guide surface 196 formed thereon which serves to guide a mill or pilot mill 198 toward the liner portion 52*f*.

Preferably, the guide surface 196 has a generally circular lateral cross-section, but other shapes may be utilized for the surface 196 without departing from the principles of the present invention, for example, the surface may have a hexagonal or spirally fluted cross-section to more readily permit fluid circulation in the annulus between the pilot mill 198 and the guide surface 196.

As shown in FIGS. 16 and 18, the guide surface 196 appears to be linear and the milling guide 190 appears to be curved, these appearances being due to convenience of illustration thereof within limited drawing dimensions. However, it is to be understood that the milling guide 190 may be linear and the guide surface 196 may be curved without departing from the principles of the present invention.

Although the anchor portion 192 is shown as an integral component of the milling guide 190, it is to be understood that the anchor portion may be separately attached to the milling guide 190 without departing from the principles of the present invention. The anchor portion 192 as representatively illustrated includes upper and lower slips 202 and a circumferentially extending debris barrier 204. The slips 202 grippingly engage the liner 28*f* in a conventional manner when the anchor portion 192 is set to prevent axial and rotational displacement of the milling guide 190 relative to the liner portion 52*f*. It is to be understood that a single slip may be utilized in place of the multiple slips 202 without departing from the principles of the present invention, however, the multiple slips 202 are preferred in the method 188 due to their typical ease of milling for removal, if such removal is required.

The debris barrier 204 may be conventional packer seal elements which sealingly engage the liner 28*f* in a conventional manner when the anchor portion 192 is set, however, it is to be understood that such sealing engagement is not necessary since, in the preferred embodiment of the method 188, the debris barrier 204 is utilized to prevent cuttings and other debris from accumulating about the slips 202 and making the milling guide 190 difficult to retrieve. Accordingly, it is also not necessary for the debris barrier 204 to radially outwardly extend when the anchor portion 192 is set in the liner 28*f*.

FIG. 16 shows the milling guide 190, including the anchor portion 192, as it is positioned just after the milling guide 190 has been disposed within the liner 28*f* and oriented to permit milling through the liner portion 52*f*. The milling guide 190 is conveyed downwardly into the liner 28*f* suspended from a wireline, slickline, tubing, or other conventional technique (not shown). An internal latching profile 200 formed on the milling guide 190 at its upper end 194 permits engagement therewith by a conventional latching tool (not shown) for conveying the milling guide into the liner 28*f*, and for retrieving the milling guide from the parent wellbore 12*f*.

The anchor portion 192 may be set in the liner 28*f* below the liner hanger 32*f* by conventional techniques, such as setting by wireline or on tubing, etc. Additionally, if the milling guide 190 is conveyed by tubing or drill pipe, the anchor portion 192 may be set by manipulation of the milling guide 190 from the earth's surface, or the anchor portion may be hydraulically set by application of fluid pressure through the tubing or drill pipe. It is to be understood that other techniques and devices for setting the anchor portion 192 may be utilized without departing from the principles of the present invention.

In the method 188 as representatively illustrated in FIGS. 16–18, the anchor portion 192 is set in the liner 28*f*, but it is to be understood that the anchor portion may alternatively be set in the parent wellbore casing 14*f* above the liner hanger 32*f* without departing from the principles of the present invention. For rotational orientation of the milling guide 190 relative to the liner portion 52*f*, the anchor portion 192 is correspondingly rotationally aligned relative to the liner portion 52*f*. Accordingly, the anchor portion 192 is rotationally aligned with respect to the liner 28*f* when it is set therein by, for example, use of a conventional gyroscope. Thus, when the anchor portion 192 is set in the liner 28*f*, the rotational and axial orientation of the milling guide 190 is thereby fixed relative to the liner portion 52*f*.

Referring specifically now to FIG. 17, a view is representatively illustrated of a lower end 206 of the milling guide 190, the view being taken from line 17—17 of FIG. 16. In FIG. 17 it may be seen that an outer side surface 208 of the milling guide 190 includes a series of circumferentially spaced apart and axially extending flutes 210 formed thereon. As shown in FIG. 17 there are four flutes 210 provided which are generally circular shaped, but other numbers of flutes and other shapes, such as rectangular, may be utilized for the flutes without departing from the principles of the present invention.

FIG. 17 shows an alternative configuration of the milling guide 190 wherein the guide surface 196 extends axially downward the lower end 206, thereby forming a scallop shaped recess on the lower end. The guide surface 196 may, thus, advantageously provide a path for cuttings, debris, etc., particularly but not exclusively those produced while the liner portion 52*f* is being milled through, to prevent accumulation of such cuttings and debris about the lower end 206. Such accumulation of cuttings and debris about the lower end 206 could subsequently prevent convenient retrieval of the milling guide 190 from the liner 28*f*. Additionally, the guide surface 196 as shown in FIG. 17 may also advantageously provide clearance for any burrs or anomalies produced on the inner surface of the liner portion 52*f* when it is milled through, such clearance subsequently permitting ease of retrieval of the milling guide 190 from the liner 28*f* upwardly across such burrs or anomalies.

Referring specifically now to FIG. 18, the method 188 is representatively illustrated in a configuration in which the pilot mill 198 has milled through the liner portion 52*f* and into the inner core 40*f* of the whipstock 20*f*. The guide surface 196 has directed the pilot mill 198 axially downward and laterally toward the liner portion 52*f*. The pilot mill 198 has been driven by a mud motor (not shown, see FIG. 13) attached to coiled tubing 212 from which the pilot mill is suspended or, for example, by drill pipe extending to the earth's surface, to mill axially downward through the liner portion 52*f* and into the inner core 40*f*, thereby forming an internal bore 214 therein.

If mud is circulated through the coiled tubing 212 (or optional drill pipe, etc.) while the pilot mill 198 is milling, cuttings produced thereby may be circulated back to the earth's surface with the mud. Such return circulation of the mud may be provided for by forming an additional opening through the milling guide 190, providing axially extending slots on the guide surface 196, or otherwise providing a sufficient flow path for the return circulation.

In a preferred embodiment of the method 188, the return circulation flows in the annulus between the guide surface 196 and the coiled tubing 212 or drill pipe and/or the mud motor. Where drill pipe is utilized instead of coiled tubing 212, the drill pipe may have spiral grooves cut onto its outer surface to accommodate the return circulation flow. Where the mud motor is utilized, it may be centralized with, for example, fins or a fluted stabilizing ring disposed thereon, to permit return circulation flow in the annulus between it and the guide surface 196. Accordingly, the coiled tubing 212 or drill pipe and/or the mud motor are sufficiently radially reduced relative to the guide surface 196 to permit adequate return circulation flow in the annulus therebetween.

The pilot mill 198 preferably has full gauge flanks 216 or full gauge fluted pads (not shown) attached thereto to prevent lateral displacement of the pilot mill within the milling guide 190 and within the inner core 40*f* upon penetration of the liner portion 52*f*. The pilot mill 198 is guided axially downward and laterally toward the liner portion 52*f* as the coiled tubing 212 or drill pipe is displaced axially downward. For this reason, cooperative axially slidable engagement between the pilot mill 198 and the guide surface 196 permits the pilot mill to be accurately rotationally and radially directed toward the whipstock inner core 40*f*. When the pilot mill 198 contacts the liner portion 52*f*, the engagement between the pilot mill 198 and the guide surface 196 substantially prevents both lateral and rotational displacement of the pilot mill relative to the liner portion 52*f*.

The coiled tubing 212 may be provided with a radially outwardly extending external projection (not shown, see FIG. 3) thereon, so that the axially downward displacement of the pilot mill 198 relative to the milling guide 190 is stopped when the pilot mill mills completely through the inner core 40*f*. The projection may axially contact the milling guide 190 when the pilot mill 198 extends a predetermined distance outwardly from the milling guide.

After the pilot mill 198 has milled completely through the inner core 40*f*, the coiled tubing 212 or drill pipe may be displaced axially upward to thereby remove the pilot mill 198 from the inner core 40*f* and liner portion 52*f*, and to withdraw the pilot mill and coiled tubing 212 from within the milling guide 190. The pilot mill 198, mud motor, and coiled tubing 212 may then be retrieved to the earth's surface.

After the pilot mill 198 has been removed from the milling guide 190, the internal bore 214 may be enlarged as described hereinabove for the method 10 shown in FIGS. 7 and 8. For example, a guide nose and mill may be utilized to substantially enlarge the internal bore 214, and a reamer may be utilized to appropriately finish and/or size the internal bore. If the guide surface 196 is sufficiently large, certain of the enlargement steps may be performed with the milling guide 190 in its position as shown in FIG. 18, the milling guide thereby guiding other cutting tools toward the bore 214.

The milling guide 190 is, however, preferably retrieved from the liner 28*f* before the above described bore enlargement steps are performed. Retrieval of the milling guide 190 is achieved by, for example, latching a conventional tool (not shown) into the latching profile 200 and applying a sufficient upwardly directed force thereto in order to unset the anchor portion 192. The slips 202 being thereby retracted and no longer grippingly engaging the liner 28*f*, the milling guide 190 may be displaced upwardly through the parent wellbore 12*f* to the earth's surface.

The plug member 46*f* may be milled through or otherwise removed by, for example, retrieving it to the earth's surface. Such retrieval of the plug member 46*f* is preferably performed after the milling guide 190 is retrieved.

Retrieval of the pilot mill 198 separately of retrieval of the milling guide 190 produces various benefits. For example, the pilot mill 198 and mud motor may be replaced or redressed without the need of retrieving the milling guide 190. As another example, the milling guide 190 without the coiled tubing 212 or pilot mill 198 received therein presents a more easily "fished" configuration. As yet another example, jars (not shown) may be used when fishing or otherwise retrieving the milling guide 190, whereas jars are not conveniently utilized on the coiled tubing 212 or drill pipe during the above described bore milling and enlarging operations, due at least in part to uncertainty induced by jars as to where the pilot mill 198 is positioned. These and other benefits of the above described method 188 and milling guide 190 will be apparent to those persons of ordinary skill in the art.

Figure 19:
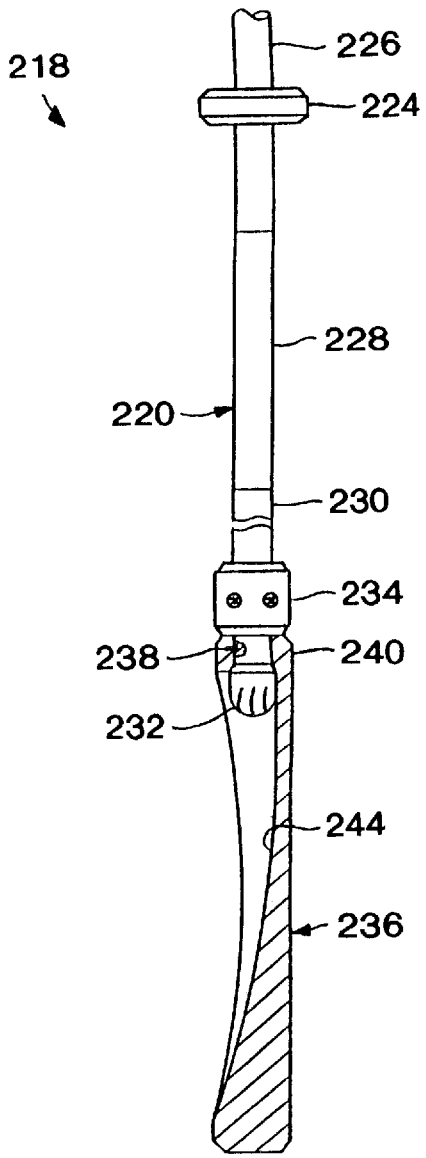
FIG. 19 is a partially elevational and partially cross-sectional view of a fourth apparatus embodying principles of the present invention.
Figure 20:
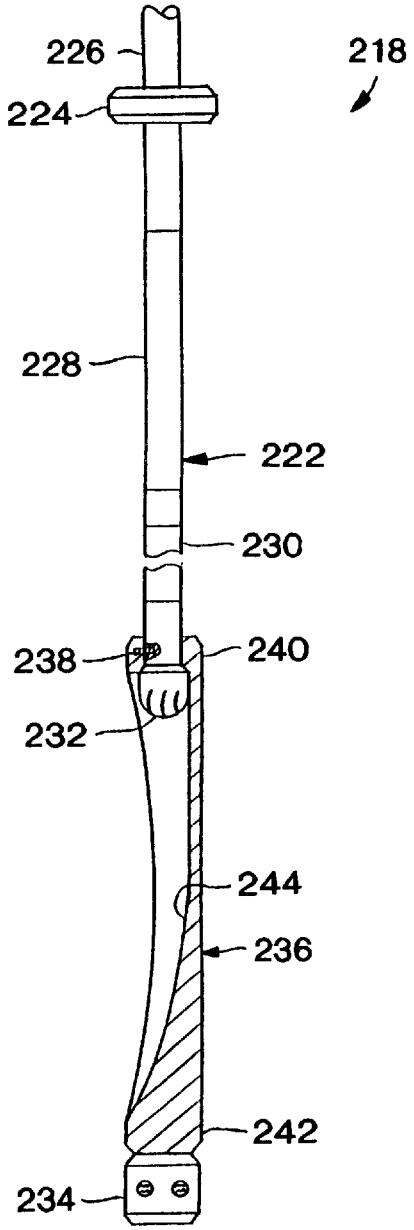
FIG. 20 is a partially elevational and partially cross-sectional view of a fifth apparatus embodying principles of the present invention.

Turning now to FIGS. 19 and 20, another method 218 of providing access to a lower portion of a parent wellbore is representatively illustrated, FIGS. 19 and 20 showing alternate configurations of bottom hole assemblies 220 and 222, respectively which may be utilized in the method 218. As with the previously described methods, method 218 may be performed within a subterranean well having a lateral wellbore, such as lateral wellbore 26 shown in FIG. 1, and a parent wellbore, such as parent wellbore 12 of FIG. 1, wherein a lower portion of the parent wellbore, such as lower portion 38, is isolated from an upper portion or the parent wellbore, such as upper portion 36, by a liner, such as liner 28, which extends laterally from the parent wellbore, a portion of the liner, such as liner portion 52, overlying the parent wellbore lower portion. Furthermore, as with the previously described methods, access may be provided to the parent wellbore lower portion by forming an opening through the liner portion overlying the parent wellbore lower portion.

The method 218 and the bottom hole assemblies 220, 222 are specially adapted for use in circumstances in which operations are performed from a floating rig or other structure near the earth's surface in which the distance between the structure and the subterranean well may vary during performance of the operations. For example, where a floating rig is utilized, typically the floating rig moves somewhat up and down as swells or waves rise and fall about the rig. Although the floating rig may be equipped with equipment known as heave motion compensators, such equipment is not always capable of completely eliminating relative displacement between the mill and the subterranean well.

In such circumstances wherein there is relative displacement between the structure from which operations are to be performed and the subterranean well, it is well known that drilling techniques, such as a technique known to those skilled in the art as "time-drilling" may be very difficult to perform. In time-drilling, a drilling, milling, or other cutting tool is placed in contact with a surface into which the cutting tool is to penetrate, and the cutting tool is driven by a rotary table and drill pipe, mud motor suspended on drill pipe or coiled tubing, or other technique, and is maintained in contact with the surface for a predetermined period of time. When the predetermined period of time has elapsed, the cutting tool is advanced into contact with the surface again, the cutting tool having previously cut away a portion of the surface with which the cutting tool was in contact. Therefore, it may be seen that relative displacement between the cutting tool and the surface to be penetrated is very important in operations such as time-drilling.

The method 218 and bottom hole assemblies 220, 222 advantageously utilize the configuration of the particular subterranean well to permit convenient performance of operations such as time-drilling from structures such as floating rigs which are known to displace relative to the subterranean well. In the following detailed description of the method 218 and bottom hole assemblies 220, 222, reference will be made to the subterranean well and elements thereof as representatively illustrated in FIG. 1 as an example of a subterranean well wherein the method 218 may be performed. It is to be understood, however, that the method 218 may be performed in other subterranean wells having different configurations, without departing from the principles of the present invention.

The bottom hole assemblies 220, 222 each include a radially outwardly extending projection 224 connected to drill pipe 226, coiled tubing, or other conveyance, a conventional mechanism known to those skilled in the art as a hydraulic advance 228, and may also include a mud motor 230. The bottom hole assemblies 220, 222 further include a cutting tool, such as a pilot mill 232, an anchor 234, and a milling guide 236. Note that in bottom hole assembly 220 the anchor 234 is positioned above the milling guide 236, and in bottom hole assembly 222 the anchor is positioned below the milling guide.

The projection 224 is representatively illustrated as being positioned on the drill pipe 226. In this manner, the disposition of the bottom hole assembly 220 or 222 may be fixed relative to the liner 28 as will be more fully described hereinbelow. It is to be understood, however, that the projection 224 may be otherwise positioned, for example, the projection may be positioned on the hydraulic advance 228, without departing from the principles of the present invention.

The projection 224 axially engages the liner hanger 32 when the bottom hole assembly 220 or 222 is lowered into the liner 28. The liner hanger 32, thus, acts as a no-go to prevent further axially downward displacement of the bottom hole assembly 220 or 222 relative to the liner 28. Weight may then be applied via the drill pipe 226 to maintain the projection 224 in axial engagement with the liner hanger 32. Therefore, it will be readily apparent to one of ordinary skill in the art that, when the bottom hole assembly 220 or 222 is lowered and received into the liner 28 and the projection 224 axially engages the liner hanger 32, the axial disposition of the bottom hole assembly 220 or 222 relative to the liner 28 is effectively fixed.

It is contemplated that the projection 224 may be permitted to rotate about the drill pipe 226, in which case bearings, bushings, etc. may be provided radially between the projection and the drill pipe, and the drill pipe may thereby be permitted to drive the pilot mill 232, in which case the mud motor 230 may not be utilized in the bottom hole assembly 220 or 222. Where the projection 224 is rotationally fixed relative to the drill pipe 226, and it is not desired for the projection 224 to rotate relative to the liner hanger 32, the mud motor 230 permits the pilot mill 232 to be driven by mud circulation therethrough. In a preferred embodiment of the method 218, the projection 224 is permitted to rotate about the drill pipe 226, but is initially rotationally fixed to the drill pipe by utilizing a releasable attachment, such as a shear pin (not shown) installed radially into the projection and drill pipe, so that the milling guide 236 may be axially and rotationally aligned with the liner portion 52 prior to setting the anchor 234, and relative rotation between the drill pipe and the projection may then be permitted by releasing the attachment, such as by shearing the shear pin.

The bottom hole assembly 220 or 222 may be rotationally oriented so that the milling guide 236 is rotationally aligned with the liner portion 52. Such rotational alignment may be achieved by conventional techniques, such as by utilizing a gyroscope, or the projection 224 and liner hanger 32 may have cooperating and complementarily shaped surfaces formed thereon which, when operatively engaged with each other, fix the rotational orientation of the bottom hole assembly 220 or 222 relative to the liner 28. Such complementarily shaped surfaces may be similar to those surfaces 126 and 132 shown in FIG. 11 and described hereinabove, or may be otherwise formed without departing from the principles of the present invention.

Where the projection 224 cooperatively engages the liner hanger 32 to thereby fix the rotational alignment of the milling guide 236 relative to the liner portion 52, it would be desirable for the liner hanger 32 to be rotationally oriented with respect to the liner portion 52, and for the projection 224 to be rotationally oriented with respect to the milling guide 236. For rotational orientation of the projection 224 with respect to the milling guide 236, each of the projection 224, drill pipe 226, hydraulic advance 228, mud motor 230, and pilot mill 232 may be at least initially fixed by conventional techniques to prevent relative axial rotation therebetween. The rotational orientation of the milling guide 236 may be initially fixed relative to the pilot mill 232 by utilizing a shear pin 238 installed through an upper end 240 of the milling guide and into the pilot mill. It is to be understood that other techniques of fixing the relative rotational orientation of the elements of the bottom hole assemblies 220, 222 may be utilized without departing from the principles of the present invention.

The hydraulic advance 228 is representatively illustrated as being interconnected axially between the drill pipe 226 and the mud motor 230. If, as more fully described hereinabove, the mud motor 230 is not utilized in the bottom hole assembly 220 or 222, the hydraulic advance 228 may be connected directly to the pilot mill 232. It is also contemplated that the mud motor 230, if utilized, may be interconnected axially between the drill pipe 226 and the hydraulic advance 228. These alternate dispositions of the elements of the bottom hole assemblies 220, 222, as well as others, may be made without departing from the principles of the present invention.

The hydraulic advance 228 is of the type, well known in the art, which is capable of being selectively axially elongated by application of fluid pressure thereto. Thus, mud circulation thereto may be utilized to operate the hydraulic advance 228 as desired to axially displace the pilot mill 232 relative to the projection 224. In this manner, time-drilling may be conveniently performed, the hydraulic advance 228 axially displacing the pilot mill 232 to successively cut and penetrate the liner portion 52 as desired at chosen time intervals. The projection 224 operating to fix the axial position of the bottom hole assembly 220 or 222 relative to the liner 28, such axial displacement of the pilot mill 232 by the hydraulic advance 228 may be achieved independent of any movement of the floating rig or other structure relative to the subterranean well. Preferably, jars, bumper subs, or other telescoping joints are provided on the drill pipe 226 above the bottom hole assembly 220 or 222, to permit relative displacement between the bottom hole assembly and the floating rig.

The anchor 234 may be of conventional construction and may be operatively connected to the upper end 240, as shown in FIG. 19, or to a lower end 242 of the milling guide 236, as shown in FIG. 20. Alternatively, the anchor 234 may be integrally constructed with the milling guide 236, similar to the integral construction of the anchor portion 192 of the milling guide 190 shown in FIG. 16, or may be otherwise operatively interconnected to the milling guide 236 without departing from the principles of the present invention. When set in the liner 28, the anchor 234 secures the milling guide 236 axially and rotationally within the liner. If, as more fully described hereinabove, the projection 224 is not rotationally oriented relative to the liner hanger 32, the milling guide 236 may be otherwise rotationally oriented by, for example, utilizing a conventional gyroscope, prior to setting the anchor 234 in the liner 28. Note that, although the anchor 234 is fixed relative to the milling guide 236, the pilot mill 232, mud motor 230, drill pipe 226, and/or hydraulic advance 228 may be axially slidingly received therein.

The pilot mill 232 is received within the upper end 240 of the milling guide 236. As representatively illustrated, the pilot mill 232 is releasably secured to the upper end 240 by a shear pin 238 and is prevented from axially upwardly displacing relative to the milling guide 236 by axial engagement therewith, similar to the axial engagement between the shoulders 148, 150 of the pilot mill 138 and milling guide 136 shown in FIG. 12 and more fully described hereinabove. Alternatively, the upper end 240 may be configured so that the pilot mill 232 may pass axially upward therethrough by, for example, providing the upper end having a radially enlarged bore as compared to that representatively illustrated in FIGS. 19 and 20, without departing from the principles of the present invention. When the projection 224 is in operative engagement with the liner hanger 32 as above-described and the anchor 234 is set in the liner 28 as above-described, the pilot mill 232 may be axially downwardly displaced relative to the milling guide 236 by utilizing the hydraulic advance 228 to shear the shear pin 238 and extend the pilot mill axially downward through the milling guide.

The milling guide 236 is similar to the milling guide 136 shown in FIG. 12 and described hereinabove, and is similar to the milling guide 190 shown in FIG. 16 and described hereinabove. The milling guide 236 is generally axially elongated and has a guide profile 244 formed thereon which cooperatively engages the pilot mill 232 to direct it to be laterally displaced with respect to the milling guide when it axially downwardly displaces relative to the guide profile. Accordingly, when the pilot mill 232 axially displaces downwardly relative to the milling guide 236, the guide profile 244 cooperatively engages the pilot mill and laterally displaces the pilot mill outward from the milling guide.

When the milling guide 236 is rotationally aligned with the liner portion 52 as more fully described hereinabove, the guide profile 244 faces the liner portion 52. Thus, when the pilot mill 232 is directed laterally outward by the guide profile 244, the pilot mill will contact the liner portion 52. Prior to the pilot mill 232 contacting the liner portion 52, mud is circulated through the mud motor 230 to drive the pilot mill, so that when the pilot mill contacts the liner portion, the pilot mill is able to cut into and penetrate the liner portion. The guide profile 244 provides lateral and circumferential support for the pilot mill 232 as it cuts and penetrates into the liner portion 52.

After the pilot mill 232 has penetrated into the liner portion 52, the pilot mill may mill axially through the whipstock inner core 40 to form an opening therethrough as in the method 134 shown in FIG. 13. Thereafter, the opening may be enlarged as more fully described hereinabove. Preferably, the pilot mill 232 is withdrawn axially upward from the opening, the anchor 234 is unset, and the bottom hole assembly 220 or 222 is retrieved from the subterranean well prior to enlargement of the opening. Where the upper end 240 has the above-described alternate configuration, wherein the pilot mill 232 is permitted to pass axially upward therethrough, the pilot mill, hydraulic advance 228, projection 224, drill pipe 226, and mud motor 230 may be retrieved from the subterranean well separately from the milling guide 236 and anchor 234.

Alternatively, deployable shoulders or retrieving lugs (not shown), which are known in the art, may be used to selectively retrieve the milling guide 236 during operations. For example, upon retrieval, the milling guide 236 may get stuck and it would be desirable to leave the milling guide 236 downhole and retrieve the pilot mill 232 to allow fishing tools to be used to retrieve the milling guide on a subsequent trip.

Referring now to FIGS. 21–24 a method 246 of providing access to the lower portion 38*g* of the parent wellbore 12*g* is representatively illustrated. Elements shown in FIGS. 21–24 which are similar to elements previously described are indicated with the same reference numerals, with an added suffix "g".

Figure 21:
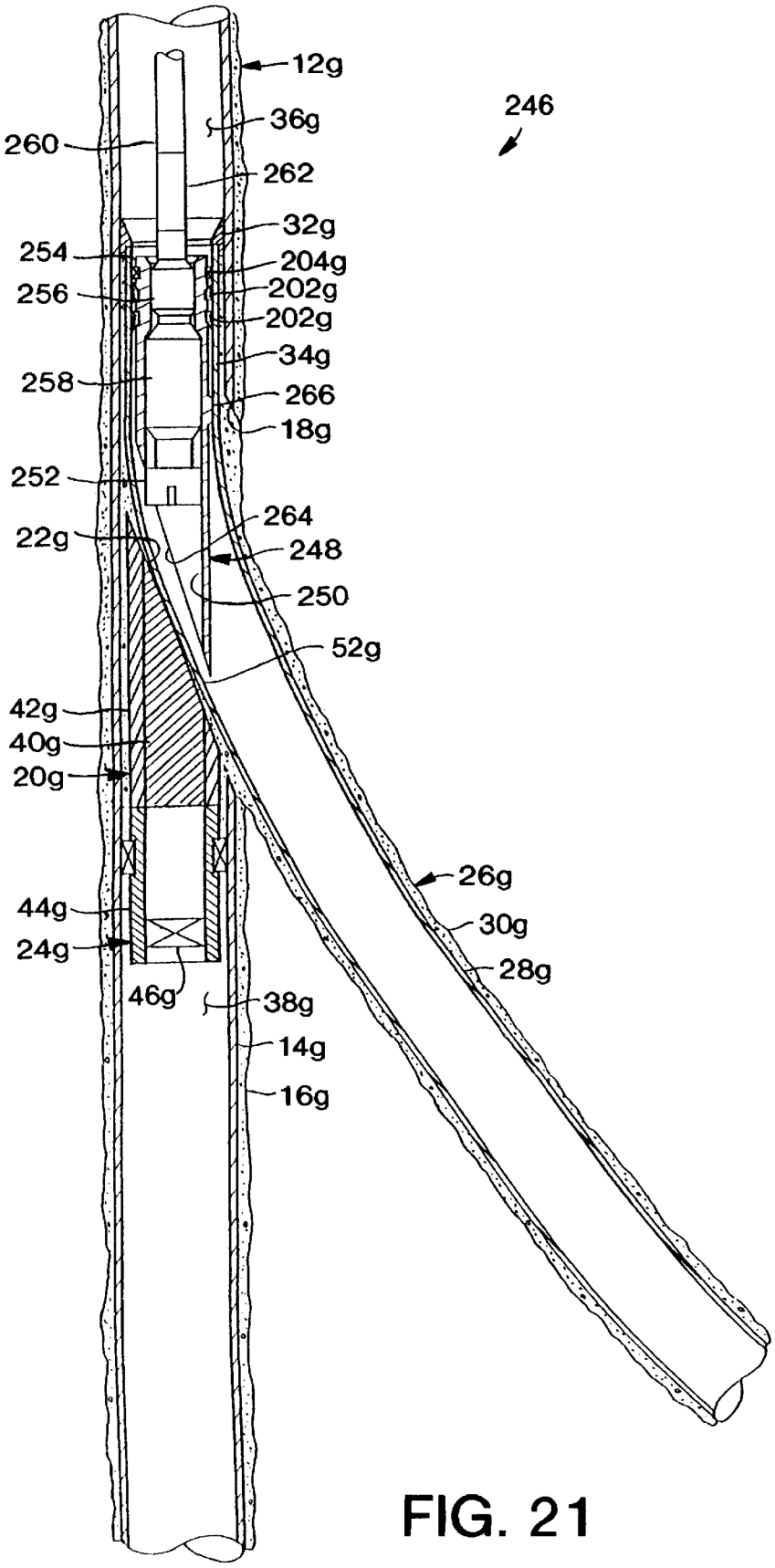
FIG. 21 is a cross-sectional view through a subterranean well illustrating a sixth apparatus and a seventh method of providing access to a lower portion of a parent wellbore wherein an opening is being formed through a liner, the apparatus and method embodying principles of the present invention.

The method 246 utilizes a uniquely configured milling guide 248. The milling guide 248 has an axially extending guide profile 250 formed therein which is operative to direct a cutting tool, such as a pilot mill 252, toward the liner portion 52*g* overlying the whipstock 20*g*. The milling guide 248 also includes an internally radially reduced upper portion 254 which has slips 202*g* and the debris barrier 204*g* externally disposed thereon. The slips 202*g* are shown in FIG. 21 grippingly engaging the liner upper portion 34*g*, the milling guide 248 being received within the liner 28*g*. It is to be understood that the milling guide 248 may also be provided wherein the upper portion 254 is not internally radially reduced, in which case the pilot mill 252 may be retrieved from the subterranean well separately from the milling guide.

An upper stabilizer 256 is axially slidingly received within the milling guide upper portion 254, and a lower stabilizer 258 is slidingly received within the milling guide profile 250. The upper stabilizer 256 is connected to drill pipe 260 or coiled tubing extending to the earth's surface and is suspended therefrom. The lower stabilizer 258 is connected axially between the upper stabilizer 256 and the pilot mill 252. As shown in FIG. 21, the lower stabilizer 258 is somewhat radially enlarged relative to the internally radially reduced upper portion 254, thereby enabling the milling guide 248 to be conveyed into the subterranean well suspended from the drill pipe 260. Alternatively, the lower stabilizer 258 may be somewhat radially reduced relative to the milling guide upper portion 254, thereby permitting the lower stabilizer to pass axially therethrough, in which case the milling guide may be conveyed into the subterranean well suspended from the drill pipe 260 by, for example, releasably securing the milling guide to the drill pipe or upper stabilizer utilizing shear pins (not shown). As another alternative, the upper and lower stabilizers 256, 258, respectively, may have a substantially same outer diameter, and the upper portion 254 and guide profile 250 may have a substantially same inner diameter, so that the upper and lower stabilizers are capable of axially reciprocating displacement within substantially the same inner diameter of the milling guide 248.

A mud motor or other downhole motor 262 may also be provided for driving the pilot mill 252, or the pilot mill may be driven by other techniques, such as by rotating the drill pipe 260 at the earth's surface using a conventional rotary table.

In operation, the milling guide 248, upper and lower stabilizers 256, 258, respectively, pilot mill 252, mud motor 262, and drill pipe 260 are run into the subterranean well until the milling guide 248 is properly disposed within the liner upper portion 34*g*. For proper disposition of the milling guide 248, the guide profile 250 is preferably oriented to direct the pilot mill 252 toward the whipstock inner core 40*g*. The milling guide 248 may include an axially sloping lower end surface 264, in which case the lower end surface 264 is preferably rotationally aligned with the liner portion 52*g*. For enhanced stabilization of the pilot mill 252 while it cuts and penetrates into the liner portion 52*g* and inner core 40*g*, the lower end surface 264 is preferably contacting or closely spaced apart from the liner portion 52*g*. Rotational orienting of the milling guide 248 relative to the liner 28*g* may be accomplished by conventional techniques well known to those of ordinary skill in the art, for example, a gyroscope may be utilized.

When the milling guide 248 is properly positioned within the liner 28*g*, the slips 20*g* are set so that they radially outwardly grippingly engage the liner 28*g*. Such setting of the slips 202*g* may be achieved by conventional techniques, such as by applying fluid pressure internally to the drill pipe 260 as is typically done when setting a conventional hydraulic packer, or by manipulation of the drill pipe at the earth's surface. Where the slips 202 are set hydraulically, preferably a fluid conduit (not shown) is provided between the drill pipe 260 and the upper portion 254.

After the slips 202*g* are set, the axial and rotational alignments of the milling guide 248 and the liner portion 52*g* are effectively fixed. Mud may then be circulated through the mud motor 262, or the drill pipe 260 may be rotated, etc., to drive the pilot mill 252. The drill pipe 260 may then be lowered from the earth's surface, or a hydraulic advance (such as hydraulic advance 228 shown in FIGS. 19 and 20) may be operated, etc., to axially downwardly displace the pilot mill 252 relative to the milling guide 248, the guide profile 250 directing the pilot mill to contact the liner portion 52*g*. The milling guide 248 may be releasably axially secured to the drill pipe 260, upper or lower stabilizer 256, 258, respectively, etc., by, for example, shear pins (such as shear pins 152, see FIG. 12), in which circumstance the shear pins are preferably sheared by axial displacement of the drill pipe relative to the milling guide.

With the pilot mill 252 being driven and axially downwardly displaced relative to the milling guide 248, the pilot mill eventually contacts, cuts, and axially penetrates into the liner portion 52*g*. When the driven pilot mill 252 contacts and begins cutting the liner portion 52*g*, the milling guide 248, and specifically the guide profile 250, prevent lateral displacement of the pilot mill relative to the liner portion 52*g*. Additionally, a radially outwardly extending lateral support 266 externally formed on the milling guide 248 prevents lateral displacement of the milling guide relative to the liner 28*g*. It is to be understood that a series of lateral supports, such as lateral support 266, may be provided on the milling guide 248 to thereby prevent lateral displacement of the milling guide relative to the liner 28*g* in various directions, and that the lateral support 266 may be otherwise configured or placed on the milling guide without departing from the principles of the present invention.

When the pilot mill 252 has cut and penetrated into the liner portion 52*g*, the pilot mill may also cut and penetrate into the whipstock inner core 40*g*, forming an initial axially extending opening 268 (see FIG. 22) therein. Preferably, the pilot mill 252 is then axially upwardly displaced relative to the liner portion 52*g* and withdrawn therefrom by raising the drill pipe 260, or retracting the hydraulic advance if it was provided. Alternatively, the pilot mill 252 may be axially downwardly displaced a sufficient distance to cut completely through the inner core 40*g*, in which case the opening 268 will extend axially through the inner core.

In the preferred illustrated method 246, the milling guide 248, pilot mill 252, upper and lower stabilizers 256, 258, respectively, mud motor 262, and drill pipe 260 are retrieved from the subterranean well after the pilot mill has only partially cut axially through the inner core 40*g* by pulling upward sufficiently on the drill pipe 260 to unset the slips 202*g* (or otherwise unsetting the slips), and removing the foregoing from the well. If, as described hereinabove, an alternate configuration of the milling guide 248 is provided in which the lower stabilizer 258 is radially reduced relative to the milling guide upper portion 254, the pilot mill 252, upper and lower stabilizers 256, 258, respectively, mud motor 262, and drill pipe 260 are retrieved from the subterranean well separately from the milling guide. The milling guide 248 is then retrieved from the subterranean well by, for example, latching onto the milling guide with an appropriate latching tool (not shown) conveyed into the subterranean well by, for example, a slickline, and applying sufficient force to unset the slips 202*g*.

Alternatively, deployable shoulders or retrieving lugs (not shown), which are known in the art, may be used to selectively retrieve the milling guide 248 during operations. For example, upon retrieval, the milling guide 248 may get stuck and it would be desirable to leave the milling guide 248 downhole and retrieve the pilot mill 252 to allow fishing tools to be used to retrieve the milling guide on a subsequent trip.

Referring specifically now to FIG. 22, the method 246 is shown wherein a cutting tool known to those skilled in the art as a round nose or ball end mill 270 is lowered into the subterranean well, in order to axially downwardly cut through the inner core 40*g*. The ball end mill 270 is preferred in this operation since it is capable of laterally cutting as well as axially cutting into the inner core 40*g*. Thus, the ball end mill 270 will tend to cut through the inner core 40*g* without cutting into the outer case 42*g* of the whipstock 20*g*, the ball end mill diverting laterally inward in the inner core if it contacts the relatively harder to cut outer case. To facilitate such lateral cutting capability, the ball end mill 270 has radially reduced flanks 272 formed thereon.

The ball end mill 270 is operatively connected to a cutting tool known to those skilled in the art as a string or watermelon mill 274 which is operatively connected to drill pipe 276 or coiled tubing extending to the earth's surface. The ball end mill 270 is lowered into the opening 268 and is driven and axially downwardly displaced to cut through the inner core 40*g*, thereby forming an opening 278 (see FIG. 23) axially through the inner core 40*g*. The watermelon mill 274 follows the ball end mill 270 through the openings 268, 278 to clean and smooth internal surfaces thereof. In a preferred embodiment of the method 246, the ball end mill 270 and the pilot mill 252 have substantially the same outer diameter, in which case, the openings 268, 278 will correspondingly have substantially the same inner diameter.

After the ball end mill 270 has cut axially through the inner core 40*g*, it is retrieved from the well along with the watermelon mill 274 and the drill pipe 276. Note that, preferably, the ball end mill 270 and watermelon mill 274 are somewhat radially reduced relative to the pilot mill 252, thereby forming the opening 278 correspondingly radially reduced relative to the opening 268, but it is to be understood that the ball end mill and/or watermelon mill may be otherwise configured without departing from the principles of the present invention.

Referring specifically now to FIG. 23, the method 246 is shown wherein a guide nose 280, reaming mill 282, string or watermelon mill 284, and drill pipe 286 are lowered into the subterranean well. The guide nose 280 is operatively connected to the reaming mill 282 in order to guide the reaming mill axially through the openings 268, 278 previously formed axially through the inner core 40*g*. The guide nose 280 and reaming mill 282 may be substantially similar to the guide nose 74 and mill 76 representatively illustrated in FIG. 7 and more fully described hereinabove. Specifically, the guide nose 280 is preferably axially retractable within the reaming mill 282, so that if the guide nose axially contacts the plug member 46*g*, the guide nose is capable of retracting axially and permitting the reaming mill to pass completely axially through the inner core 40*g*.

The reaming mill 282 is driven by, for example, rotating the drill pipe 286 in a rotary table at the earth's surface, or circulating mud through a mud motor operatively interconnected to the drill pipe. The guide nose 280, reaming mill 282, watermelon mill 284, and drill pipe 286 are then lowered, the guide nose thereby being inserted into the opening 268. The reaming mill 282 will then follow the guide nose 280 axially through the openings 268, 278 to enlarge the openings and substantially remove remaining portions of the inner core 40*g*.

The watermelon mill 284, in turn, follows the reaming mill 282 to clean and smooth a resulting opening 288 (see FIG. 24) thereby formed completely axially through the whipstock 20*g*. Note that the opening 268 as it passes axially through the liner portion 52*g* is also enlarged by the reamer 282 and watermelon mill 284. The drill pipe 286, watermelon mill 284, reaming mill 282, and guide nose 280 are then retrieved from the subterranean well.

Referring specifically now to FIG. 24, the method 246 is shown wherein a plug mill 290, two string or watermelon mills 292, and drill pipe 294 or coiled tubing are lowered into the subterranean well in order to remove the plug member 46*g* disposed within the packer 24*g*. It is to be understood that other techniques may be utilized to remove the plug member 46*g*, for example, the plug member may be retrieved to the earth's surface.

In the preferred method 246, the plug mill 290 is lowered into the opening 288 and axially downwardly displaced therein. The plug mill 290 is driven by rotating the drill pipe 294 at the earth's surface, or mud may be circulated through a mud motor interconnected to the drill pipe, etc. The plug mill 290 is then brought into axial contact with the plug member 46*g* to cut the plug member from the packer 24*g*. The watermelon mills 292 interconnected axially between the plug mill 290 and the drill pipe 294 follow the plug mill through the opening 288, and clean and smooth the opening.

When the plug member 46*g* has been removed from the packer 24*g,* the plug mill 290, watermelon mills 292, and drill pipe 294 are retrieved from the subterranean well. It will now be fully appreciated that access to the parent wellbore lower portion 38*g* has thus been provided by the method 246.

Figure 25:
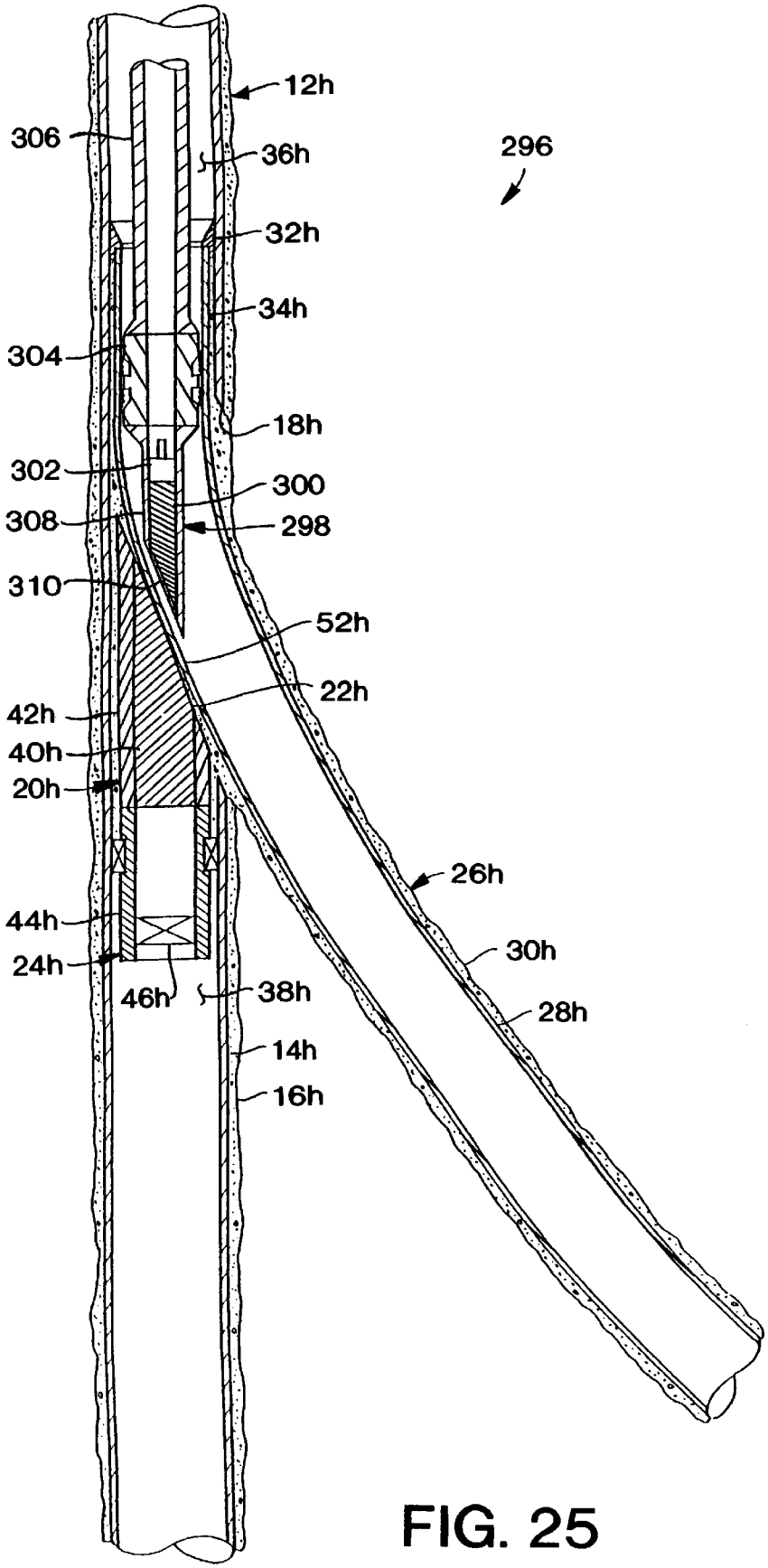
FIG. 25 is a cross-sectional view through a subterranean well illustrating a seventh apparatus and an eighth method of providing access to a lower portion of a parent wellbore wherein an opening is being formed through a liner, the apparatus and method embodying principles of the present invention.

Turning now to FIG. 25, a method 296 of providing access to the lower portion 38*h* of the parent wellbore 12*h* is representatively illustrated. Elements shown in FIG. 25 which are similar to elements previously described are indicated with the same reference numerals, with an added suffix "h".

The method 296 utilizes a uniquely configured apparatus 298 for forming an opening through the liner portion 52*h*. For this purpose, the apparatus 298 includes a cutting device 300 operatively connected to a firing head 302. The apparatus 298 is axially and radially aligned relative to the liner portion 52*h* by an anchor 304 which is set in the liner upper portion 34*h,* and which is suspended from, and conveyed into the subterranean well along with the apparatus 298 by, drill pipe 306 or coiled tubing.

The device 300 is preferably of the type known as a Thermol Torch™ marketed by Halliburton Energy Services, Incorporated of Alvarado, Tex. The Thermol Torch™ is capable of cutting through metal, such as the liner portion 52*h,* or other materials upon being initiated. For initiating the device 300, the firing head 302 contains a conventional explosive, so that when the explosive is detonated, the device 300 will burn an opening in the liner portion 52*h* overlying the whipstock 20*h*. It is to be understood that the device 300 may be other than a Thermol Torch™ without departing from the principles of the present invention, for example, the device 300 may be of the type well known to those skilled in the art as a chemical cutter, or an explosive material.

The device 300 is contained within a generally tubular housing 308. The housing 308 protects the device 300 from damage thereto during conveyance into the well. The housing 308 may also include a laterally sloping lower surface 310 which is preferably complementarily shaped relative to the liner portion 52*h*. In this manner, the device 300 may also be complementarily shaped relative to the liner portion 52*h,* enabling it to be closely spaced apart therefrom for enhanced effectiveness of the device 300.

In operation, the apparatus 298 and anchor 304 are conveyed into the subterranean wellbore suspended from the drill pipe 306. The apparatus 298 is rotationally aligned with the liner portion 52*h* so that the lower surface 310 of the housing 308 faces toward the liner portion 52*h*. Such rotational alignment may be achieved using conventional techniques, such as by utilizing a gyroscope. The apparatus 298 is also axially aligned so that the lower surface 310 is closely spaced apart from the liner portion 52*h* using conventional techniques.

The axial, radial, and rotational alignment of the apparatus 298 is secured by setting the anchor 304 in the liner upper portion 34*h*. The anchor 304 may be set by, for example, applying hydraulic pressure to the anchor 304 through the drill pipe 306, or manipulating the drill pipe at the earth's surface. When the anchor 304 is set, it grippingly engages the liner upper portion 34*h*. However, it is to be understood that the anchor 304 may be set elsewhere in the subterranean well, such as in the parent wellbore casing 14*h,* without departing from the principles of the present invention.

When the apparatus 298 has been axially, radially, and rotationally aligned with the liner portion 52*h* and the anchor 304 is set, the firing head 302 is operated to detonate the explosive therein. The firing head 302 may be of the type well known to those skilled in the art and used in conventional perforating operations. The firing head 302 may be operated by, for example, dropping a weight from the earth's surface to impact the firing head, applying hydraulic pressure to the drill pipe 306 to cause displacement of a piston within the firing head, engaging a wireline with the firing head to cause a current to flow through an explosive cap within the firing head, etc. These and many other techniques of detonating an explosive within the firing head 302 are well known to those skilled in the art, and may be utilized without departing from the principles of the present invention. Furthermore, detonation of an explosive may not be necessary to initiate the device 300, for example, a low order burning may be sufficient to initiate the device, or a partition between reactive chemicals may be opened to permit the chemicals to react with each other, etc. It is to be understood that other techniques of initiating the device 300 may be utilized without departing from the principles of the present invention.

When the device 300 has been initiated, an opening is subsequently formed through the liner portion 52*h*. If the device 300 is a Thermol Torch™, the opening is formed by thermal cutting through the liner portion 52*h*. The anchor 304 may then be unset by, for example, applying a sufficient upward force via the drill pipe 306 at the earth's surface to unset the anchor. Alternatively, the anchor 304 may be unset by a downward axial force, a rotational torque, or a combination of forces (downward and/or upward forces, with or without rotational torque), or any other physical manipulation, such as ratcheting or using a J-slot mechanism. The drill pipe 306, anchor 304, and apparatus 298 may then be retrieved from the subterranean wellbore. Thereafter, the opening may be extended axially through the whipstock inner core 40*h* and enlarged utilizing any of the above-described methods. After extending and enlarging the opening, the plug member 46*h* may be removed also by utilizing any of the above-described methods.

Figure 26:
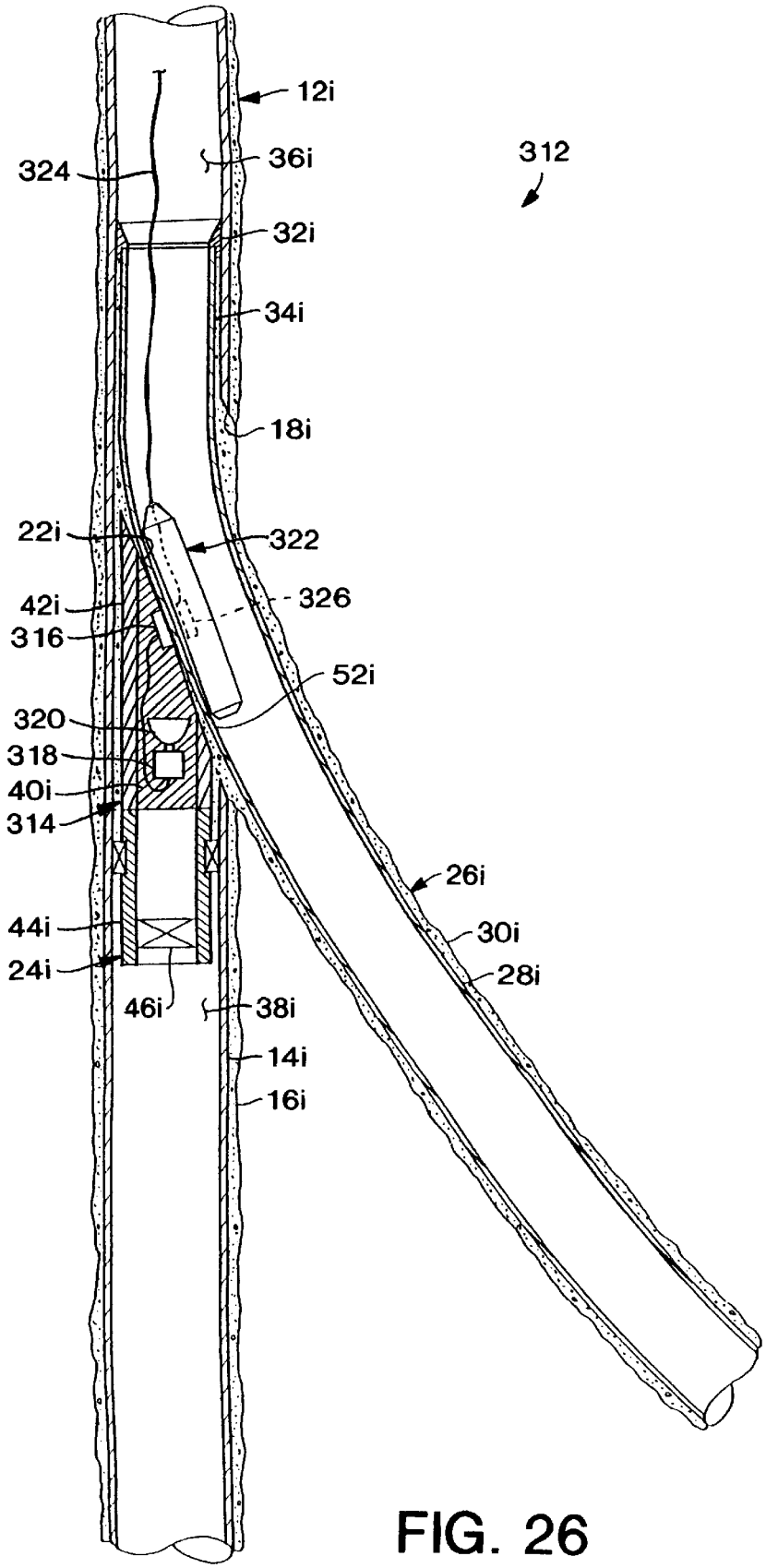
FIG. 26 is a cross-sectional view through a subterranean well illustrating an eighth apparatus and a ninth method of providing access to a lower portion of a parent wellbore wherein an opening is being formed through a liner, the apparatus and method embodying principles of the present invention.

Turning now to FIG. 26, a method 312 of providing access to the lower portion 38*i* of the parent wellbore 12*i* is representatively illustrated. Elements shown in FIG. 26 which are similar to elements previously described are indicated with the same reference numerals, with an added suffix "i".

The method 312 utilizes a uniquely configured whipstock 314 which, unlike the above-described methods, enables the method 312 to form an opening through the liner portion 52*i* from the parent wellbore 12*i* external to the liner 28*i*. For this purpose, the whipstock 314 includes a receiver 316, a delay device 318, and an cutting device 320 disposed within the inner core 40*i*.

The receiver 316 is representatively illustrated as being positioned proximate the whipstock upper surface 22*i,* in order to enhance its reception of a predetermined signal from the liner wellbore 26*i*. The receiver 316 may be of the type capable of receiving acoustic, electromagnetic, nuclear, or other form of signal. It is to be understood that the receiver 316 may be otherwise configured or disposed without departing from the present invention.

The receiver 316 is interconnected to the delay device 318, so that when the receiver receives the predetermined signal, the delay device begins counting down a predetermined time interval. When the predetermined time interval has been counted down, the delay device 318 initiates the explosive device 320. It is to be understood that the delay device 318 may be otherwise activated, for example, the delay device may be activated by applying predetermined pressure pulses to the lateral wellbore 26*i*, without departing from the principles of the present invention.

The cutting device 320 may be a Thermol Torch™, described more fully hereinabove, or, as representatively illustrated in FIG. 26, the cutting device may be a shaped explosive charge of the type well known to those skilled in the art and commonly utilized in well perforating operations. However, other types of cutting devices may be used for the cutting device 320 without departing from the principles of the present invention. When the delay device 318 initiates the cutting device 320, the cutting device forms an opening from the inner core 40*i* and directed through the liner portion 52*i*.

In operation, the receiver 316, delay device 318, and cutting device 320 are operatively positioned within the whipstock inner core 40*i* prior to placement of the whipstock 314 within the parent wellbore casing 14*i*. Thereafter, when it is desired to form an opening through the liner portion 52*i*, preferably a tool 322 conveyable into the parent wellbore upper portion 36*i* is lowered into the lateral wellbore 26*i* suspended from a wireline 324 or electric line, coiled tubing, or drill pipe extending to the earth's surface. The tool 322 includes a transmitter 326 which is capable of producing the predetermined signal.

The transmitter 326 is preferably positioned proximate the liner portion 52*i* closely spaced apart from the receiver 316. The predetermined signal is then produced by the transmitter 326 by, for example, conducting appropriately coded instructions to the transmitter 326 via the wireline 324 from the earth's surface. The receiver 316 then receives the predetermined signal and activates the time delay 318. The time interval counted down by the time delay 318 preferably is sufficiently long for the tool 322 to be retrieved to the earth's surface before the time delay initiates the cutting device 320, so that the tool 322 is unharmed thereby.

When the cutting device 320 has been initiated, an opening is subsequently formed through the liner portion 52*i*. If the device 320 is a Thermol Torch™, the opening is formed by thermal cutting through the inner core 40*i* and liner portion 52*i*. If the device 320 is an explosive shaped charge, the opening is formed by detonation of the explosive, causing the opening to be formed from the inner core 40*i* and through the liner portion 52*i*. Thereafter, the opening may be extended axially downward through the whipstock inner core 40*i* and enlarged utilizing any of the above-described methods. After extending and enlarging the opening, the plug member 46*i* may be removed also by utilizing any of the above-described methods.

Figure 27:
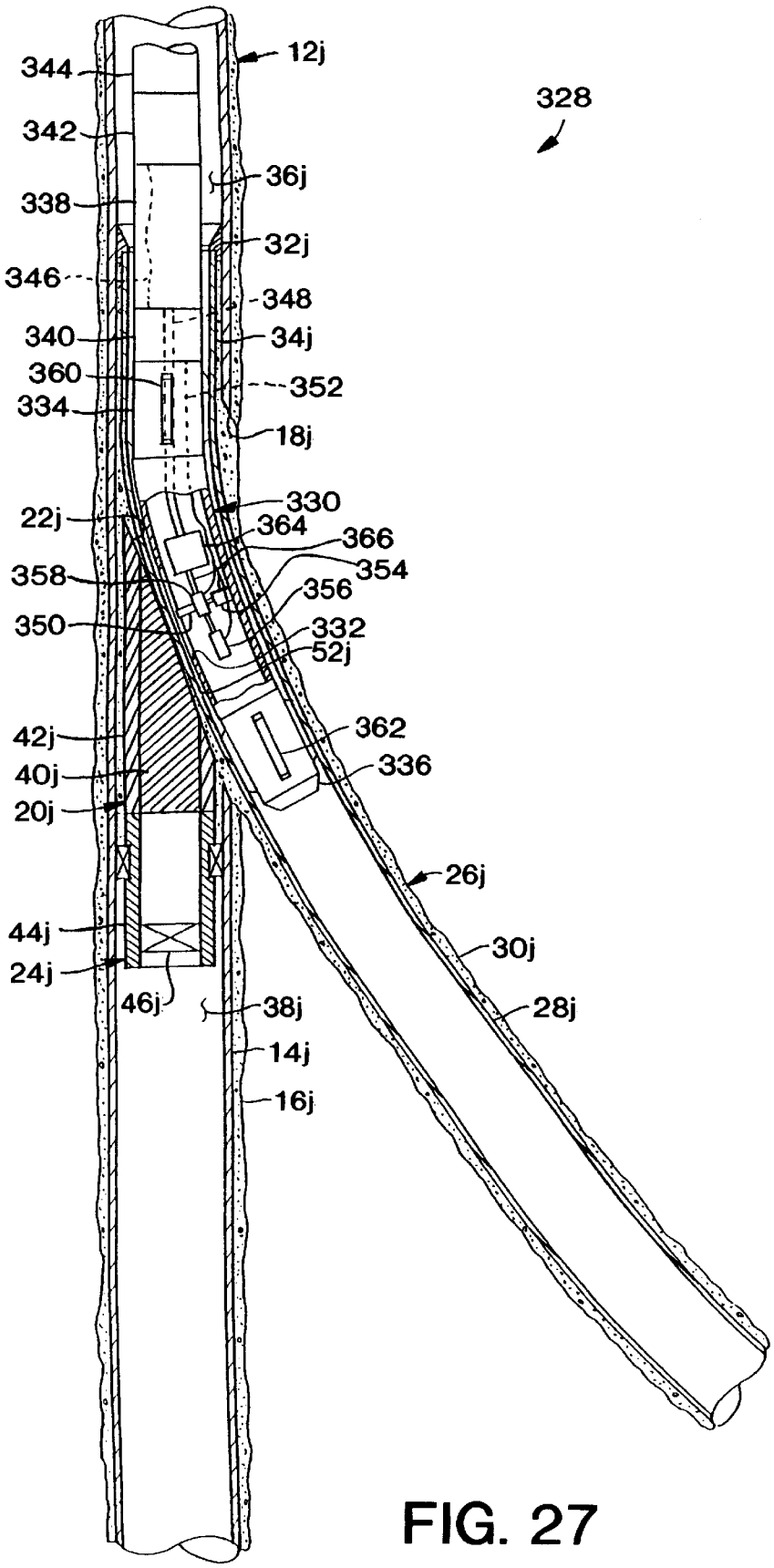
FIG. 27 is a cross-sectional view through a subterranean well illustrating a ninth apparatus and a tenth method of providing access to a lower portion of a parent wellbore wherein an opening is being formed through a liner, the apparatus and method embodying principles of the present invention.

Turning now to FIG. 27, a method 328 of providing access to the lower portion 38*i* of the parent wellbore 12*i* is representatively illustrated. Elements shown in FIG. 27 which are similar to elements previously described are indicated with the same reference numerals, with an added suffix "j".

The method 328 utilizes a uniquely configured apparatus 330 which is capable of forming an opening through the liner portion 52*j*. Accordingly, the apparatus 330 is representatively illustrated in FIG. 27 as being positioned within the lateral wellbore 26*j* adjacent the liner portion 52*j*, a radially extending opening 332 formed on the apparatus being axially and rotationally aligned with the liner portion 52*j*. In the method 328, the apparatus 330, upper and lower stabilizers 334, 336, respectively, a mud motor 338, a cutter controller 340, and a signal processor 342 are lowered into the subterranean well suspended from drill pipe 344 or coiled tubing extending to the earth's surface. The upper and lower stabilizers 334, 336 provide radial spacing within the wellbore.

The signal processor 342 is preferably of the type well known to those skilled in the art which is capable of receiving, decoding, and transmitting signals via pressure pulses in mud circulated therethrough from the earth's surface via the drill pipe 344. Such signal processors are commonly utilized in techniques know to those skilled in the art as "measurement while drilling". The signal processor 342 utilized in the method 328 is interconnected to the cutter controller 340 via communications line 346, such that signals transmitted from the earth's surface and received by the signal processor 342 may be communicated to the cutter controller 340 for purposes which will become apparent upon consideration of the further description of the method 328 hereinbelow, and such that signals transmitted from the cutter controller 340 via the communications line 346 to the signal processor 342 may be thereby communicated to the earth's surface. Thus, the signal processor 342 enables two-way communication between the cutter controller 340 and the earth's surface via mud circulating through the signal processor. It is to be understood that other techniques of communication between the cutter controller 340 and the earth's surface, for example, by a wireline, may be provided, and the signal processor 342 may be otherwise disposed in the method 328, without departing from the principles of the present invention.

The mud motor 338 is disposed axially between the signal processor 342 and the cutter controller 340. The mud motor 338 has the communications line 346 extending axially therethrough and is otherwise conventional, the mud motor producing rotation of a generally axially extending shaft 348 in response to mud circulation therethrough. Such shaft rotation is utilized in the apparatus 330 to drive a cutting device 350 disposed within the apparatus and extendable radially outward through the opening 332, and/or to displace the cutting device 350 relative to the remainder of the apparatus. However, it is to be understood that other techniques of driving and/or displacing the cutting device 350, such as providing electric motors or solenoid valves, etc., may be utilized, and the mud motor 338 may be otherwise disposed in the method 328, without departing from the principles of the present invention.

The cutter controller 340 is shown disposed axially between the mud motor 338 and the upper stabilizer 334. The cutter controller 340 contains conventional circuitry for controlling the displacement of the cutting device 350 relative to the remainder of the apparatus 330. For this purpose, communications lines 352 extend axially downward from the cutter controller 340 to actuators 354, 356, and 358 disposed within the apparatus 330. The actuators 354, 356, 358 are conventional and are operative to displace the cutting device 350 in radial, axial, and tangential (rotational) directions, respectively relative to the remainder of the apparatus 330. Thus, if, for example, the cutter controller 340 receives a signal from the signal processor 342 indicating that the cutting device 350 is to be extended radially outward through the opening 332, the cutter controller 340 will activate the actuator 354 to radially outwardly displace the cutting device 350 as desired. Similarly, the cutting device 350 may be directed to displace axially or rotationally by correspondingly activating the actuator 356 and/or 358, respectively.

It is to be understood that other techniques of displacing the cutting device 350 with respect to the apparatus 330 may be provided without departing from the principles of the present invention. For example, a template may be provided for mechanically translating rotation of the shaft 348 into corresponding axial, radial and rotational displacement of the cutting device 350, in which case the desired opening through the liner portion 52*j* may be formed by circulating mud through the mud motor 338 to thereby produce rotation of the shaft 348, thereby driving the cutting device 350 and/or displacing the cutting device axially, radially, and rotationally, without the need for the signal processor 342 or the cutter controller 340.

In an alternate construction of the apparatus 330, the cutting device 350 may be a cutting tool as used on a milling machine in a typical machine shop operation. In that case, the cutting tool may be rotated by the mud motor 338 and a screw drive geared to the mud motor rotation may cause axial advancement of the cutting tool in an axial direction. The TRACS™ type tool (see FIG. 15 and the accompanying detailed description hereinabove) may be used in this case, together with wedge devices to adjust a depth of cut of the cutting tool for each pass of the cutting tool, with multiple passes potentially required to cut a given wall thickness of a known material. A controlled profile of the opening from the lateral wellbore 26*j* to the parent wellbore 12*j* through the liner portion 52*j* may thus be formed.

The upper stabilizer 334 is disposed axially between the cutter controller 340 and the apparatus 330. The upper stabilizer 334 is of conventional construction except in that the shaft 348 and communications lines 352 extend axially therethrough. In the method 328, the upper stabilizer 334 is utilized to prevent rotation of the apparatus 330 relative to the liner 28*j*, and for this purpose, the upper stabilizer has a series of circumferentially spaced apart fins 360 disposed thereon which are preferably made of a rubber material, and which grippingly engage the liner 28*j* to thereby prevent relative rotation therebetween. However, other techniques may be utilized to prevent rotation of the apparatus 330 within the liner 28*j*, such as an anchor, and the upper stabilizer 334 may be otherwise disposed in the method 328, without departing from the principles of the present invention.

The lower stabilizer 336 is similar to the upper stabilizer 334 in that it is utilized to prevent relative rotation between the apparatus 330 and the liner 28*j*, and it has radially outwardly extending fins 362 disposed thereon for this purpose. Thus, the apparatus 330 is disposed axially between the upper and lower stabilizers 334, 336, respectively. As with the upper stabilizer 334, other rotationally restrictive techniques may be utilized, and the lower stabilizer 336 may be otherwise disposed in the method 328, without departing from the principles of the present invention.

The apparatus 330 may include a gearbox 364 which is operative to receive the shaft 348 rotation and transmit power therefrom to the cutting device 350. In the representatively illustrated apparatus 330, the gearbox 364 is connected to the cutting device 350 via a flexible shaft 366, so that, as the cutting tool 350 is displaced relative to the apparatus 330, the gearbox 364 remains connected thereto. It is to be understood that other techniques may be utilized for operatively connecting the shaft 348 to the cutting device 350 without departing from the principles of the present invention. Additionally, where the cutting device 350 is directed to displace by a template, as described hereinabove, the gearbox may also be utilized to displace the cutting device relative to the template without departing from the principles of the present invention.

The cutting device 350 may be similar to a metal cutting mill as commonly utilized in a machine shop, or the cutting device may be a fluid jet, a plasma torch, a metal cutting laser, etc., without departing from the principles of the present invention. Substantially any device capable of cutting through the liner portion 52*j* may be utilized for the cutting device 350.

In operation, the apparatus 330 is lowered into the subterranean well with the signal processor 342, mud motor 338, cutter controller 340, and upper and lower stabilizers 334, 336, respectively, suspended from the drill pipe 344. The apparatus 330 is then aligned axially, rotationally, and radially with respect to the liner 28*j*, so that the opening 332 is facing the liner portion 52*j* overlying the whipstock 20*j*. Such axial, rotational, and radial alignment may be achieved by conventional techniques, such as by utilizing a gyroscope. At this point the cutting device 350 is radially inwardly retracted with respect to the opening 332.

When it is desired to form an opening through the liner portion 52*j*, mud is circulated through the drill pipe 344 from the earth's surface, and is likewise circulated through the signal processor and the mud motor 338. A predetermined signal is sent to the signal processor 342 to instruct the cutter controller 334 to activate the actuators 354, 356, 358 to displace the cutting device 350 radially, axially, and rotationally relative to the apparatus 330, the cutting device 350 at this time being driven by the mud motor 338.

Preferably, the actuators 354, 356, 358 are activated to first radially outwardly extend the cutting device 350 through the opening 332. When the cutting device 350 has extended sufficiently radially outward from the apparatus 330, the cutting device will cut and penetrate into the liner portion 52*j*. The actuators 354, 356, 358 may then be activated to cut a desired opening profile through the liner portion 52*j*, the cutter controller 340 directing such displacement of the cutting device 350.

It is contemplated that the cutter controller 340 is capable of communicating via the signal processor 342 with appropriate equipment on the earth's surface for indicating certain parameters which would be of interest, such as cutting device speed, relative displacement of the cutting device 350, etc., thereby permitting real time control of the cutting device 350 from the earth's surface.

When the cutting device 350 has cut the desired opening profile through the liner portion 52*j*, the cutting device is retracted radially inward through the opening 332. The apparatus 330, signal processor 342, mud motor 338, cutter controller 340, upper and lower stabilizers 334, 336, respectively, and the drill pipe 344 may then be retrieved from the subterranean well to the earth's surface. Thereafter, the opening through the liner portion 52*j* may be extended axially downward through the whipstock inner core 40*j* and enlarged utilizing any of the above-described methods. After extending and enlarging the opening, the plug member 46*j* may be removed also by utilizing any of the above-described methods.

Figure 28:
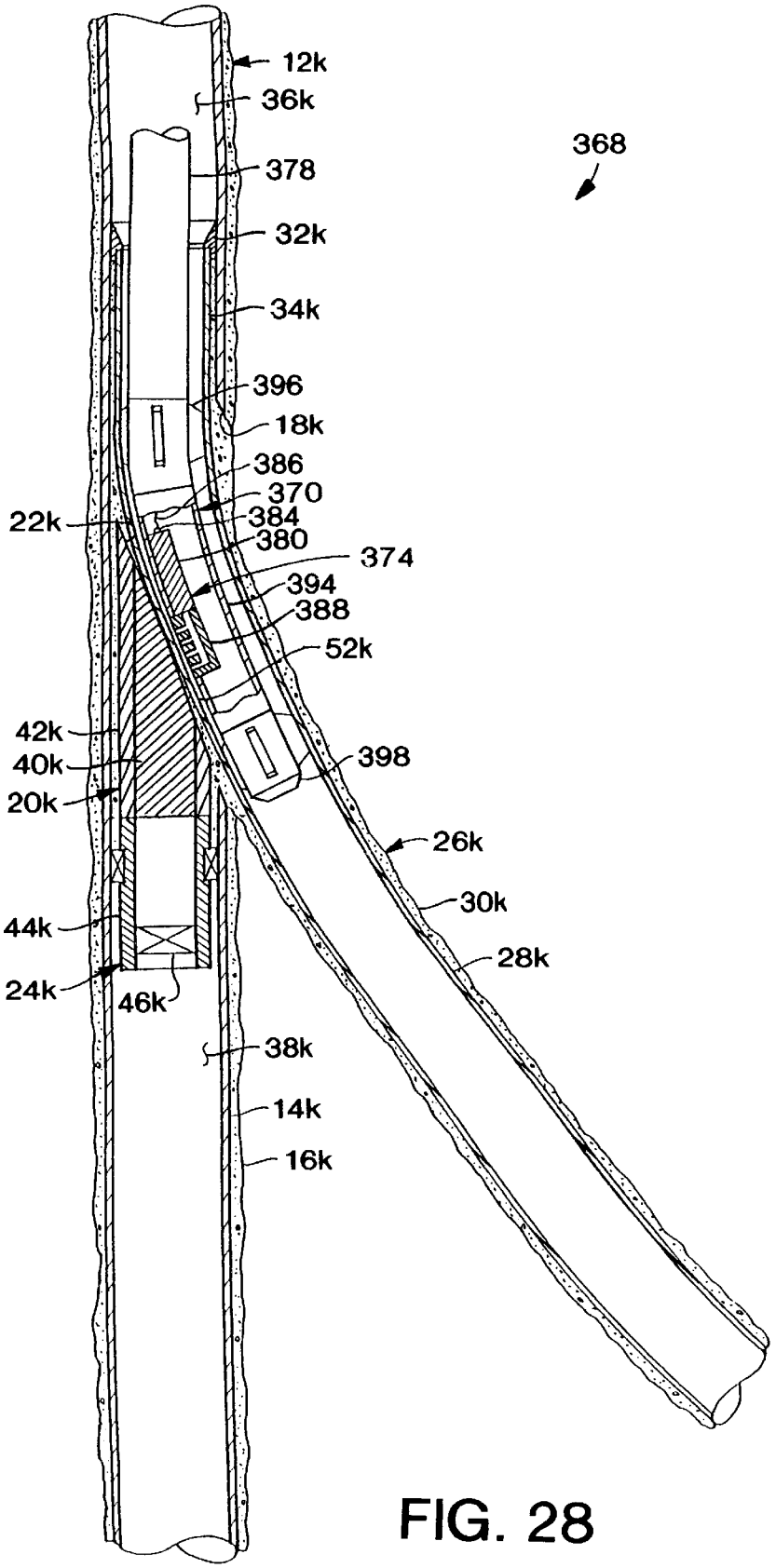
FIG. 28 is a cross-sectional view through a subterranean well illustrating a tenth apparatus and an eleventh method of providing access to a lower portion of a parent wellbore wherein an opening is being formed through a liner, the apparatus and method embodying principles of the present invention.
Figure 29:
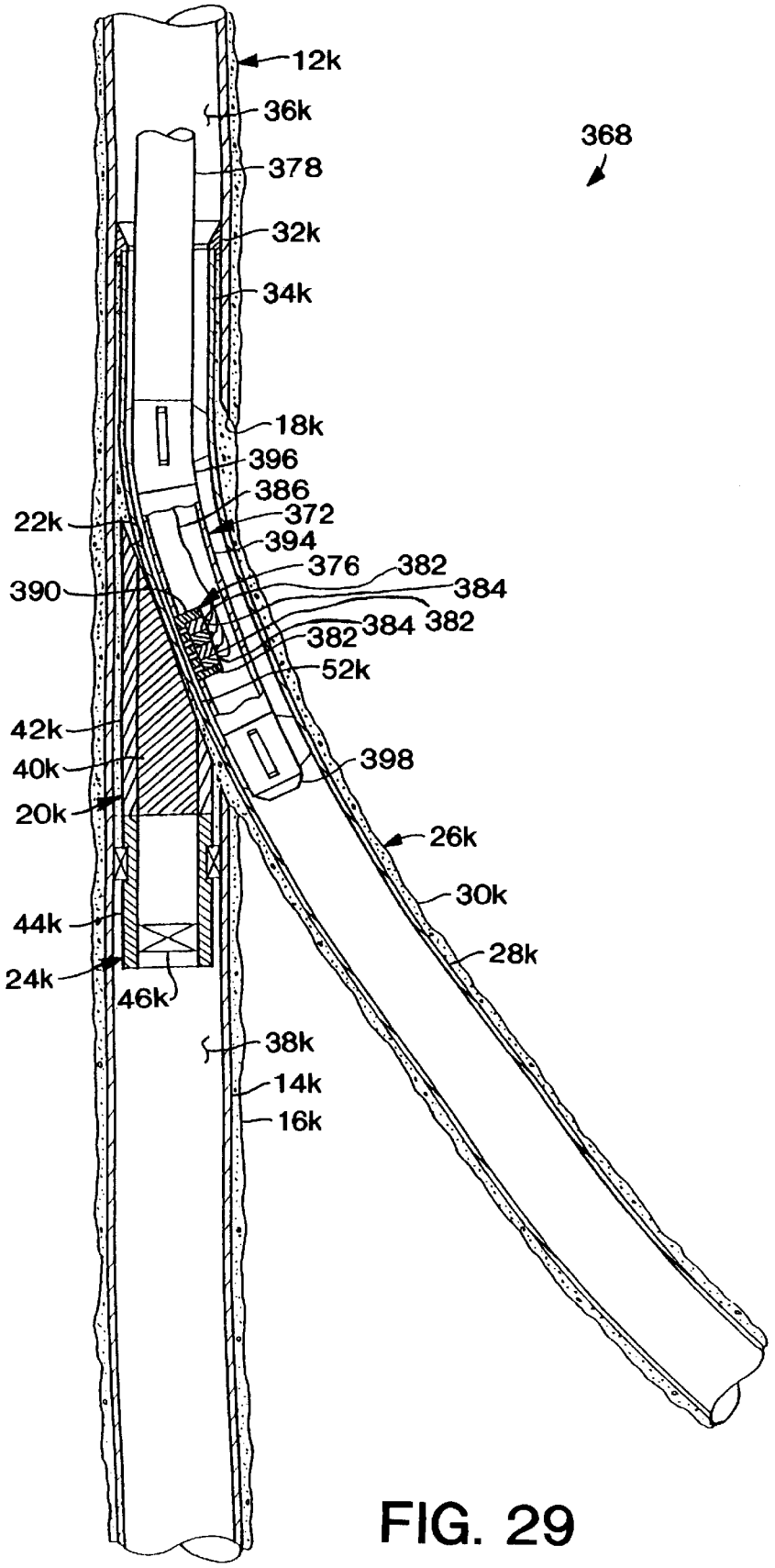
FIG. 29 is a cross-sectional view through a subterranean well illustrating an eleventh apparatus and a twelfth method of providing access to a lower portion of a parent wellbore wherein an opening is being formed through a liner, the apparatus and method embodying principles of the present invention.

Turning now to FIGS. 28 and 29, a method 368 of providing access to the lower portion 38*k* of the parent wellbore 12*k* is representatively illustrated. Elements shown in FIGS. 28 and 29 which are similar to elements previously described are indicated with the same reference numerals, with an added suffix "k".

The method 368 as representatively illustrated in FIG. 28 utilizes a uniquely configured apparatus 370 for forming an opening through the liner portion 52*k*. The method 368 as representatively illustrated in FIG. 29 utilizes a uniquely configured apparatus 372, which is similar to the apparatus 370. For forming an opening through the liner portion 52*k*, each of the apparatus 370 and 372 include a cutting device 374 and 376, respectively, operatively disposed therein.

Each of the apparatus 370 and 372 is suspended from, and conveyed into the subterranean well by, drill pipe 378 or coiled tubing, and is axially and rotationally aligned relative to the liner portion 52*k* by conventional methods, such as by utilizing a gyroscope. It is to be understood that the apparatus 370 and/or 372 may be conveyed into the subterranean well by other methods, such as suspended from wireline, slickline, etc., without departing from the principles of the present invention.

The device 374 preferably includes a thermal cutter 380 of the type known as a Thermol Torch™ marketed by Halliburton Energy Services, Incorporated of Alvarado, Tex., more fully described hereinabove in the detailed description of the method 296 accompanying FIG. 25. The Thermol Torch™ is capable of cutting through metal, such as the liner portion 52*k*, or other materials upon being initiated. The cutting device 376 preferably includes a plurality of such Thermol Torch™ thermal cutters 382. It is to be understood that the device 374 or 376 may be other than a Thermol Torch™ without departing from the principles of the present invention, for example, the device 374 may be of the type well known to those skilled in the art as a chemical cutter, or an explosive material.

For initiating the thermal cutters 380, 382, the apparatus 370, 372 include conventional initiators 384 operatively connected to each of the thermal cutters, only one such initiator being utilized in the apparatus 370 as the device 374 includes only one thermal cutter 380. According to conventional practice, initiators, such as initiators 384, are typically activated by applying electrical current therethrough via conductors, such as conductors 386, connected thereto. Such electrical current may be supplied by wireline extending to the earth's surface, or may be provided by other techniques, such as by dropping a conventional battery pack down through the drill pipe 378 or coiled tubing from the earth's surface.

Each initiator 384 contains a conventional explosive, so that when the explosive is detonated, the thermal cutter 380 or 382 to which it is connected will begin burning. The resulting burn of the thermal cutters 380 or 382 is directed radially outward from the apparatus 370 or 372, respectively, by a series of nozzles disposed on a nozzle manifold 388, 390, respectively. The nozzles are shown in FIGS. 28 and 29 as radially outwardly extending openings formed through the nozzle manifolds 388, 390.

Preferably, the nozzle manifolds 388, 390 each include a plurality of nozzles arranged in a two dimensional array, such that an opening in the liner portion 52*k* overlying the whipstock 20*k* is formed in the shape of the array. Although the nozzle manifolds 388, 390 as representatively illustrated in FIGS. 28 and 29 have the nozzles arranged axially, it will be readily apparent to one of ordinary skill in the art that such array of nozzles may also extend circumferentially about the apparatus 370 and/or 372. With the nozzle arrays extending both partially axially and partially circumferentially about the apparatus 370 and/or 372, the nozzle arrays are seen to define a two dimensional area of the liner portion 52*k* through which the thermal cutters 380 and/or 382 will burn to thereby form an opening through the liner portion when the initiators are activated. The assignee of the present invention, and certain of the applicants herein, have performed tests wherein nozzles having diameters of approximately 0.125 inch and being interconnected at their outlets by a triangular cross-section groove having a width of approximately 0.125 inch were formed on a nozzle manifold, sixteen of such nozzles being utilized in the nozzle manifold for the test, with satisfactory results in forming an opening through metal plate obtained therefrom.

Each of the cutting devices 374, 376 is contained within a generally tubular housing 394. The housing 394 protects the device 374 or 376 from damage thereto during conveyance into the well. Upper and lower centralizers 396, 398, respectively, are disposed axially straddling the housing 394 and operatively connected thereto. The centralizers 396, 398 may laterally offset the housing 394 toward the liner portion 52*k* within the liner 28*k* for enhanced effectiveness of the cutting device 374 or 376 as shown in FIGS. 28 and 29, and may act to laterally constrain the apparatus 370 or 372, preventing lateral displacement of the apparatus away from the liner portion 52*k* during burning of the thermal cutter or cutters 380 or 382.

In operation, the apparatus 370 or 372 is conveyed into the subterranean wellbore suspended from the drill pipe 378. The apparatus 370 or 372 is axially and rotationally aligned with the liner portion 52*k* so that the nozzle manifold 390 or 392, respectively, faces toward the liner portion 52*k*. Such rotational alignment may be achieved using conventional techniques, such as by utilizing a gyroscope. The axial and rotational alignment of the apparatus 370 or 372 may then be secured by setting an anchor (not shown) connected thereto in the liner 28*k* or casing 14*k*, but such setting of the anchor is not necessary in the method 368.

When the apparatus 370 or 372 has been axially and rotationally aligned with the liner portion 52*k*, the initiator or initiators 384, respectively, is activated to detonate the explosive therein. The initiators 384 may be activated by applying electrical current thereto as described hereinabove, or a firing head of the type well known to those skilled in the art and used in conventional perforating operations may be utilized. The firing head may be operated by, for example, dropping a weight from the earth's surface to impact the firing head, applying hydraulic pressure to the drill pipe 378 to cause displacement of a piston within the firing head, engaging a wireline with the firing head to cause a current to flow through the initiators 384, etc. These and many other techniques of detonating an explosive within the firing head are well known to those skilled in the art, and may be utilized without departing from the principles of the present invention. Furthermore, detonation of an explosive may not be necessary to initiate the thermal cutter 380 or 382, for example, a low order burning may be sufficient to initiate the thermal cutter, or a partition between reactive chemicals may be opened to permit the chemicals to react with each other, etc. It is to be understood that other techniques of initiating the thermal cutter 380 or 382 may be utilized without departing from the principles of the present invention.

When the thermal cutter or cutters 380 or 382, respectively, has been initiated, an opening is subsequently formed through the liner portion 52*k*. If the cutter 380 or 382 is a Thermol Torch™, the opening is formed by thermal cutting through the liner portion 52*k* in the shape of the array of nozzles on the nozzle manifold 388 or 390, respectively. The drill pipe 378, upper centralizer 396, lower centralizer 398, anchor (if utilized), and apparatus 370 or 372 may then be retrieved from the subterranean wellbore. Thereafter, the opening may be extended axially through the whipstock inner core 40*k* and enlarged utilizing any of the above-described methods. After extending and enlarging the opening, the plug member 46*k* may be removed also by utilizing any of the above-described methods.

The foregoing detailed description is to be clearly understood as being given by way of illustration and example only, the spirit and scope of the present invention being limited solely by the appended claims.

What is claimed is:

1. A method of forming an opening through a tubular structure extending laterally across a wellbore to thereby provide access to the wellbore, the method comprising the steps of:

providing an apparatus having a cutting device including a cutting fluid source disposed therein and a series of spaced apart nozzles radially outwardly directed therefrom, the cutting fluid source being connected to the nozzles, so that a cutting fluid is flowable from the cutting fluid source through the nozzles;

positioning the apparatus within the tubular structure, said tubular structure having an inner wall, wherein the nozzles are directed toward the inner wall of the tubular structure proximate the location where the tubular structure laterally extends across the wellbore;

activating the cutting device; and directing the cutting fluid to cut into the tubular structure proximate the location where the tubular structure laterally extends across the wellbore.

2. The method according to claim 1, wherein the step of activating the cutting device comprises initiating at least one thermal cutter.

3. The method according to claim 1, wherein the step of activating the cutting device comprises initiating at least one chemical cutter.

4. The method according to claim 1, wherein the step of providing the apparatus further comprises providing the nozzles disposed in a two-dimensional array.

5. The method according to claim 1, wherein the step of providing the apparatus further comprises providing the cutting fluid source including a plurality of thermal cutters, each of the thermal cutters being connected to at least one of the nozzles.

6. A method of completing a subterranean well, comprising the steps of:

drilling a lateral wellbore intersecting a parent wellbore of the well;

positioning a liner within the well, a first portion of the liner extending into the lateral wellbore, a second portion of the liner extending axially into the parent wellbore, and a third portion of the liner extending laterally across the parent wellbore;

disposing an apparatus within the third portion, the apparatus including a housing containing a cutting device therein, the cutting device being operative to discharge a cutting fluid from at least one nozzle, the nozzle being radially directed relative to the housing;

aligning the nozzle with a sidewall of the third portion; and cutting through the sidewall by flowing the cutting fluid through the nozzle, without rotation of the cutting device.

7. The method according to claim 6, wherein the aligning step further comprises aligning a plurality of the nozzles with the sidewall, and wherein the cutting step further comprises cutting a two-dimensional shape out of the sidewall, the shape corresponding to an array of the plurality of the nozzles.

8. The method according to claim 6, further comprising the step of anchoring a whipstock in the parent wellbore, and wherein the cutting step further comprises cutting through the sidewall overlying the whipstock.

9. The method according to claim 6, further comprising the step of anchoring a whipstock in the parent wellbore, the whipstock including an inner core made of a material having a hardness different from that of an outer case of the whipstock, and wherein the cutting step further comprises cutting through the sidewall overlying the inner core.

10. The method according to claim 9, further comprising the step of enlarging an opening formed through the sidewall in the cutting step.

11. The method according to claim 10, wherein the enlarging step further comprises extending the opening through the whipstock, thereby substantially removing the inner core from the whipstock.

* * * * *